US008529703B2

(12) United States Patent
Kabashima et al.

(10) Patent No.: US 8,529,703 B2
(45) Date of Patent: Sep. 10, 2013

(54) CLEANING AGENT, CLEANING METHOD AND CLEANING APPARATUS

(75) Inventors: Kazuo Kabashima, Yokohama (JP); Kenichi Kato, Kawasaki (JP); Shoji Matsumoto, Tokyo (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 865 days.

(21) Appl. No.: 12/409,360

(22) Filed: Mar. 23, 2009

(65) Prior Publication Data

US 2009/0229633 A1 Sep. 17, 2009

Related U.S. Application Data

(62) Division of application No. 10/296,960, filed as application No. PCT/JP01/03839 on May 8, 2001, now Pat. No. 7,531,495.

(30) Foreign Application Priority Data

Jun. 1, 2000 (JP) ..... 2000-165065

(51) Int. Cl.
*C11D 7/50* (2006.01)
*C11D 7/28* (2006.01)

(52) U.S. Cl.
CPC ..... *C11D 7/28* (2013.01)
USPC ..... 134/10; 134/40

(58) Field of Classification Search
USPC ..... 134/10, 40
See application file for complete search history.

(56) References Cited

U.S. PATENT DOCUMENTS

| | | | | |
|---|---|---|---|---|
| 4,984,318 | A * | 1/1991 | Coindreau-Palau | 8/158 |
| 5,055,138 | A * | 10/1991 | Slinn | 134/11 |
| 5,205,857 | A | 4/1993 | Yokoyama | |
| 5,248,456 | A | 9/1993 | Evans, Jr. et al. | |
| 5,370,143 | A | 12/1994 | Takahashi | |
| 5,401,321 | A | 3/1995 | Hugo et al. | |
| 5,454,969 | A | 10/1995 | Fields et al. | |
| 5,498,266 | A * | 3/1996 | Takagawa et al. | 8/142 |
| 5,509,431 | A | 4/1996 | Smith, Jr. et al. | |
| 5,512,198 | A | 4/1996 | Sasaki et al. | |
| 5,567,348 | A | 10/1996 | Nozawa et al. | |
| 5,599,783 | A | 2/1997 | Ide et al. | |
| 5,629,352 | A | 5/1997 | Shiino et al. | |

(Continued)

FOREIGN PATENT DOCUMENTS

| | | |
|---|---|---|
| DE | 297 752 A7 | 1/1992 |
| EP | 0 431 458 A1 | 6/1991 |

(Continued)

*Primary Examiner* — Gregory Webb
(74) *Attorney, Agent, or Firm* — Birch, Stewart, Kolasch & Birch, LLP

(57) ABSTRACT

A cleaning agent or a rinsing agent having no flash point which comprises a chlorine-free fluorine-containing compound have a vapor pressure at 20° C. of $1.33\times10^3$ Pa or more and one or more components having a vapor pressure at 20° C. less than $1.33\times10^3$ Pa and optionally an additive such as an antioxidant; a method for cleaning which comprises cleaning with the cleaning agent and rinsing and/or vapor cleaning utilizing a vapor being generated by boiling the cleaning agent or a condensate thereof; a method for separating a soil which comprises contacting a cleaning agent in a cleaning tank with a condensate of the vapor of the cleaning agent in a soil separating tank, to thereby continuously separate and remove a soil contained in the cleaning agent; and a cleaning apparatus.

22 Claims, 7 Drawing Sheets

(56) References Cited

U.S. PATENT DOCUMENTS

| | | | | |
|---|---|---|---|---|
| 5,639,719 | A | 6/1997 | Tanaka et al. | |
| 5,747,437 | A | 5/1998 | Michaud | |
| 5,908,822 | A | 6/1999 | Dishart | |
| 5,962,385 | A | 10/1999 | Maruyama et al. | |
| 5,968,882 | A | 10/1999 | Matsuhisa et al. | |
| 6,004,434 | A * | 12/1999 | Kiany | 203/3 |
| 6,008,179 | A | 12/1999 | Flynn et al. | |
| 6,043,201 | A | 3/2000 | Milbrath et al. | |
| 6,074,573 | A | 6/2000 | Kaneko | |
| 6,159,917 | A | 12/2000 | Baran, Jr. et al. | |
| 6,172,031 | B1 | 1/2001 | Stevens | |
| 6,310,018 | B1 | 10/2001 | Behr et al. | |
| 6,372,700 | B1 | 4/2002 | Zazerra et al. | |
| 6,401,353 | B2 | 6/2002 | Kimura | |
| 6,478,880 | B1 | 11/2002 | Shank | |
| 6,492,309 | B1 | 12/2002 | Behr et al. | |
| 6,537,380 | B2 | 3/2003 | Zazerra et al. | |
| 6,846,790 | B2 * | 1/2005 | Evers et al. | 510/285 |
| 7,531,495 | B2 * | 5/2009 | Kabashima et al. | 510/407 |
| 2001/0020337 | A1 | 9/2001 | Kimura | |
| 2002/0038480 | A1 * | 4/2002 | Deak et al. | 8/142 |
| 2002/0107160 | A1 | 8/2002 | Zazzera et al. | |
| 2003/0224956 | A1 | 12/2003 | Miller et al. | |
| 2004/0224870 | A1 | 11/2004 | Doyel et al. | |

FOREIGN PATENT DOCUMENTS

| | | | |
|---|---|---|---|
| EP | 0 480 784 | A | 4/1992 |
| EP | 771865 | A1 | 5/1997 |
| GB | 817 849 | A | 8/1959 |
| GB | 897 792 | A | 5/1962 |
| JP | 7-173498 | | 7/1995 |
| JP | 9-194890 | A | 7/1997 |
| JP | 10-036894 | A | 2/1998 |
| JP | 10-192797 | A | 7/1998 |
| JP | 10-212498 | A | 8/1998 |
| JP | 10-251692 | A | 9/1998 |
| JP | 10-277507 | A | 10/1998 |
| JP | 11-128854 | | 5/1999 |
| JP | 2000-008095 | A | 1/2000 |
| JP | 2000-154400 | A | 6/2000 |
| JP | 2000-192090 | A | 7/2000 |
| JP | 2001-131593 | A | 5/2001 |
| JP | 2001-131594 | A | 5/2001 |
| WO | WO-98/37575 | A1 | 8/1998 |
| WO | WO-99/31214 | A | 6/1999 |

* cited by examiner

CLEANING AGENT, CLEANING METHOD AND CLEANING APPARATUS

This application is a Divisional of co-pending application Ser. No. 10/296,960 filed on Nov. 29, 2002 and for which priority is claimed under 35 U.S.C. §120. Application Ser. No. 10/296,960 is the national phase of PCT International Application No. PCT/JP01/03839 filed on May 8, 2001 under 35U.S.C. § 371. The entire contents of each of the above-identified applications are hereby incorporated by reference.

TECHNICAL FIELD

The present invention relates to a cleaning agent, a rinsing agent, a cleaning method, a soil-separating method and a cleaning apparatus, which are suitably used for cleaning all kinds of contaminants such as working oil, grease and wax used in processing precision machine parts, optical machine parts and the like, flux used in soldering electrical and electronic parts, liquid crystals and the like.

BACKGROUND ART

When processing precision machine parts, optical machine parts and the like, various kinds of working oil such as cutting oil, pressing oil, drawing oil, hot-treating oil, rust preventing oil, lubricating oil and the like, grease, wax and the like are used. It is necessary to remove contamination caused by them at the final stage, and the removal has been generally carried out using a solvent.

As a joining process for electronic circuitry, soldering has been the most generally carried out. It is usual that a metal surface to be soldered is previously treated with flux containing rosin as a main component for the purpose of removing any oxide on the surface to be soldered, cleaning said surface, preventing re-oxidation thereof and improving the solder-wetting property. As a soldering process, there are processes such as a process comprising dipping a substrate in flux of a solution state, thereby attaching the flux on the substrate surface, and thereafter supplying a melted solder thereto; and a process comprising supplying a paste obtained by mixing powders of flux and solder to a spot to be soldered, followed by heating. In any case, after soldering, it is necessary to sufficiently remove the flux residue, which causes metal corrosion and deterioration of insulation.

In carrying out cleaning and removal thereof, a solvent such as 1,1,2-trichloro-1,2,2-trifluoroethane (hereinafter referred to as CFC113) and a mixture of CFC113 and an alcohol has been used from a viewpoint of many characteristic features such as non-flammability, low toxicity and superior dissolution property. However, there had been noted an environmental pollution problem of the earth, including ozonosphere destruction, due to CFC113, and in Japan, the production thereof had been wholly abolished in the end of 1995. As a substitute for CFC113, there have been proposed hydrochloro-fluorocarbons such as a mixture of 3,3-dichloro-1,1,1,2,2-pentafluoropropane and 1,3-dichloro-1,1,2,2,3-pentafluoropropane (hereinafter referred to as HCFC225) and 1,1-dichloro-1-fluoroethane (hereinafter referred to as HCFC141b). However, in Japan, it is intended to inhibit the use thereof by 2020 because of a little ozonosphere destruction ability.

Further in recent years, there have been proposed non-flammable fluorine solvents, such as hydro-fluorocarbons (hereinafter referred to as HFC), hydro-fluoroethers (hereinafter referred to as HFE) and the like, which are completely free from ability to cause ozonosphere destruction, and which are completely free of chlorine atoms. However, these solvents are inferior in dissolution ability because of the absence of chlorine atoms, so that these solvents by themselves cannot be used as a cleaning agent. Accordingly, JP-A 10-36894 and JP-A 10-192797 disclose a technique, according to which cleaning is carried out with a cleaning agent obtained by adding a high boiling solvent to HFC or HFE, and thereafter HFC or HFE is used as a rinsing agent.

However, since both inventions propose use of a high boiling solvent for the cleaning agent, there remain problems such that the drying property of a material to be cleaned decreases and soil accumulating in the cleaning agent increase, thereby causing re-adhesion of soil on the surface of a material to be cleaned. Therefore, in order to improve such cleaning methods, JP-A 2000-8096 proposes a process, according to which there is provided a rinsing tank in which HFC or HFE having low soil dissolution ability and superior drying property are placed, so that the high boiling component having superior dissolution property is rinsed, and at the same time, a rinsing liquid in the rinsing tank is used to separate soil accumulating in the cleaning agent. However, the rinsing liquid in the rinsing tank is used, and therefore, the soil-separating ability remarkably deteriorates, so that the soil cannot be separated with high efficiency.

As described above, in the existing circumstances, the cleaning agent and the cleaning method so far-proposed as a substitute of CFC113 have many problems when used as a cleaning agent such that even if used for cleaning, some will be prohibited to be used in the future because of the problem of ozonosphere destruction, or even if soil accumulating in the cleaning agent can be separated in a continuous manner, the separating efficiency of soil in the cleaning agent remarkably deteriorates, because the rinsing liquid in the rinsing tank is used up.

DISCLOSURE OF INVENTION

An object of the present invention is to provide a cleaning agent and a rinsing agent, which can exhibit high cleaning power to all kinds of soil comparable to HCFC225, while preventing deterioration of cleaning property owing to re-adhesion of soil on the surface of a material to be cleaned, and preventing oxidation deterioration at the time of cleaning at a high temperature or vapor-cleaning, and which contain a high boiling solvent having low toxicity, low inflammability and no fear of ozonosphere destruction and superior in its cleaning property, and also provide a cleaning method, a soil-separating method and a cleaning apparatus, which are suitable for the foregoing cleaning agent or/and the foregoing rinsing agent.

The present inventor has studied a cleaning agent, a rinsing agent, a cleaning method, a soil-separating method and a cleaning apparatus, respectively, to accomplish the above-mentioned object. With respect to the cleaning agent, as a result of extensive studies to find a low flammability cleaning agent taking advantage of an evaporation controlling effect and superior soil dissolution characteristics of a component (b), it has been found that when (a1) a chlorine-free fluorine-containing compound having a vapor pressure of not less than $1.33\times10^3$ Pa at 20° C., and (b) a component having a vapor pressure of less than $1.33\times10^3$ Pa at 20° C., which are different from each other in evaporation rate, are used in combination, cleaning power against contamination can be improved without detriment to characteristics of no flash point peculiar to the component (a1). Further, it has been found that when (a2) at least one compound having a vapor pressure of not less than $1.33\times10^3$ Pa at 20° C., which is selected from the group consisting of alcohols, ketones, esters and hydrocarbons, or a combination of (b1) glycol ether monoalkyl ethers and (b2) glycol ether dialkyl ethers is used in combination, a higher cleaning effect can be obtained and all kinds of soil can be cleaned. Furthermore, it has been found that glycol ethers, glycol ether acetates and hydroxycarboxylic acid esters included in the component (b) have an effect of controlling a possibility of flash, and therefore, the amount of the component (a2) added can be increased. Still further, it has been found that when the component (b) is the glycol ether, an antioxidant (c) or a ultraviolet absorber (d) can be used in combination, and as a result, oxidation inhibition can be attained.

With respect to the rinsing agent, the inventor has extensively studied to find a rinsing agent having superior rinsing property taking advantage of characteristics of high drying property peculiar to the component (a1) and high soil dissolution ability peculiar to the component (b). As a result, it has been found that the component (a1) and the component (b) can be used in each specific composition ratio, thereby preventing the re-adhesion of soil on the surface of a material to be cleaned, and as a result, the rinsing property can be remarkably improved.

Further, the inventor has extensively studied to find a cleaning method, a soil-separating method and a cleaning apparatus, which are suitable for the cleaning agent in accordance with the present invention. As a result, there has been found a cleaning method exhibiting a high cleaning effect, according to which rinsing and/or vapor-cleaning is carried out with use of the cleaning agent in accordance with the present invention, the vapor generated by heating said cleaning agent and its condensate, or the rinsing agent in accordance with the present invention. Further, taking advantage of the cleaning method in accordance with the present invention, there have been found a cleaning apparatus permitting a one-liquid cleaning without use of any rinsing agent, and facilitating a liquid control, and another cleaning apparatus equipped with a dip-rinsing tank, which is suitable for precision cleaning, when a higher level of cleaning is required.

Further, it has been found that the cleaning agent in the cleaning tank and a condensate obtained by condensing vapor of the cleaning agent in a water separation tank can be transferred to a soil-separating tank, and contacted therein with each other, thereby separating and removing soil dissolved in the cleaning agent in the soil-separating tank, and thereafter the liquid freed from the soil is returned to the cleaning tank, and as a result, the soil in the cleaning agent can be efficiently separated in a continuous manner. Moreover, it has been found that any soil finely dispersed in the liquid returning to the cleaning tank can be separated with a separation filter, and as a result, a higher soil-separating effect can be obtained. Thereby, the present invention has been obtained.

That is, the 1st aspect of the present invention provides a cleaning agent having no flash point, which comprises (a1) a chlorine-free fluorine-containing compound having a vapor pressure of not less than $1.33\times10^3$ Pa at 20° C., and (b) a component having a vapor pressure of less than $1.33\times10^3$ Pa at 20° C.

The 2nd aspect of the present invention provides the cleaning agent according to the 1st aspect of the present invention, which further contains (a2) at least one compound having a vapor pressure of not less than $1.33\times10^3$ Pa at 20° C., which is selected from the group consisting of alcohols, ketones, esters and hydrocarbons.

The 3rd aspect of the present invention provides a rinsing agent having no flash point, which contains (a1) 80.0% by mass to 99.9% by mass of a chlorine-free fluorine-containing compound having a vapor pressure of not less than $1.33\times10^3$ Pa at 20° C., and (b) 0.1% by mass to 20.0% by mass of a component having a vapor pressure of less than $1.33\times10^3$ Pa at 20° C.

The 4th aspect of the present invention provides the rinsing agent having no flash point according to the 3rd aspect of the present invention, which further contains 0.1 to 20.0% by mass of (a2) at least one compound having a vapor pressure of not less than $1.33\times10^3$ Pa at 20° C., which is selected from the group consisting of alcohols, ketones, esters and hydrocarbons.

The 5th aspect of the present invention provides the cleaning agent having no flash point or the rinsing agent having no flash point according to any one of the 1st to 4th aspects of the present invention, wherein the component (a1) is a compound selected from methyl perfluorobutyl ether, methyl perfluoroisobutyl ether and a mixture thereof.

The 6th aspect of the present invention provides the cleaning agent having no flash point or the rinsing agent having no flash point according to any one of the 1st to 5th aspects of the present invention, wherein the component (b) is at least one compound selected from the group consisting of organic compounds having an ether bond and/or an ester bond.

The 7th aspect of the present invention provides the cleaning agent having no flash point or the rinsing agent having no flash point according to any one of the 1st to 6th aspects of the present invention, wherein the component (b) comprises at least one compound selected from the group consisting of glycol ethers, glycol ether acetates and hydroxy-carboxylic acid esters.

The 8th aspect of the present invention provides the cleaning agent having no flash point or the rinsing agent having no flash point according to any one of the 1st to 7th aspects of the present invention, wherein the component (b) comprises at least one compound selected from the group consisting of compounds represented by the following formulas (1), (2), (3) and (4),

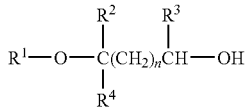

(1)

wherein $R^1$ is an alkyl, alkenyl or cycloalkyl group having 1 to 6 carbon atoms, $R^2$, $R^3$ and $R^4$ are each hydrogen or a methyl group, and n is an integer of 0 or 1,

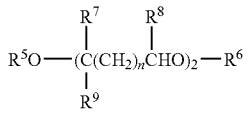

(2)

wherein $R^5$ is an alkyl, alkenyl or cycloalkyl group having 4 to 6 carbon atoms, $R^7$, $R^8$ and $R^9$ are each hydrogen or a methyl group, $R^6$ is an alkyl, alkenyl or cycloalkyl group having 3 to 6 carbon atoms, and n is an integer of 0 or 1,

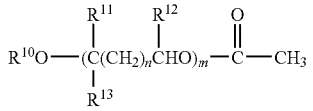

(3)

wherein $R^{10}$ is an alkyl, alkenyl or cycloalkyl group having 1 to 6 carbon atoms, $R^{11}$, $R^{12}$ and $R^{13}$ are each hydrogen or a methyl group, n is an integer of 0 or 1, and m is an integer of 1 to 4, and

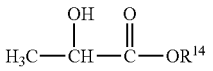

(4)

wherein $R^{14}$ is an alkyl, alkenyl or cycloalkyl group having 1 to 6 carbon atoms.

The 9th aspect of the present invention provides the cleaning agent having no flash point or the rinsing agent having no flash point according to any one of the 1st to 8th aspects of the present invention, wherein the component (b) comprises a combination of (b1) at least one compound selected from glycol ether monoalkyl ethers and (b2) at least one compound selected from glycol ether dialkyl ethers.

The 10th aspect of the present invention provides the cleaning agent having no flash point or the rinsing agent having no flash point according to the 9th aspect of the present invention, wherein the combination comprises at least one compound selected from hydrophilic glycol ether monoalkyl ethers as the component (b1) and at least one compound selected from hydrophobic glycol ether dialkyl ethers as the component (b2).

The 11th aspect of the present invention provides the cleaning agent having no flash point or the rinsing agent having no flash point according to the 9th aspect of the present invention, wherein the combination comprises at least one compound selected from hydrophobic glycol ether monoalkyl ethers as the component (b1) and at least one compound selected from hydrophilic glycol ether dialkyl ethers as the component (b2).

The 12th aspect of the present invention provides the cleaning agent having no flash point or the rinsing agent having no flash point according to the 9th aspect of the present invention, wherein both the component (b1) and the component (b2) are hydrophilic.

The 13th aspect of the present invention provides the cleaning agent having no flash point or the rinsing agent having no flash point according to the 9th aspect of the present invention, wherein both the component (b1) and the component (b2) are hydrophobic.

The 14th aspect of the present invention provides the cleaning agent having no flash point or the rinsing agent having no flash point according to the 9th aspect of the present invention, wherein the component (b1) comprises at least one selected from 3-methoxybutanol, 3-methyl-3-methoxybutanol, dipropylene glycol mono-n-propyl ether and dipropylene glycol mono-n-butyl ether.

The 15th aspect of the present invention provides the cleaning agent having no flash point or the rinsing agent having no flash point according to the 9th aspect of the present invention, wherein the component (b2) comprises at least one selected from diethylene glycol diethyl ether, diethylene glycol di-n-butyl ether and dipropylene glycol dimethyl ether.

The 16th aspect of the present invention provides the cleaning agent having no flash point or the rinsing agent having no flash point according to any one of the 1st to 15th aspects of the present invention, which further contains (c) an antioxidant.

The 17th aspect of the present invention provides the cleaning agent having no flash point or the rinsing agent having no flash point according to the 16th aspect of the present inventions the component (c) comprises at least one compound selected from the group consisting of phenol antioxidants, amine antioxidants, phosphorus antioxidants and sulfur antioxidants.

The 18th aspect of the present invention provides the cleaning agent having no flash point or the rinsing agent having no flash point according to any one of the 16th or 17th aspects of the present invention, wherein the component (c) is a combination of at least one compound selected from the group consisting of phenol antioxidants and amine antioxidants, and at least one compound selected from the group consisting of phosphorus antioxidants and sulfur antioxidants.

The 19th aspect of the present invention provides the cleaning agent having no flash point or the rinsing agent having no flash point according to any one of the 16th to 18th aspects of the present invention, wherein the component (c) has a melting point of not higher than 120° C.

The 20th aspect of the present invention provides the cleaning agent having no flash point or the rinsing agent having no flash point according to any one of the 1st to 19th aspects of the present invention, which further contains (d) an ultraviolet absorber.

The 21st aspect of the present invention provides a cleaning method characterized by using the cleaning agent and/or the rinsing agent according to any one of the 1st to 20th aspects of the present invention.

The 22nd aspect of the present invention provides a cleaning method characterized by carrying out rinsing and/or vapor-cleaning with use of vapor of the cleaning agent and/or the rinsing agent according to any one of the 1st to 20th aspects of the present invention and/or a condensate of said vapor.

The 23rd aspect of the present invention provides a cleaning method characterized by carrying out cleaning with a cleaning agent having no flash point, which contains (a) a component having a vapor pressure of not less than $1.33\times10^3$ Pa at 20° C., and (b) a component having a vapor pressure of less than $1.33\times10^3$ Pa at 20° C., and further carrying out rinsing and/or vapor-cleaning with use of (f) vapor of said cleaning agent or a condensate of said vapor.

The 24th aspect of the present invention provides a cleaning method characterized by carrying out cleaning with (e) the cleaning agent according to any one of the 1st, 2nd and 5th to 20th aspects of the present invention, and further carrying out rinsing and/or vapor-cleaning with use of (f) vapor of the cleaning agent or a condensate of said vapor.

The 25th aspect of the present invention provides the cleaning method according to any one of the 21st to 23rd aspects of the present invention, wherein the rinsing and/or vapor-cleaning is carried out with use of vapor of the rinsing agent according to any one of the 3rd, 4th and 16th aspects of the present invention or a condensate of said vapor.

The 26th aspect of the present invention provides a cleaning method characterized by carrying out cleaning with (e) the cleaning agent according to any one of the 1st, 2nd and 5th to 20th aspects of the present invention, and thereafter carrying out rinsing and/or vapor-cleaning with use of a liquid selected from the component (a), the rinsing agent according to the 3rd aspect of the present invention, the rinsing agent according to the 4th aspect of the present invention and the rinsing agent according to the 16th aspect of the present invention, vapor of said liquid or a condensate of said vapor of the liquid.

The 27th aspect of the present invention provides a soil-separating method, characterized by carrying out cleaning with (e) the cleaning agent according to any one of the 1st, 2nd and 5th to 20th aspects of the present invention, contacting said cleaning agent contaminated with soil in a cleaning tank with (f) a liquid condensate of vapor of said cleaning agent in a soil-separating tank, thereby separating soil dissolved in said cleaning agent, and returning the liquid freed from soil to the cleaning tank.

The 28th aspect of the present invention provides a soil-separating method, characterized by passing a liquid through a separation filter, which liquid is obtained by contacting a liquid condensate of vapor of a cleaning agent with the cleaning agent contaminated with contaminants in a cleaning tank, and thereafter returning the passed liquid to the cleaning tank.

The 29th aspect of the present invention provides the soil-separating method according to the 27th aspect of the present invention, wherein the liquid treated in a soil-separating tank is passed through the separation filter, and thereafter returned to the cleaning tank.

The 30th aspect of the present invention provides a cleaning method characterized in that the cleaning method according to any one of the 21st to 26th aspects of the present invention is used in combination with the soil-separating method according to any one of the 27th to 29th aspects of the present invention.

The 31st aspect of the present invention provides a cleaning method characterized by carrying out pre-rinsing with a pre-rinsing agent containing the component (b) before rinsing.

The 32nd aspect of the present invention provides a cleaning method characterized by carrying out pre-rinsing before rinsing with use of a liquid treated by the soil-separating method according to any one of the 27th to 29th aspects of the present invention as a pre-rinsing agent.

The 33rd aspect of the present invention provides a cleaning method characterized by carrying out cleaning with a cleaning agent containing the component (a) and the component (b), successively carrying out pre-rinsing with a pre-rinsing agent containing the component (b), and thereafter carrying out rinsing or/and vapor-cleaning with vapor of the pre-rinsing agent containing the component (b) or a condensate of said vapor.

The 34th aspect of the present invention provides a cleaning method characterized in that the cleaning method or the separating method according to any one of the 21st to 30th aspects of the present invention is used in combination with the cleaning method according to any one of the 31st to 33rd aspects of the present invention.

The 35th aspect of the present invention provides a cleaning apparatus comprising (A) a cleaning tank having a heating mechanism for heating at least one component constituting (e) a cleaning agent or/and generating vapor thereof, (B) a vapor zone in which vapor-cleaning is carried out with the vapor generated from the cleaning tank (A), (C) a water separation tank in which water is removed from a condensate obtained by condensing the generated vapor, and (D) a mechanism for carrying out in the vapor zone (B) shower-rinsing of the condensate allowed to stay in the water separation tank.

The 36th aspect of the present invention provides a cleaning apparatus comprising (E) a cleaning tank in which a material to be cleaned is cleaned with (e) a cleaning agent, (F) a heating tank having a heating mechanism for generating vapor of at least one component or compound constituting said cleaning agent, (G) a vapor zone in which vapor-cleaning is carried out with the vapor generated from the heating tank (F), (H) a water separation tank in which water is removed from the condensate obtained by condensing the generated vapor, (I) a mechanism for carrying out in the vapor zone (G) shower-rinsing of the condensate allowed to stay in the water separation tank (H), and (J) a mechanism for circulating the cleaning agent between the cleaning tank (E) and the heating tank (F).

The 37th aspect of the present invention provides a cleaning apparatus comprising (O) a cleaning tank having a mechanism for heating at least one component constituting (e) a cleaning agent or/and generating vapor thereof, (P) a vapor zone in which vapor-cleaning is carried out with the vapor generated from the cleaning tank (O), (Q) a water separation tank in which water is removed from a condensate obtained by condensing the generated vapor, and (R) a rinsing tank, in which dip-rinsing is carried out with the condensate from which water has been removed in the water separation tank.

The 38th aspect of the present invention provides a cleaning apparatus comprising (S) a cleaning tank in which a material to be cleaned is cleaned with (e) a cleaning agent, (T) a dip-rinsing tank, in which dip-rinsing is carried out with a component (a) or a rinsing agent, (U) a heating tank having a heating mechanism for generating vapor of the component (a) or the rinsing agent, (V) a vapor zone in which vapor-cleaning is carried out with the vapor generated from the heating tank (U), and (W) a water separation tank in which water is removed from a condensate obtained by condensing the generated vapor.

The 39th aspect of the present invention provides a cleaning apparatus comprising (A) a cleaning tank having a mechanism for heating at least one component constituting (e) a cleaning agent or/and generating vapor thereof, (B) a vapor zone in which vapor-cleaning is carried out with the vapor generated from the cleaning tank (A), (C) a water separation tank in which water is removed from a condensate obtained by condensing the generated vapor, (K) a soil-separating tank in which a soil-containing cleaning agent is contacted with said condensate to separate the soil dissolved in the cleaning agent, (D) a mechanism for carrying out in the vapor zone (B) shower-rinsing of the condensate allowed to stay in the water separation tank, and (L) a mechanism for continuously transferring the cleaning agent in the cleaning tank (A) to the soil-separating tank.

The 40th aspect of the present invention provides a cleaning apparatus comprising (E) a cleaning tank, in which a material to be cleaned is cleaned with (e) a cleaning agent, (F) a heating tank having a heating mechanism for generating vapor of at least one component or compound constituting the cleaning agent, (G) a vapor zone in which vapor-cleaning is carried out with the vapor generated form the heating tank (F), (H) a water separation tank in which water is removed from the condensate obtained by condensing the generated vapor, (M) a soil-separating tank in which a soil-containing cleaning agent is contacted with said condensate to separate the soil dissolved in the cleaning agent, (I) a mechanism for carrying out in the vapor zone (G) shower-rinsing of the condensate allowed to stay in the water separation tank (H), (J) a mechanism for circulating the cleaning agent between the cleaning tank (E) and the heating tank (F), and (N) a mechanism for continuously transferring the cleaning agent in the cleaning tank (E) to the soil-separating tank.

The 41st aspect of the present invention provides a cleaning apparatus having a pre-rinsing tank.

The 42nd aspect of the present invention provides a cleaning apparatus characterized by using a liquid as a pre-rinsing agent in a pre-rinsing tank, the liquid being that treated with a soil-separating tank or/and a separation filter.

The 43rd aspect of the present invention provides a cleaning apparatus characterized in that the cleaning apparatus according to any of the 35th to 40th aspects of the present invention is used in combination with the cleaning apparatus according to any of the 41st and 42nd aspects of the present invention.

The 44th aspect of the present invention provides a cleaning apparatus comprising (E) a cleaning tank in which a material to be cleaned is cleaned with (e) a cleaning agent, (F) a heating tank having a heating mechanism for generating vapor of at least one component or compound constituting the cleaning agent, (G) a vapor zone in which vapor-cleaning is carried out with the vapor generated form the heating tank (F), (H) a water separation tank in which water is removed from a condensate obtained by condensing the generated vapor, (M) a soil-separating tank in which a soil-containing cleaning agent is contacted with said condensate to separate the soil dissolved in the cleaning agent, (X) a mechanism for separating soils with a separation filter in a liquid treated in the soil-separating tank, (Y) a mechanism for carrying out in the vapor zone (G) shower-rinsing of the liquid transferred through the separation filter and the condensate allowed to stay in the water separation tank (H), (J) a mechanism for circulating the cleaning agent between the cleaning tank (E) and the heating tank (F), and (N) a mechanism for continuously transferring the cleaning agent in the cleaning tank (E) to the soil-separating tank.

The 45th aspect of the present invention provides a cleaning apparatus comprising (Z) a cleaning tank having a heating mechanism for heating at least one component constituting (e) a cleaning agent or/and heating it to generate its vapor, (AA) a vapor zone in which vapor-cleaning is carried out with the vapor generated from the cleaning tank, (AB) a water separation tank in which water is removed from a condensate obtained by condensing the generated vapor, (AC) a rinsing tank in which dip-rinsing is carried out with the condensate from which water has been removed in the water separation tank (AB), (AD) a soil-separating tank, in which a soil-containing cleaning agent is contacted with the condensate to separate soil dissolved in the cleaning agent, (AE) a mechanism for continuously transferring the cleaning agent in the cleaning tank (Z) to the soil-separating tank, (AF) a mechanism for continuously transferring the condensate to the soil-separating tank from which condensate water has been removed in the water separation tank (AB), (AG) a mechanism for separating, with a separation filter, soil in a liquid treated in the soil-separating tank, and (AH) a pre-rinsing tank in which dip-pre-rinsing is carried out with the liquid transferred through the separation filter.

The 46th aspect of the present invention provides the cleaning method according to any one of the 21st to 34th aspects of the present invention, wherein the cleaning apparatus according to any one of the 35th to 45th aspects of the present invention is used.

Figure 1:
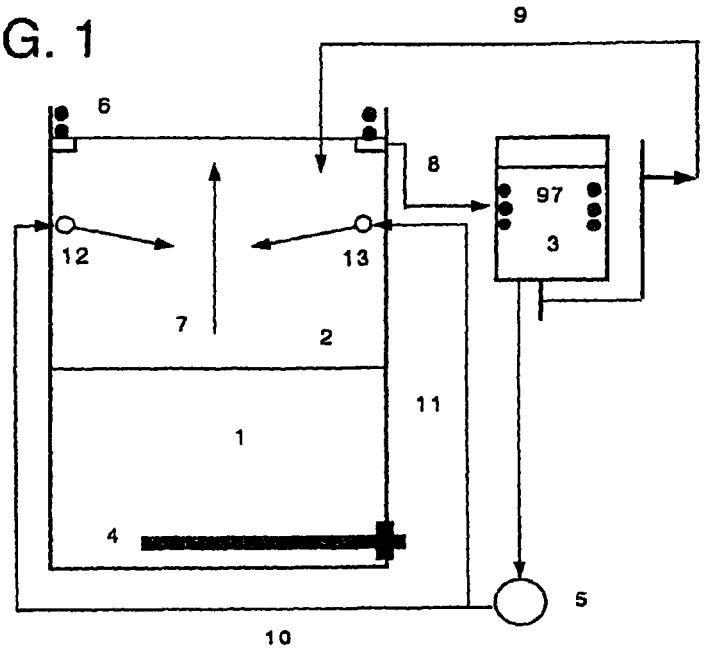
FIG. 1 shows an embodiment of the cleaning apparatus according to the 35th aspect of the present invention.

In the Figures, each reference signifies as follows.

1 Cleaning tank (A), 2 vapor zone (B), 3 water separation tank (C), 4 heater, 5 pump for shower use (D), 6 cooling pipe, 7 vapor flow, 8 pipe for condensate, 9 pipe for condensate after water separation, 10 pipe for condensate for spray (D), 11 pipe for condensate for shower (D), 12 spray nozzle (D), 13 spray nozzle (D), 14 cleaning tank (E), 15 heating tank (F), 16 vapor zone (G), 17 water separation tank (H), 18 ultrasonic wave, 19 pump for circulating cleaning agent (J), 20 heater, 21 pump for spray (I), 22 cooling pipe, 23 vapor flow, 24 pipe for condensate, 25 pipe for condensate after water separation, 26 pipe for condensate for shower (I), 27 pipe for condensate for spray (I), 28 spray nozzle (I), 29 spray nozzle (I), 30 cleaning agent flow, 31 pipe for circulating cleaning agent, 32 cleaning tank (A), 33 vapor zone (B), 34 water separation tank (C), 35 soil-separating tank (K), 36 pump for spray (D), 37 pump for transferring cleaning agent (L), 38 heater, 39 cooling pipe, 40 vapor flow, 41 pipe for condensate, 42 pipe for condensate after water separation, 43 pipe for condensate for spray (D), 44 pipe for condensate for shower (D), 45 spray nozzle (D), 46 spray nozzle (D), 47 pipe for transferring cleaning agent, 48 pipe for returning liquid after separating soil, 49 cleaning tank (E), 50 heating tank (F), 51 vapor zone (G), 52 water separation tank (H), 53 soil-separating tank (M), 54 pump for spray (I), 55 pump for transferring cleaning agent (N), 56 pump for circulating cleaning agent (J), 57 ultrasonic wave, 58 heater, 59 cooling pipe, 60 vapor flow, 61 pipe for condensate, 62 pipe for condensate after water separation, 63 pipe for condensate for spray (I), 64 pipe for condensate for spray (I), 65 spray nozzle (I), 66 spray nozzle (I), 67 cleaning agent flow, 68 pipe for circulating cleaning agent (J), 69 pipe for supplying cleaning agent (N), 70 pipe for returning liquid after separating soil, 71 cleaning tank (O), 72 rinsing tank (R), 73 vapor zone (P), 74 water separation tank (Q), 75 ultrasonic wave, 76 heater, 77 cooling pipe, 78 vapor flow, 79 pipe for condensate, 80 pipe for condensate after water separation, 81 condensate flow, 82 cleaning tank (S), 83 rinsing tank (T), 84 heating tank (U), 85 vapor zone (V), 86 water separation tank (W), 87 cleaning tank heater, 88 distillation tank heater, 89 ultrasonic wave, 90 cleaning tank cooling pipe, 91 cooling pipe, 92 distillation tank cooling pipe, 93 vapor flow, 94 pipe for condensate, 95 pipe for condensate after water separation, 96 condensate flow, 97~105 cooling pipe, 106 cleaning tank (E), 107 heating tank (F), 108 vapor zone (G), 109 water separation tank (H), 110 cooling pipe, 111 pump for shower (Y), 112 soil-separating tank, 113 cooling tank, 114 pump for transferring cleaning agent (N), 115 tank for liquid treated in soil-separating tank (X), 116 cooling pipe, 117 pump for transferring liquid treated in soil-separating tank and pump for shower (X, Y), 118 separation filter unit (X), 119 ultrasonic wave, 120 pump for circulating cleaning agent (J), 121 heater, 122 cooling pipe, 123 vapor flow, 124 spray nozzle (Y), 125 spray nozzle (Y), 126 pipe for spray (Y), 127 pipe for spray (Y), 128 pipe for condensate, 129 check valve (Y), 130 pipe for condensate, 131 pipe for liquid treated in soil-separating tank (Y), 132 pipe for pre-rinsing liquid, 133 check valve (Y), 134 pipe for circulating cleaning agent (J), 135 cleaning agent flow, 136 cleaning tank (Z), 137 pre-rinsing tank (AH), 138 rinsing tank (AC), 139 vapor zone (AA), 140 water separation tank (AB), 141 cooling pipe, 142 pump for transferring condensate, 143 soil-separating tank (AD), 144 cooling pipe, 145 pump for transferring cleaning agent (AE), 146 tank for liquid treated in soil-separating tank (AG), 147 cooling pipe, 148 pump for transferring liquid treated in soil-separating tank (AG), 149 separation filter unit (AG), 150 ultrasonic wave, 151 ultrasonic wave, 152 heater, 153 pre-rinsing liquid flow, 154 rinsing liquid flow, 155 cooling pipe, 156 vapor flow, 157 cooling pipe, 158 pipe for condensate, 159 pipe for condensate, 160 pipe for liquid treated in soil-separating tank, 161 pipe for pre-rinsing liquid, and 162 pipe for transferring cleaning agent.

BEST MODE FOR CARRYING OUT THE INVENTION

The present invention is explained in detail as follows.

In the present specification, the term "cleaning" means that soil attached to a material to be cleaned is removed to such an extent that there is no influence on a successive processing step. The term "rinsing" means that a cleaning agent containing soil attached to a material to be cleaned is replaced with a solvent containing no soil after completion of cleaning. The term "spray rinsing" means that a solvent in the form of liquid or spray delivered through a single outlet or plural outlets is applied to a material to be cleaned, thereby replacing a cleaning agent attached to the material to be cleaned with the solvent. The term "pre-rinsing" means that a cleaning agent containing soil attached to a material to be cleaned is replaced with a solvent after completion of cleaning and before rinsing. And the term "vapor-cleaning" means that soil remaining in a slight amount on the surface of a material to be cleaned is removed with a condensate formed on the surface of the material to be cleaned due to a temperature difference between the material to be cleaned and vapor.

The component (a) having a vapor pressure of not less than $1.33\times10^3$ Pa at 20° C. used for the cleaning agent and the rinsing agent in accordance with the present invention is not particularly limited, as long as it has a vapor pressure of not less than $1.33\times10^3$ Pa at 20° C. Examples thereof are (a1) chlorine-free fluorine-containing compounds, and (a2) compounds having superior drying property such as alcohols, ketones, esters and hydrocarbons. The component (a) is exemplified by type of compound as follows.

The chlorine-free fluorine-containing compounds (a1) include a fluorine compound containing no chlorine atom such as a hydrocarbon and an ether, whose hydrogen atoms are partially substituted with a fluorine atom only. Examples thereof are those comprising carbon atoms, hydrogen atoms, an oxygen atom and a fluorine atom, but no chlorine atom, such as a cyclic HFC specified by the following general formula (5), a chain HFC specified by (6) and an HFC specified by (7), and a combination of two or more selected therefrom.

$$C_nH_{2n-m}F_m \quad (5)$$

(In the formula, m and n are each an integer satisfying $4\leqq n\leqq 6$ and $5\leqq m\leqq 2n-1$, respectively.)

$$C_xH_{2x+2-y}F_y \quad (6)$$

(In the formula, x and y are each an integer satisfying $4\leqq x\leqq 6$ and $6\leqq y\leqq 12$, respectively.)

$$C_sF_{2s+1}OR \quad (7)$$

(In the formula, $4\leqq s\leqq 6$, and R is an alkyl group having 1 to 3 carbon atoms.)

Specific examples of the cyclic HFC are 3H,4H,4H-perfluorocyclobutane, 4H,5H,5H-perfluorocyclopentane and 5H,6H,6H-nonafluorocyclohexane.

Specific examples of the chain HFC are 1H,2H,3H,4H-perfluorobutane, 1H,2H-perfluorobutane, 1H,3H-perfluorobutane, 2H,3H-perfluorobutane, 4H,4H-perfluorobutane, 1H,1H,3H-perfluorobutane, 1H,1H,4H-perfluorobutane, 1H,2H,3H-perfluorobutane, 1H,1H,4H-perfluorobutane, 1H,2H-perfluoropentane, 1H,4H-perfluoropentane, 2H,3H-perfluoropentane, 2H,4H-perfluoropentane, 2H,5H-perfluoropentane, 1H,2H,3H-perfluoropentane, 1H,3H,5H-perfluoropentane, 1H,5H,5H-perfluoropentane, 2H,2H,4H-perfluoropentane, 1H,2H,4H,5H-perfluoropentane, 1H,4H,5H,5H,5H-perfluoropentane, 1H,2H-perfluorohexane, 2H,3H-perfluorohexane, 2H,4H-perfluorohexane, 2H,5H-perfluorohexane and 3H,4H-perfluorohexane.

Specific examples of the HFE are methyl perfluorobutyl ether, methyl perfluoroisobutyl ether, methyl perfluoropentyl ether, methyl perfluoro-cyclohexyl ether, ethyl perfluorobutyl ether, ethyl perfluoroisobutyl ether and ethyl perfluoropentyl ether.

In the cleaning agent and the rinsing agent in accordance with the present invention, at least one compound selected from these (a1) chlorine-free fluorine-containing compounds can be used in combination. Of these, preferred are cyclic HFC and HFE including alcohols, ketones, esters and glycol ethers, which are high in their solubility to a high polar solvent and low in their earth anathermal coefficient. More preferred are 4H,5H,5H-perfluorocyclopentane; methyl perfluorobutyl ether, methyl perfluoroisobutyl ether and their mixtures; and ethyl perfluorobutyl ether, ethyl perfluoroisobutyl ether and a mixture thereof. Much more preferred are methyl perfluorobutyl ether, methyl perfluoroisobutyl ether and a mixture thereof, which are superior in a flash point-controlling effect. Particularly, in order to obtain a cleaning agent and rinsing agent having no flash point, it is necessary to use the component (a1), namely, the chlorine-free fluorine-containing compound.

With respect to the component (a2) used in the cleaning agent and rinsing agent in accordance with the present invention, namely, at least one compound having a vapor pressure of not less than $1.33\times10^3$ Pa at 20° C., which is selected from the group consisting of alcohols, ketones, esters and hydrocarbons, (a2) is exemplified by type of compound as follows.

Specific examples of the alcohols are methanol, ethanol, n-propanol and isopropanol.

Specific examples of the ketones are acetone and methyl ethyl ketone.

Specific examples of the esters are ethyl formate, propyl formate, isobutyl formate, methyl acetate, ethyl acetate, methyl propionate and ethyl propionate.

Specific examples of the hydrocarbons are n-hexane, isohexane, cyclohexane, cyclohexene, 2-methyl-pentane, 2,3-dimethylbutane, n-heptane, 2-methylhexane, 3-methylhexane, 2,4-dimethylpentane and isooctane.

From a viewpoint of improving compatibility, it is recommendable that the difference between the specific gravity of the component (a2) or the component (b) and that of the component (a1) to be used in combination therewith is within a range of preferably ±0.8 of the component (a1), more preferably ±0.7 thereof. Particularly, compatibility of the chlorine-free fluorine-containing compound (a1) to the other component highly depends upon temperature, and therefore it is important to diminish the difference between the specific gravity thereof and that of the other component to be used in combination therewith, so that compatibility at a low temperature can be maintained.

From a viewpoint of diminishing a fluctuation of the composition when in use, it is recommendable that the difference between the boiling point of the component (a2) and that of the component (a1) to be used in combination therewith is within a range of ±40° C. of the component (a1), more preferably ±30° C. thereof.

For the component (a1), it is preferred that the component (a2) to be used in combination therewith is an azeotropic mixture or an azeotrope-like mixture having a composition similar to that of the azetropic mixture. In the cleaning agent and the rinsing agent in accordance with the present invention, for the purposes of improving cleaning power and improving rinsing property to each soil such as work oil, grease, wax and flux, it is necessary to use (b) at least one compound selected from components having a vapor pressure of less than $1.33\times10^3$ Pa at 20° C. in combination therewith. Examples thereof are those exhibiting good cleaning property to various kinds of soil and having a vapor pressure of less than $1.33\times10^3$ Pa at 20° C., such as various kinds of hydrocarbons, alcohols, ketones and organic compounds having an ether bond and/or ester bond. When the vapor pressure of the component (b) is within the range defined above, the cleaning agent and the rinsing agent in accordance with the present invention, which are superior in its rinsing property and cleaning property, respectively, can be obtained. The vapor pressure is preferably not more than $6.66\times10^2$ Pa at 20° C., and more preferably not more than $1.33\times10^2$ Pa at 20° C. The component (b) is exemplified by type of solvent as follows.

Specific examples of the hydrocarbons are decane, undecane, dodecane, tridecane, tetradecane, pentadecane, menthane, bicyclohexyl, cyclododecane and 2,2,4,4,6,8,8-heptamethylnonane.

Specific examples of the alcohols are n-butanol, isobutanol, sec-butanol, isoamyl alcohol, n-heptanol, n-octanol, n-nonanol, n-decanol, n-undecanol, benzyl alcohol, furfuryl alcohol, ethylene glycol and propylene glycol.

Specific examples of the ketones are methyl n-amyl ketone, diisobutyl ketone, diacetone alcohol, phorone, isophorone, cyclohexanone and acetophenone.

The ether bond-carrying organic compound used for the cleaning agent and the rinsing agent in accordance with the present invention is a compound containing at least one ether bond (C—O—C) in its molecular structure, and the ester bond-carrying organic compound is a compound containing at least one ester bond (—COO—) in its molecular structure.

Examples of the ether bond-carrying compound are those specified by the following general formula (8).

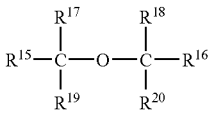

(8)

In the formula, $R^{15}$ and $R^{16}$ are each an aliphatic compound, alicyclic compound, aromatic compound or heterocyclic compound residue having at least one selected from alkyl groups, alkenyl groups, cycloalkyl groups, acetyl group, carbonyl group, hydroxyl group, ester bonds and ether bonds, and $R^{17}$ to $R^{20}$ are each hydrogen or an alkyl group.

Examples of the ester bond-carrying compound are those specified by the following general formula (9).

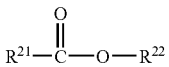

(9)

In the formula, $R^{21}$ and $R^{22}$ are each an aliphatic compound, alicyclic compound, aromatic compound or heterocyclic compound residue having at least one selected from alkyl groups, alkenyl groups, cycloalkyl groups, acetyl group, carbonyl group, hydroxyl group, ester bonds and ether bonds.

Specific examples thereof are n-butyl acetate, isoamyl acetate, 2-ethylhexyl acetate, methyl acetoacetate, ethyl acetoacetate, methyl lactate, ethyl lactate, propyl lactate, butyl lactate, γ-butyrolactone, dimethyl succinate, dimethyl glutarate, dimethyl adipate, 3-methyl-3-methoxybutyl acetate, diethylene glycol monobutyl ether ecetate, dipropylene glycol monomethyl ether acetate and dipropylene glycol monobutyl ether acetate.

Among the above-described compounds as the component (b), glycol ethers, glycol ether acetates and hydroxycarboxylic acid esters are preferred because of the particularly high effect of controlling flammability of the alcohol to be used in combination therewith.

As the glycol ethers, (b1) glycol ether monoalkyl ethers and (b2) glycol ether dialkyl ethers are mentioned. The (b1) glycol ether monoalkyl ether is an aliphatic or alicyclic compound of a structure, wherein two hydroxyl groups are bonded to two carbon atoms different from each other, and one hydrogen of said hydroxyl group is substituted with a hydrocarbon residue or an ether bond-containing hydrocarbon residue. The (b2) glycol ether dialkyl ether is an aliphatic or alicyclic compound of a structure, wherein two hydroxyl groups are bonded to two carbon atoms different from each other, and every hydrogen of two hydroxyl groups are substituted with a hydrocarbon residue or an ether bond-containing hydrocarbon residue. For example, (b1) glycol ether monoalkyl ethers specified by the following general formula (10) and (b2) glycol ether dialkyl ethers specified by the following general formula (11) are mentioned.

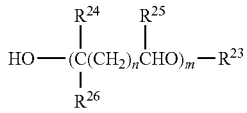

(10)

In the formula, $R^{23}$ is an alkyl, alkenyl or cycloalkyl group having 1 to 6 carbon atoms, $R^{24}$, $R^{25}$ and $R^{26}$ are each hydrogen or a methyl group, n is an integer of 0 or 1, and m is an integer of 1 to 4.

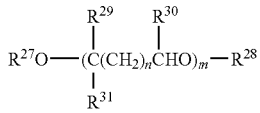

(11)

In the formula, $R^{27}$ is an alkyl, alkenyl or cycloalkyl group having 1 to 6 carbon atoms, $R^{28}$ is an alkyl or alkenyl group having 1 to 4 carbon atoms, $R^{29}$, $R^{30}$ and $R^{31}$ are each hydrogen or a methyl group, n is an integer of 0 or 1, and m is an integer of 1 to 4.

The hydrophilic glycol ether monoalkyl ethers and the hydrophilic glycol ether dialkyl ethers, which are used for the cleaning agent and the rinsing agent in accordance with the present invention are those capable of dissolving in water without formation of separate phases at the time when the glycol ether/water are mixed at 30° C. at a mass proportion of 60/40. The hydrophobic glycol ether monoalkyl ethers and the hydrophobic glycol ether dialkyl ethers are those capable of forming separate phases at the time when the glycol ether/water are mixed at 30° C. at a mass proportion of 60/40.

Preferred hydrophilic glycol ether monoalkyl ethers and hydrophilic glycol ether dialkyl ethers are those capable of dissolving at 30° C. in water at any arbitrary proportion, and preferred hydrophobic glycol ether monoalkyl ethers and hydrophobic glycol ether dialkyl ethers are those having solubility to water at 30° C. of not more than 60% by mass.

With respect to the (b1) glycol ether mono-alkyl ethers, specific examples of the hydrophilic glycol ether monoalkyl ethers are diethylene glycol monomethyl ether, diethylene glycol monoethyl ether, diethylene glycol mono n-propyl ether, diethylene glycol mono-i-propyl ether, diethylene glycol mono-n-butyl ether, propylene glycol monomethyl ether, dipropylene glycol monomethyl ether, tripropylene glycol monomethyl ether, 3-methoxybutanol and 3-methyl-3-methoxybutanol. Specific examples of the hydrophobic glycol ether monoalkyl ethers are ethylene glycol mono-n-hexyl ether, propylene glycol mono-n-butyl ether, dipropylene glycol mono-n-propyl ether and dipropylene glycol mono-n-butyl ether. Incidentally, dipropylene glycol mono-n-propyl ether and dipropylene glycol mono-n-butyl ether are superior in cleaning property to soil of amine hydrochlorides and organic acids, which cause an ionic residue in a flux cleaning, and soil of polymer rosin and rosin metal salts, which are produced in a soldering step and cause a white residue.

Further, 3-methoxybutanol, 3-methyl-3-methoxybutanol and other (b1) glycol ether monoalkyl ethers specified by the following general formula (1) are compounds having good cleaning property particularly to various kinds of soil, and exhibiting a superior cleaning effect.

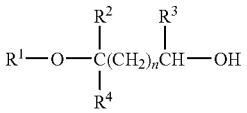

(1)

In the formula, $R^1$ is an alkyl, alkenyl or cycloalkyl group having 1 to 6 carbon atoms, $R^2$, $R^3$ and $R^4$ are each hydrogen or a methyl group, and n is an integer of 0 or 1.

With respect to the (b2) glycol ether dialkyl ethers, examples of the hydrophilic glycol ether dialkyl ethers are diethylene glycol dimethyl ether and diethylene glycol diethyl ether, and examples of hydrophobic glycol ether dialkyl ethers are diethylene glycol di-n-butyl ether and dipropylene glycol dimethyl ether. Incidentally, diethylene glycol diethyl ether and dipropylene glycol dimethyl ether are superior in cleaning property particularly to rosin contained in the flux component.

Further, diethylene glycol di-n-butyl ether and other (b2) glycol ether dialkyl ethers specified by the following general formula (2) are compounds having good cleaning property particularly to various kinds of soil, and exhibiting a superior cleaning effect.

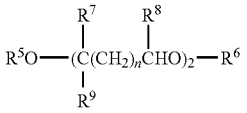

(2)

In the formula, $R_5$ is an alkyl, alkenyl or cycloalkyl group having 4 to 6 carbon atoms, $R^7$, $R^8$ and $R^9$ are each hydrogen or a methyl group, $R^6$ is an alkyl, alkenyl or cycloalkyl group having 3 to 6 carbon atoms, and n is an integer of 0 or 1.

In the present invention, depending upon the cleaning purpose, it is permitted to select a more preferred combination of the glycol ether monoalkyl ethers and the glycol ether dialkyl ethers more suitable to various kinds of soil. For example, a combination wherein any one of (b1) and (b2) is hydrophilic and the other is hydrophobic is suitable particularly for cleaning of various kinds of flux, cleaning of thermosetting or UV setting inks such as various soldering resist inks applied to a substrate surface, and cleaning of liquid crystals, and a combination wherein both components are hydrophilic is suitable particularly for cleaning of various kinds of flux and cleaning of a mixer portion and a nozzle portion of a mixing dispenser for an epoxy type or urethane type two-component resin used for adhesion or encapsulation of various electric or electronic parts. Further, a combination wherein both components are hydrophobic is suitable particularly for cleaning of various low polarity work oils used for processing precision machine parts and optical machine parts, such as cutting oil, pressing oil, drawing oil, hot treating oil, rust preventing oil and lubricating oil, cleaning of grease and wax, and cleaning of liquid crystals.

As the glycol ethers used in the present invention, more preferred from a viewpoint of low toxicity are dipropylene glycol monomethyl ether, dipropylene glycol mono-n-propyl ether, dipropylene glycol mono-n-butyl ether, dipropylene glycol dimethyl ether, 3-methoxybutanol and 3-methyl-3-methoxybutanol, which produce no alkoxyacetic acid during metabolism in a human body.

The glycol ether acetates are those obtained by acetylation of hydroxyl group-carrying glycol ethers, and preferably those specified by the following general formula (3).

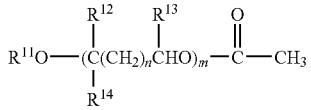

(3)

In the formula, $R^{10}$ is an alkyl, alkenyl or cycloalkyl group having 1 to 6 carbon atoms, $R^{11}$, $R^{12}$ and $R^{13}$ are each hydrogen or a methyl group, n is an integer of 0 or 1, and m is an integer of 1 to 4.

Specific examples thereof are acetates of monoalkyl ether such as ethylene glycol, diethylene glycol, triethylene glycol, propylene glycol, dipropylene glycol and tripropylene glycol, 3-methoxybutyl acetate and 3-methyl-3-methoxybutyl acetate.

As the glycol ether acetates used in the present invention, more preferred from a viewpoint of low toxicity are dipropylene glycol monomethyl ether acetate, dipropylene glycol mono-n-propyl ether acetate, dipropylene glycol mono-n-butyl ether acetate, 3-methoxybutyl acetate and 3-methyl-3-methoxybutyl acetate, which produce no alkoxyacetic acid during metabolism in a human body.

The hydroxycarboxylic acid esters are hydroxyl group-carrying ester compounds, and preferably those specified by the following general formula (4).

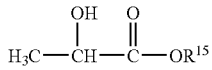

(4)

In the formula, $R^{14}$ is an alkyl, alkenyl or cycloalkyl group having 1 to 6 carbon atoms.

Examples thereof are lactic acid esters, malic acid esters, tartaric acid esters, citric acid esters, glycol monoesters, glycerol monoesters, glycerol diesters, ricinolic acid esters and castor oil. Among the above-mentioned (b) components, lactic acid esters are particularly preferred, and specific examples thereof are methyl lactate, ethyl lactate, propyl lactate, butyl lactate and pentyl lactate.

As a particularly preferred component (b), a compound having at least one butyl or isobutyl group as a part of its molecular structure and a compound containing a chain hydrocarbon structure having 4 to 6 carbon atoms and an oxygen atom in its molecule are mentioned. Specific examples thereof are 3-methoxy-butyl acetate, 3-methyl-3-methoxybutyl acetate, butyl lactate, diethylene glycol mono-n-butyl ether, diethylene glycol mono-1-butyl ether, dipropylene glycol mono-n-butyl ether, dipropylene glycol mono-i-butyl ether, 3-methoxybutanol, 3-methyl-3-methoxy-butanol and diethylene glycol di-n-butyl ether. These compounds can exhibit superior rosin dissolution property, as well as superior cleaning property to ionic substances and white residue-causing substances in the cleaning of flux. Among these components (b), hydrocarbons are preferred for the cleaning of work oil, grease, wax and liquid crystals, and the glycol ethers, the esters and the ketones, particularly the glycol ethers, are preferred for the cleaning of resins such as flux.

For the cleaning agent and the rinsing agent in accordance with the present invention, it is permitted to use (c) an antioxidant for the purpose of preventing oxidation of the cleaning agent. Examples thereof are as follows. Their melting points are shown in the parentheses. Examples of phenol antioxidants are 1-oxy-3-methyl-4-isopropylbenzene (112° C.), 2,4-dimethyl-6-t-butylphenol (liquid at 20° C.), 2,6-di-t-butylphenol (37° C.), butyl hydroxyanisole (57 to 63° C.), 2,6-di-t-butyl-p-cresol (69 to 71° C.), 2,6-di-t-butyl-4-ethylphenol (44 to 45° C.), 2,6,-di-t-butyl-4-hydroxy-methylphenol (141° C.), triethylene glycol-bis[3-(3-t-butyl-5-methyl-4-hydroxyphenyl)propionate] (76 to 79° C.), 1,6-hexanediol-bis[3-(3,5-di-t-butyl-4-hydroxy-phenyl) propionate] (104 to 108° C.) and octadecyl-3-(3,5-di-t-butyl-4-hydroxyphenyl)propionate (50 to 52° C.).

Examples of amine antioxidants are diphenyl-p-phenylene-diamine (130° C.), 4-amino-p-diphenylamine (74° C.) and p,p'-dioctyldiphenylamine (80 to 100° C.).

Examples of phosphorus antioxidants are phenylisodecyl phosphite (liquid at 20° C.), diphenyldiisooctyl phosphite (liquid at 20° C.), diphenyl-diisodecyl phosphite (liquid at 20° C.), triphenyl phosphite (liquid at 20° C.), trisnonylphenyl phosphite (liquid at 20° C.) and bis(2,4-di-t-butylphenyl)-pentaerythritol diphosphite (liquid at 20° C.).

Examples of sulfur antioxidants are dilauryl 3,3'-thiodipropionate (34 to 42° C.), ditridecyl 3,3'-thiodipropionate (liquid at 20° C.), dimyristyl 3,3'-thiodipropionate (49 to 55° C.) and distearyl 3,3'-thiodipropionate (63 to 69° C.).

Among the compounds exemplified, the phenol antioxidants are higher in the addition effect, and 2,6-di-t-butyl-p-cresol is particularly preferred. In the case of vapor-cleaning or other continuous uses of the cleaning agent under heating, it is recommendable to use a combination of at least one selected from the group consisting of phenol antioxidants and amine antioxidants and at least one selected from the group consisting of sulfur antioxidants, because decomposition of the cleaning agent due to its oxidation can be prevented for a long period of time. Further, in order to prevent a stain from appearing on the surface of a material to be cleaned after completion of the cleaning, the melting point of the antioxidant is preferably not higher than 120° C., and more preferably not higher than the cleaning temperature in the vapor-cleaning.

It is permitted to add (d) ultraviolet absorbers to the cleaning agent and the rinsing agent in accordance with the present invention, thereby attaining a further improvement of oxidation stability owing to a combination use with the antioxidant (c). Examples thereof are benzophenones such as 4-hydroxybenzophenone, 2-hydroxy-4-methoxybenzophenone, 2,2'-dihydroxy-4-methoxybenzophenone, 2-hydroxy-4-methoxy-4'-chlorobenzophenone, 2,2'-hydroxy-4-n-octoxybenzophenone, 2-hydroxy-4-n-octoxybenzophenone, 2,4-dihydroxybenzophenone, 5-chloro-2-hydroxybenzophenone, 2,2'-dihydroxy-4,4'-dimethoxybenzophenone and 4-dodecyl-2-hydroxybenzophenone, phenyl salicylates such as phenyl salicylate, 4-t-butylphenyl salicylate, 4-octylphenyl salicylate and bisphenol A di-salicylate, and benztriazoles such as 2-(5-methyl-2-hydroxyphenyl)-benztriazole, 2-[2-hydroxy-3,5-bis(α,α'-dimethylbenzyl)phenyl]-2H-benztriazole, 2-(3,5-di-t-butyl-2-hydroxyphenyl)benztriazole, 2-(3-t-butyl-5-methyl-2-hydroxyphenyl)benztriazole, 2-(3,5-di-t-amyl-2-hydroxyphenyl)benztriazole, 2-(2'-hydroxy-4'-t-octylphenyl)benztriazole, 2-(2'-hydroxy-5'-methyl-phenyl) benztriazole and 2-(2'-hydroxy-5'-t-octyl-phenyl) benztriazole.

The cleaning agent in accordance with the present invention can be obtained by mixing and blending the above-mentioned respective components, the component (a1), the component (b), the component (c) and the component (d) with one another in a conventional manner.

The mass proportion of respective components is not particularly limited, except such that high cleaning property, low oxidation-deterioration, low toxicity and low flammability, which are characteristic features of the cleaning agent, are not impaired. When the chlorine-free fluorine-containing compound having a vapor pressure of not less than $1.33\times10^3$ Pa at 20° C. (a1) and the component having a vapor pressure of less than $1.33\times10^3$ Pa at 20° C. (b) are used in combination, it is more preferred that the mass proportion of the component (a1)/the component (b) is within a range of from 90/10 to 20/80. When the mass proportion of the component (b) is 10 or more, a more preferred improvement effect of dissolving various kinds of soil can be obtained, and when it is 80 or less, a more preferred effect to prevent the cleaning agent components from remaining on the surface of a material to be cleaned can be obtained. From a viewpoint of balance between the cleaning property of the cleaning agent and the property of the cleaning agent components remaining on the surface of a material to be cleaned, a more preferable mass proportion of the components (a1) and (b) is within a range of from 80/10 to 40/60, and much more preferable is from 70/30 to 50/50.

When the component (a1) and the component (a2) are used in combination, the mass proportion is more preferably within a range of from 99/1 to 70/30. When the mass proportion of the component (a2) is 1 or more, a more preferred improvement effect of dissolving various kinds of soil can be obtained, and when it is 30 or less, a more preferred low flammability can be obtained.

When the component (b1) and the component (b2) are used in combination, the mass proportion is more preferably within a range of from 90/10 to 10/90. When the mass proportion of the component (b1) is 10 or more, more preferred rosin dissolution can be obtained, and when it is 90 or less, more preferred cleaning property to polymer rosin and metal salts of rosin can be obtained. From a viewpoint of balance between the dissolution to rosin and cleaning property to soil causing a white residue due to the polymer rosin, a more preferable mass proportion of the component (b1)/component (b2) is within a range of from 80/20 to 20/80, and much more preferable is from 70/30 to 30/70.

When the component (c), the antioxidant, and the component (d), the ultraviolet absorber, are added, {(c)+(d)} is preferably from 1 to 1000 ppm, and more preferably from 10 to 1000 ppm, to {(a)+(b)}. Further, it is preferred that the mass proportion of (c)/(d) is within a range of from 90/10 to 10/90, and more preferably from 80/20 to 20/80.

The rinsing agent in accordance with the present invention can be obtained according to a process comprising mixing and blending the above-mentioned respective components, the component (a1), the component (a2), the component (b), the component (c) and the component (d) with one another in a conventional manner, or a process comprising heating the cleaning agent in accordance with the present invention to generate its vapor, and cooling the vapor to obtain a condensate. In the case where the rinsing agent in accordance with the present invention is used in a continuous manner, it is recommendable to use the condensate obtained through generation of the vapor.

In order to obtain characteristic features of the rinsing agent, such as high rinsing property, high drying property, low oxidation deterioration, low toxicity and low flammability, blending amounts of respective components are necessarily as follows. A blending amount of the component (a1), the chlorine-free fluorine-containing compound, is from 80.0% by mass to 99.9% by mass, preferably from 90.0% by mass to 99.9% by mass, and more preferably from 95.0% by mass to 99.5% by mass, to the whole composition. When the blending amount is 80.0% by mass or more, superior drying property due to a sufficient evaporation rate can be obtained. When it is 99.9% by mass or less, superior rinsing property to the cleaning agent containing much soil can be obtained. The blending amount of the component (b), the component having a vapor pressure of less than $1.33\times10^3$ Pa at 20° C., is from 0.1% by mass to 20.0% by mass, preferably from 0.1% by mass to 10% by mass, and more preferably from 0.5% by mass to 5% by mass. When the blending amount is 0.1% by mass or more, superior rinsing property can be obtained. When it is 20.0% by mass or less, sufficient drying property can be obtained.

It is permitted to add (a2) at least one compound selected from the group consisting of alcohols, ketones, esters and hydrocarbons to the rinsing agent containing the components (a1) and (b). The amount added thereof is from 0.1% by mass to 20.0% by mass, preferably from 0.1% by mass to 10% by mass, and more preferably from 0.5% by mass to 5% by mass. When the amount is 0.1% by mass or more, a more preferred vapor-cleaning property can be attained. When it is 20% by mass or less, a more preferred rinsing agent with low possibility of flash can be obtained.

When the component (c), the antioxidant, and the component (d), the ultraviolet absorber, are added, {(c)+(d)} is preferably from 1 to 1000 ppm, and more preferably from 10 to 500 ppm, to {(a1)+(b)}. The mass proportion of (c)/(d) is within a range of preferably from 90/10 to 10/90, and more preferably from 80/20 to 20/80.

It is preferred that the composition of the rinsing agent is the same as that of the cleaning agent to be rinsed, because it is easy to keep the composition of the rinsing agent constant.

Melting points of the cleaning agent and the rinsing agent in accordance with the present invention are preferably not higher than 15° C., respectively. In view of uses in the winter, more preferable are not higher than 10° C., and much more preferable are not higher than 5° C.

If desired, it is permitted to add various kinds of auxiliary agents such as surfactants, stabilizers, defoaming agents and ultraviolet absorbers to the cleaning agent and the rinsing agent in accordance with the present invention in a manner such that effects of the present invention are not impaired.

Examples of the additives, which may be added to the cleaning agent in accordance with the present invention, are explained as follows.

As the surfactant, anionic surfactants, cationic surfactants, nonionic surfactants and amphoteric surfactants may be added. The anionic surfactants include an alkali metal, alkanol amine or amine salt of aliphatic acids having 6 to 20 carbon atoms or dodecylbenzene sulfonic acid. The cationic surfactants include quaternary ammonium salts. The nonionic surfactants include ethylene oxide additives of alkylphenols or straight chain or branched aliphatic alcohols having 8 to 18 carbon atoms, and polyethylene oxide polypropylene oxide block polymers. The amphoteric surfactants include betaine type and amino acid type ones.

As the stabilizers for controlling corrosion, rust generation and discoloration of metals, nitroalkanes such as nitromethane and nitroethane, epoxides such as 1,2-butylene oxide, ethers such as 1,4-dioxane, amines such as triethanolamine, and 1,2,3-benztriazoles are mentioned.

As the defoaming agents, self-emulsified silicone, silicone, fatty acids, higher alcohols, polypropylene glycol, polyethylene glycol and fluorine surfactants are mentioned.

The most effective cleaning can be attained with the cleaning agent and the rinsing agent in accordance with the present invention by means of the following cleaning method, soil-separating method and cleaning apparatus.

The cleaning methods according to the 21st to 25th aspects of the present invention are to carry out cleaning with the cleaning agent (e) containing the component having a vapor pressure of not less than $1.33\times10^3$ Pa at 20° C. (a1), and the component having a vapor pressure of less than $1.33\times10^3$ Pa at 20° C. (b). If desired, the antioxidant (c) may be added thereto, thereby obtaining superior metal stability. Further, the processes are characterized in that after completion of the cleaning, rinsing and/or vapor-cleaning are (is) carried out with (f) vapor of the cleaning agent and its condensate, the vapor being generated by heating the cleaning agent. It is noted that the component (a1), the chlorine-free fluorine-containing compound is inevitably used to obtain the cleaning agent and rinsing agent having no flash point. In the cleaning step, physical means such as hand wiping, dipping and showering are combined for the purpose of improving cleaning property, so that an effective cleaning can be attained. In addition, in the rinsing step, physical means such as dipping and spraying are combined for the purpose of improving rinsing property, so that the rinsing property can be further improved. For the purpose of improving the rinsing property, it is more preferred to use a solvent containing substantially no soil as the rinsing agent. When a spray-rinsing is carried out for the purpose of cleaning or rinsing, a discharging pressure is preferably from $1\times10^3$ to $2\times10^6$ Pa, and more preferably from $1\times10^4$ to $1\times10^6$ Pa. The cleaning method in accordance with the present invention can be said to be the most suitable as a cleaning method using a cleaning agent, because it is superior in both cleaning property and drying property and has little effect on a material to be cleaned.

A cleaning method carried out with the cleaning agent in accordance with the present invention and a cleaning apparatus therewith may be any process and apparatus capable of cleaning a material to be cleaned. For example, it is possible to improve and then use a conventional cleaning method and apparatus so far used with a chlorine cleaning agent. There is no limitation for the cleaning method and apparatus. A preferred cleaning apparatus with use of the cleaning agent and rinsing agent accordance with the present invention is explained as follows.

As a cleaning apparatus preferable for a one liquid cleaning wherein the cleaning agent in accordance with the present invention containing a component having a low vapor pressure, namely the component (b) having a vapor pressure of less than $1.33\times10^3$ Pa at 20° C. is used, and no rinsing agent is used, there are mentioned a cleaning method and an apparatus, wherein a cleaning tank is heated, thereby enabling a heat-cleaning of the soil attached to a material to be cleaned in the cleaning tank, and a condensate of the component (a) having a high vapor pressure mainly contained in the cleaning agent and the component (b) slightly contained therein is subjected to spray-rinsing in a vapor zone, thereby rinsing a small amount of soil possibly attached to the surface of a material to be cleaned, and moreover a temperature of the material to be cleaned is lowered, thereby increasing the vapor-cleaning effect. According to the cleaning method and cleaning apparatus in accordance with the present invention, it is not necessary to use any rinsing agent and a one liquid cleaning can be carried out, and as a result, a cleaning system easy in a liquid control can be attained.

As a specific example of the cleaning method, the cleaning apparatus according to the 35th aspect of the present invention and the cleaning method according to the 36th aspect of the present invention are preferably pointed out. The cleaning method and cleaning apparatus in accordance with the present invention are explained in detail with reference to the drawings attached as follows. The cleaning apparatus shown in FIG. 1, which is an embodiment of the cleaning apparatus according to the 35th aspect of the present invention, comprises as a main structure, a cleaning tank (A) 1, in which the cleaning liquid (e) is introduced, a vapor zone (B) 2, which is filled with vapor of the cleaning agent, a cooling pipe 6, with which the evaporated cleaning agent is condensed, a water separation tank (C) 3, in which the condensate is separated from water attached to the cooling pipe 6, and mechanisms (D) 5, 10, 11, 12 and 13 for spray-rinsing the condensate separated in the water separation tank (C) 3. In carrying out a practical cleaning, a material to be cleaned, which is placed in a jig or cage for exclusive use, is transferred through the cleaning apparatus in order of the cleaning tank (A) 1 and the vapor zone (B) 2, thereby completing the cleaning.

In the cleaning tank (A) 1, the cleaning agent in accordance with the present invention is heated with a heater 4, and the soil attached to the material to be cleaned is cleaned and removed under heating. At this time, any physical power such as vibration and submerged jet of the cleaning agent, as used for a conventional cleaning machine, may be applied.

In the vapor zone (B) 2, a vapor of the component (a) having a high vapor pressure mainly contained in the cleaning agent in accordance with the present invention and the component (b) slightly contained therein is condensed in the cooling pipe 6 and gathered in the water separation tank (C) 3. The liquid temperature of the condensate is lowered with a cooling pipe 97, and thereafter the condensate is transferred in the pipes (D) 10 and 11 with the aid of the spray pump (D) 5, and sprayed to a material to be cleaned through the spray nozzles (D) 12 and 13, thereby removing the soil dissolved and/or dispersed in the cleaning agent, which soil had been attached to the material to be cleaned. The condensate is gathered in the water separation tank (C) 3, thereafter introduced into the cleaning tank (A) 1 through the pipe 9 and the shower pump (D) 5 and heated with the heater 4. A part or the whole of the composition is vaporized and condensed with the cooling pipe 6 as indicated by the arrow 7, and then the condensate is returned to the water separation tank (C) 3 through the pipe 8.

The vapor-cleaning carried out in the vapor zone (B) 2 filled with the vapor generated in the cleaning tank (A) 1 is effective as a finish cleaning carried out in the last stage of the cleaning step, because no soil at all is contained in the liquid produced on the surface of the material to be cleaned through condensation of the vapor.

According to the cleaning apparatus in accordance with the present invention, the component (a) having a high vapor pressure mainly contained in the cleaning agent and the component (b) slightly contained therein are circulated while being subjected to state transition to a liquid or a gas in the cleaning apparatus, and as a result, possibly slightly remaining soil attached to the material to be cleaned can be rinsed or vapor-cleaned without use of any rinsing agent.

Figure 2:
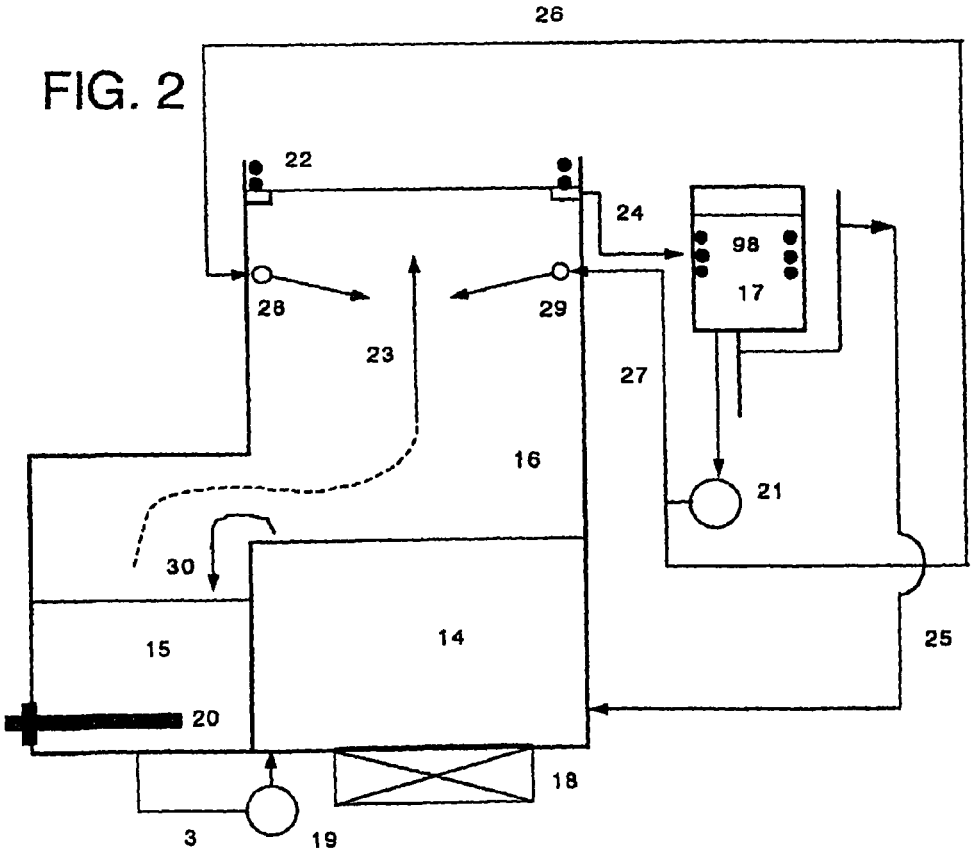
FIG. 2 shows an embodiment of the cleaning apparatus according to the 36th aspect of the present invention.

Next, a cleaning apparatus shown in FIG. 2, which is an example of the cleaning apparatus according to the 36th aspect of the present invention, comprises as a main structure, a cleaning tank (E) 14 and a heating tank (F) 15, in which the cleaning agent (e) is introduced, a vapor zone (G) 16 filled with vapor of the cleaning agent, a cooling pipe 22, with which the evaporated cleaning agent is condensed, a water separation tank (H) 17, in which the condensed liquid is separated from water attached to the cooling pipe, mechanisms (I) 21, 26, 27, 28 and 29 for spray-rinsing the condensate separated in the water separation tank (H) 17, and mechanisms (J) 19 and 31 for circulating the cleaning agent between the cleaning tank (E) 14 and the heating tank (F) 15. In a practical cleaning, a material to be cleaned, which is placed in a jig or cage for exclusive use, is transferred through the cleaning apparatus in order of the cleaning tank (E) 14 and the vapor zone (G) 16, thereby completing the cleaning.

In the cleaning tank (E) 14, the soil attached to the material to be cleaned is cleaned and removed with the aid of an ultrasonic wave 18 while controlling the temperature to a pre-determined degree. At this time, any physical power such as vibration and submerged jet of the cleaning agent, as used for a conventional cleaning machine, may be applied.

In the vapor zone (G) 16, a vapor of the component (a) having a high vapor pressure mainly contained in the cleaning agent in accordance with the present invention and the component (b) slightly contained therein is condensed with the cooling pipe 22 and gathered in the water separation tank (H) 17. The liquid temperature of the condensate is lowered with a cooling pipe 98, and thereafter the condensate is transferred in the pipes (I) 26 and 27 with the aid of the spray pump (I) 21, and sprayed to a material to be cleaned through the spray nozzles (I) 28 and 29, thereby removing the soil dissolved and/or dispersed in the cleaning agent, which soil had been attached to the material to be cleaned. The condensate is gathered in the water separation tank (H) 17, thereafter introduced into the cleaning tank (E) 14 through the pipe 25 and the spray pump (I) 21, overflowed as indicated by the arrow 30, and then introduced into the heating tank (F) 15 to be heated with the heater 20. A part or the whole of the composition is vaporized and condensed with the cooling pipe 22 as indicated by the arrow 7, and then the condensate is returned to the water separation tank (H) 17 through the pipe 24.

The vapor-cleaning carried out in the vapor zone (G) 16 filled with the vapor generated in the heating tank (F) 15 is effective as a finish cleaning carried out in the last stage of the cleaning step, because no soil at all is contained in the liquid produced on the surface of the material to be cleaned through condensation of the vapor.

According to the mechanisms (J) 19 and 31 provided for circulating the cleaning agent between the cleaning tank (E) 14 and the heating tank (F) 15, the cleaning agent is transferred in the cleaning tank (E) 14 through the pipe (J) 31 with the aid of the circulating pump (J) 19, and overflowed as indicated by the arrow 30 to return to the heating tank (F) 15 from the cleaning tank (E) 14, so that the cleaning agent compositions in both the cleaning tank (E) 14 and the heating tank (F) 15 can be always made equal and the fluctuation of the composition of the cleaning agent in the cleaning tank (E) 14 can be prevented, thereby obtaining a stabilized cleaning property.

According to the cleaning apparatus in accordance with the present invention, the component (a) having a high vapor pressure mainly contained in the cleaning agent and the component (b) slightly contained therein are circulated while being subjected to state transition to a liquid or a gas in the cleaning apparatus, and as a result, possibly slightly remaining soil attached to the material to be cleaned can be rinsed or vapor-cleaned without use of any rinsing agent.

In the cleaning apparatus shown in the fore-going FIG. 1 or FIG. 2, it is permitted to increase the cleaning tank and/or the heating tank to two or more tanks, respectively, depending upon the purposes and uses.

As a cleaning apparatus suitably used in the case where precision cleaning of a high cleaning level is carried out using the cleaning agent in accordance with the present invention, which cleaning agent contains the component (b) having a low vapor pressure, namely a vapor pressure of less than $1.33\times10^3$ Pa at 20° C., there is noted an apparatus, wherein the cleaning tank is heated, thereby heat-cleaning the soil attached to the material to be cleaned in the cleaning tank, the condensate of the component (a) having a high vapor pressure mainly contained in the cleaning agent and the component (b) slightly contained therein is allowed to stay in a dip-rinsing tank in which the material to be cleaned is dipped to be rinsed, thereby rinsing possibly slightly remaining soil attached to the surface of the material to be cleaned as well as lowering the temperature of the material to be cleaned, and as a result, a vapor-cleaning effect is increased. The cleaning apparatus in accordance with the present invention, wherein the condensate is allowed to stay in the rinsing tank to carry out dip-rinsing ensures a cleaning system, according to which a more superior rinsing effect can be attained and re-adhesion of soil to the surface of the material to be cleaned can be prevented. It is permitted to use either the condensate obtained through heating the cleaning agent or the rinsing agent in accordance with the present invention as the rinsing agent usable in the dip-rinsing tank.

As a specific example of the cleaning method, preferably, the cleaning apparatus according to the 37th aspect of the present invention is pointed out. The cleaning method and cleaning apparatus in accordance with the present invention are explained in detail with reference to the drawings attached as follows. The cleaning apparatus shown in FIG. 5, which is an example of the cleaning apparatus according to the 37th aspect of the present invention, comprises as a main structure, a cleaning tank (O) 71 having a heating mechanism for heating at least one component constituting the cleaning agent (e) and/or generating vapor thereof, a vapor zone (P) 73, in which vapor-cleaning is carried out with the vapor generated in the cleaning tank (O) 71, a cooling pipe 77, with which the evaporated cleaning agent is condensed, a water separation tank (Q) 74, in which the condensed liquid is separated from water attached to the cooling pipe from, and a rinsing tank (R) 72, in which dip-rinsing is carried out with the condensate freed from water in the water separation tank (Q) 74. In carrying out a practical cleaning, a material to be cleaned, which is placed in a jig or cage for exclusive use, is transferred through the cleaning apparatus in order of the cleaning tank (O) 71, the rinsing tank (R) 72 and the vapor zone (P) 73, thereby completing the cleaning.

In the cleaning tank (O) 71, the cleaning agent in accordance with the present invention is heated with a heater 76, and the soil attached to the material to be cleaned is cleaned and removed under heating. At this time, any physical power such as vibration and submerged jet of the cleaning agent, as used for a conventional cleaning machine, may be applied.

In the rinsing tank (R) 72, the cleaning agent in accordance with the present invention is heated with the heater 76, the evaporated cleaning agent is condensed with the cooling pipe 77, a temperature of the condensate is lowered with the cooling pipe 103 and at the same time, water is removed in the water separation tank (Q) 74, and the cleaning agent and soil attached to the material to be cleaned are cleaned and removed with the water-free condensate returned to the rinsing tank (72) with the aid of a supersonic wave generator 75. At this time, any physical power such as vibration and submerged jet of the cleaning agent, as used for a conventional cleaning machine, may be applied. It is possible to prevent the composition fluctuation of the cleaning agent by using the rinsing agent in accordance with the present invention, which is put in advance in the rinsing tank. Further, for preventing the fluctuation of the composition of the cleaning agent, it is more preferred that the composition of the rinsing agent in accordance with the present invention is made equal to that of the condensate obtained through heating of the cleaning agent.

In the vapor zone (P) 73, the vapor of the component (a) having a high vapor pressure mainly contained in the cleaning agent in accordance with the present invention and the component (b) slightly contained therein is condensed with the cooling pipe 77 and gathered in the water separation tank (Q) 74. Thereafter, the condensate is transferred to the rinsing tank (R) 72, in which the material to be cleaned is dipped in the condensate, thereby removing the soil dissolved and/or dispersed in the cleaning agent, which soil had been attached to the material to be cleaned. The condensate is gathered in the water separation tank (Q) 74, thereafter introduced into the rinsing tank (R) 72 through the pipe 80, overflowed as indicated by the arrow 81, and returned to the cleaning tank (O) 71. The condensate therein is heat-boiled with the heater 76, and a part or the whole of the composition is vaporized and condensed with the cooling pipe 78 as indicated by the arrow 78, and then the condensate is returned to the water separation tank (Q) 74 through the pipe 79.

The vapor-cleaning carried out in the vapor zone (P) 73 filled with the vapor generated in the cleaning tank (O) 71 is effective as a finish cleaning carried out in the last stage of the cleaning step, because no soil at all is contained in the liquid produced on the surface of the material to be cleaned through condensation of the vapor.

According to the cleaning apparatus in accordance with the present invention, the component (a) having a high vapor pressure mainly contained in the cleaning agent and the component (b) slightly contained therein are circulated while being subjected to state transition to a liquid or a gas in the cleaning apparatus, and as a result, possibly slightly remaining soils attached to the material to be cleaned can be cleaned in the rinsing tank (R) 72 and the vapor zone (P) 73. Therefore, the cleaning apparatus is suitable for precision cleaning, for which a higher cleaning level is required.

Figure 5:
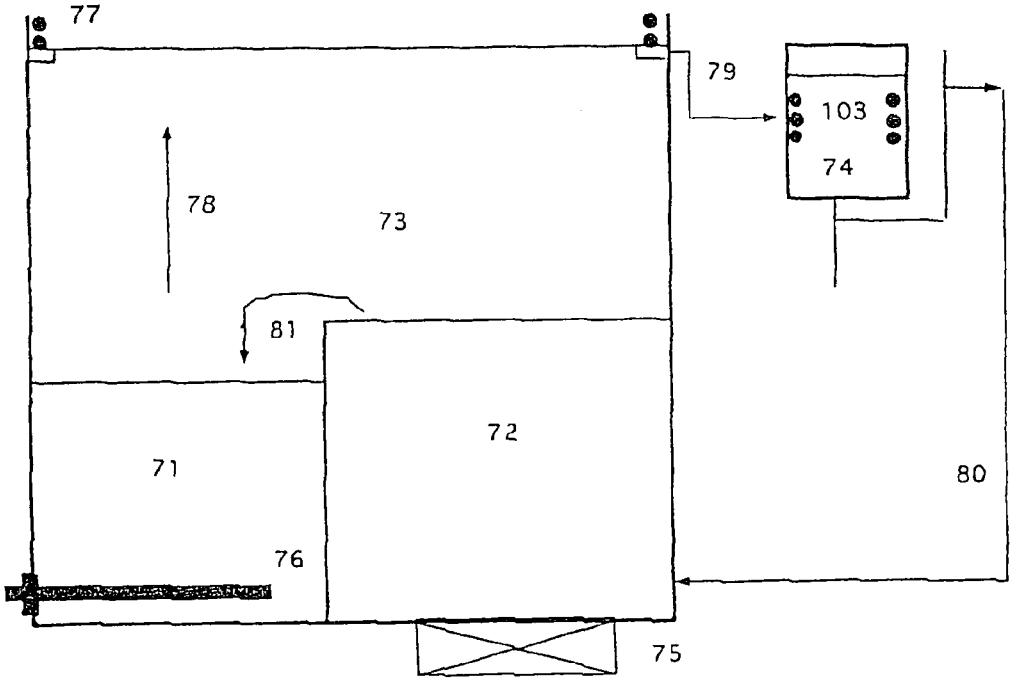
FIG. 5 shows an embodiment of the cleaning apparatus according to the 37th aspect of the present invention.

In the cleaning apparatus shown in the foregoing FIG. 5, it is permitted to increase the cleaning tank and/or the rinsing tank to two or more tanks, respectively, depending upon the purposes and uses.

The cleaning method according to the 26th aspect of the present invention is suitable for a cleaning method, wherein the cleaning is carried out using two liquids, namely, the cleaning agent in accordance with the present invention, which contains the component (b) having a low vapor pressure of less than $1.33\times10^3$ Pa at 20° C., and the component (a) or/and the rinsing agent in accordance with the present invention, without liquid circulation between the cleaning tank and the rinsing tank or/and the heating tank with independent use of the cleaning agent and the component (a) or/and the rinsing agent.

Specifically, according to the cleaning method, the soil attached to the material to be cleaned is cleaned while heating the cleaning agent in the cleaning tank and controlling the cleaning agent temperature to a fixed degree, and a condensate of the component (a) or/and the rinsing agent in accordance with the present invention is allowed to stay in the rinsing tank, in which the material to be cleaned is dipped and rinsed, thereby rinsing a small amount of soil possibly attached to the surface of the material to be cleaned, and lowering the temperature of the material to be cleaned, and as a result, the vapor-cleaning effect with the vapor of the component (a) or/and the rinsing agent in accordance with the present invention can be increased. In cleaning a substrate equipped with parts such as an aluminum electrolysis condenser by means of flux cleaning, the cleaning method and the cleaning apparatus in accordance with the present invention, wherein the temperature of the cleaning agent in the cleaning tank is controlled can ensure a cleaning system capable of diminishing any effect on the parts on board.

As a specific example of the cleaning method, the cleaning apparatus according to the 38th aspect of the present invention is preferably pointed out. The cleaning method and cleaning apparatus in accordance with the present invention are explained in detail with reference to the drawing attached as follows. The cleaning apparatus shown in FIG. 6, which is an example of the cleaning apparatus according to the 38th aspect of the present invention, comprises as a main structure, a cleaning tank (S) 82 having a heating mechanism for heating the cleaning agent, a rinsing tank (T) 83, in which the material to be cleaned is rinsed with the rinsing agent, a heating tank (U) 84 having a heating mechanism for boiling the rinsing agent, a vapor zone (V) 85, in which vapor-cleaning is carried out with the vapor generated in the heating tank (U) 84, a cooling pipe 92, with which the evaporated cleaning agent is condensed, and a water separation tank (W) 86, in which the condensed liquid is separated from water attached to the cooling pipe. In carrying out a practical cleaning, a material to be cleaned, which is placed in a jig or cage for exclusive use, is transferred through the cleaning apparatus in order of the cleaning tank (S) 82, the rinsing tank (T) 83 and the vapor zone (V) 85, thereby completing the cleaning.

In the cleaning tank (S) 82, the soil attached to the material to be cleaned is cleaned and removed with the aid of a supersonic wave generator 89 while the cleaning agent in accordance with the present invention is heated with a heater 87. At this time, any physical power such as vibration and submerged jet of the cleaning agent, as used for a conventional cleaning machine, may be applied. Incidentally, the component (a) having a high vapor pressure contained in the cleaning agent is once evaporated by heating, and condensed with a cooling pipe 90, and as a result, the resulting condensate is returned to the cleaning tank (S) 82. Therefore, fluctuation of the composition can be diminished.

In the rinsing tank (T) 83, the cleaning agent and soil attached to the material to be cleaned are cleaned and removed with the component (a), the rinsing agent in accordance with the present invention and their condensates. At this time, any physical power such as vibration and submerged jet of the cleaning agent, as used for a conventional cleaning machine, may be applied.

In the vapor zone (V) 85, a vapor of mainly the component (a) having a high vapor pressure is condensed with the cooling pipe 92 and gathered in the water separation tank (W) 86. After lowering the liquid temperature of the condensate with the cooling pipe 105, the condensate is transferred to the rinsing tank (T) 83, in which the material to be cleaned is dipped in the condensate, whose temperature is lowered with the cooling pipe 104, thereby removing the soil dissolved and/or dispersed in the cleaning agent, which soil had been attached to the material to be cleaned. The condensate is gathered in the water separation tank (w) 86, thereafter introduced into the rinsing tank (T) 83 through the pipe 95, overflowed as indicated by the arrow 96, and returned to the heating tank (U) 84. The condensate therein is heated with the heater 88, and a part or the whole of the composition is vaporized and condensed with the cooling pipe 92 as indicated by the arrow 93, and then the condensate is returned to the water separation tank (W) 86 through the pipe 94. Incidentally, water in the air is condensed with the cooling pipe 91, so that conveyance of water in the cleaning machine can be prevented, and at the same time loss of the cleaning agent and the rinsing agent owing to diffusion of the vapor can be diminished.

The vapor-cleaning carried out in the vapor zone (V) 85 filled with the vapor generated in the distillation tank (U) 84 is effective as a finish cleaning carried out in the last stage of the cleaning step, because no soil at all is contained in the liquid produced on the surface of the material to be cleaned through condensation of the vapor.

According to the cleaning apparatus in accordance with the present invention, two liquids of the cleaning agent and the rinsing agent are used in tanks different from each other, so that possibly small amounts of soil remaining attached to the material to be cleaned can be cleaned in the rinsing tank (T) 83 and the vapor zone (V) 85 while diminishing the composition fluctuation of the cleaning agent in the cleaning tank. Therefore, the cleaning apparatus can be applied for precision cleaning, for which a higher cleaning level is required.

Figure 6:
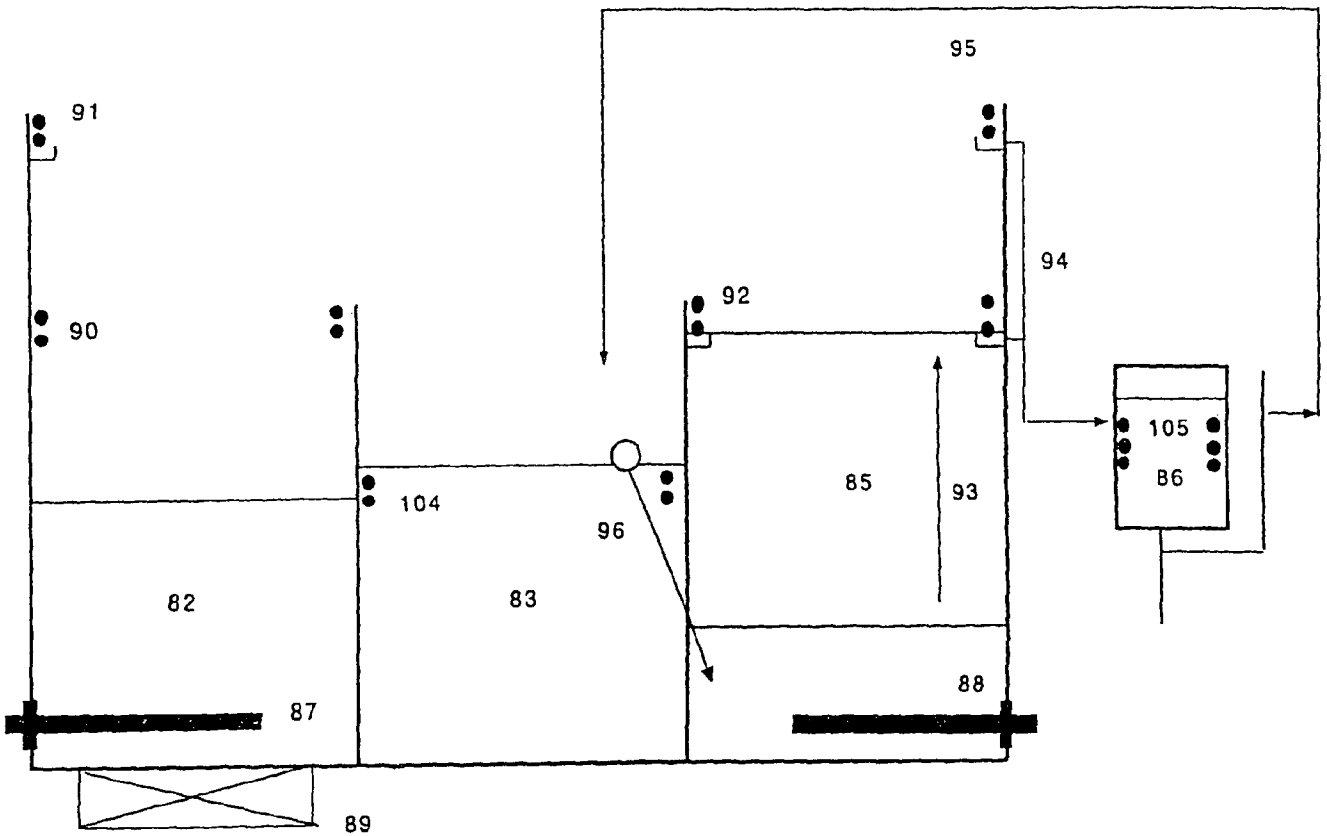
FIG. 6 shows an embodiment of the cleaning apparatus according to the 38th aspect of the present invention.

In the cleaning apparatus shown in the foregoing FIG. 6, it is permitted to increase the number of the cleaning tank and/or the rinsing tank to two or more depending upon the purposes and uses.

The soil-separating method according to the 27th aspect of the present invention is characterized in that (f) a liquid formed by condensing vapor, which is generated by heating the cleaning agent in accordance with the present invention and allowed to stay in the water separation tank, and the cleaning agent contaminated with soil in the cleaning tank are contacted with each other in the soil-separating tank, thereby separating the soil dissolved in the cleaning agent, and thereafter the liquid freed from the soil is returned to the cleaning tank, and as a result the soil in the cleaning agent can be separated in a continuous manner. Particularly in order to obtain the cleaning agent and the rinsing agent having no flash point, it is necessary to use the component (a1), namely the chlorine-free fluorine-containing compound. Further, in order to increase the soil-separating efficiency, the amount of the cleaning agent supplied to the soil-separating tank is increased, and at the same time, the temperature inside of the soil-separating tank is lowered. As a result, it is possible to separate the soil more effectively. The temperature inside the soil-separating tank is kept preferably at not higher than 20° C., and more preferably not higher than 10° C. Further, from a viewpoint of enabling a gravity separation, it is preferred that the specific gravity of the soil separated is different from that of the liquid in the separating tank. According to the soil-separating method in accordance with the present invention, on use of the cleaning agent (e), the life thereof can be far improved, and moreover it is possible to diminish work frequency such as exchange of the cleaning agent and decrease the running cost. Accordingly, it can be said that it is the most suitable soil-separating method.

As the cleaning method and cleaning apparatus having a soil-separating mechanism, which are carried out with the cleaning agent in accordance with the present invention, any apparatus capable of cleaning the material to be cleaned may be used. For example, it is permitted to use a conventional cleaning apparatus as used with conventional chlorine cleaning agent, which is altered to have the soil-separating mechanism. Although the cleaning method and cleaning apparatus having the soil-separating mechanism are not limited, the cleaning apparatus according to the 39th aspect of the present invention and the cleaning apparatus according to the 40th aspect of the present invention are pointed out as examples of a specific cleaning method having the soil-separating mechanism. The cleaning method and cleaning apparatus having the soil-separating mechanism in accordance with the present invention are explained with reference to the attached Figures as follows. The soil-separating mechanism-carrying cleaning apparatus shown in FIG. 3, which is an example of the cleaning apparatus according to the 39th aspect of the present invention, comprises as a main structure, a cleaning tank (A) 32, in which the cleaning agent is introduced, a vapor zone (B) 33, which is filled with vapor of the cleaning agent, a cooling pipe 39, with which the evaporated cleaning agent is condensed, a water separation tank (C) 34, in which the condensed liquid is separated from water attached to the cooling pipe, a soil-separating tank (K) 35, in which the condensate allowed to stay in the water separation tank (C) 34 and the cleaning agent contaminated with soil in the cleaning tank are contacted with each other, thereby separating and removing the soil dissolved in the cleaning agent, mechanisms (D) 36, 43, 44, 45 and 46 for spray-rinsing the condensate separated in the water separation tank (C) 34, and mechanisms (L) 37 and 47 for transferring the cleaning agent in the cleaning tank (A) 32 to the soil-separating tank in a continuous manner. In carrying out a practical cleaning, a material to be cleaned, which is placed in a jig or cage for exclusive use, is transferred through the cleaning apparatus in order of the cleaning tank (A) 32 and the vapor zone (B) 33, thereby completing the cleaning.

In the cleaning tank (A) 32, the soil attached to the material to be cleaned is cleaned and removed while the cleaning agent in accordance with the present invention is heated with a heater 38. At this time, any physical power such as vibration and submerged jet of the cleaning agent, as used for a conventional cleaning machine, may be applied.

In the vapor zone (B) 33, the vapor of the component (a) having a high vapor pressure mainly contained in the cleaning agent in accordance with the present invention and the component (b) slightly contained therein are condensed with the cooling pipe 39 and gathered in the water separation tank (C) 34. After lowering the liquid temperature of the condensate with the cooling pipe 99, the condensate is transferred to the pipes (D) 43 and 44 with the aid of the spray pump (D) 36, and sprayed on the material to be cleaned through the spray nozzles (D) 45 and 46, thereby removing the soil dissolved and/or dispersed in the cleaning agent, which soil had been attached to the material to be cleaned.

In the soil-separating tank (K) 35, the condensate of the water separation tank (C) 34, which is introduced through the pipe 42, and the cleaning agent of the cleaning tank (A) 32 transferred with the aid of the cleaning agent-transferring pump (L) 37 are contacted with each other, and at the same time, the liquid temperature is lowered with the cooling pipe 100, thereby separating and removing the soil dissolved in the cleaning agent. Thereafter the cleaning agent freed from the soil and the condensate are returned to the cleaning tank (A) 32, and as a result, the soil conveyed by the cleaning agent can be removed in a continuous manner. The condensate is gathered in the water separation tank (C) 34, and after lowering the liquid temperature with the cooling pipe 99, returned to the cleaning tank (A) 32 passing through the pipe 42, the soil-separating tank (K) 35 and the pipe 48. Further, the condensate is returned to the cleaning tank (A) 32 from the spray pump (D) 36 passing through the pipes 43 and 44 and the spray nozzles (D) 45 and 46. In the cleaning tank, the condensate is heated with the heater 38, and a part or the whole thereof is vaporized and condensed with the cooling pipe 39 as indicated by the arrow 40, and then the condensate is returned to the water separation tank (C) 34 through the pipe 41.

The vapor-cleaning carried out in the vapor zone (B) 33 filled with the vapor generated in the cleaning tank (A) 32 is effective as a finish cleaning carried out in the last stage of the cleaning step, because no soil at all is contained in the liquid produced on the surface of the material to be cleaned through condensation of the vapor.

According to the cleaning apparatus in accordance with the present invention, the component (a) having a high vapor pressure mainly contained in the cleaning agent and the component (b) slightly contained therein are circulated while being subjected to state transition to a liquid or a gas in the cleaning apparatus, and as a result, possibly small amounts of soil remaining attached to the material to be cleaned can be rinsed or vapor-cleaned without use of any rinsing agent, and moreover, the soil conveyed by the cleaning agent can be separated and removed in a continuous manner, thereby far improving the cleaning agent life.

Figure 4:
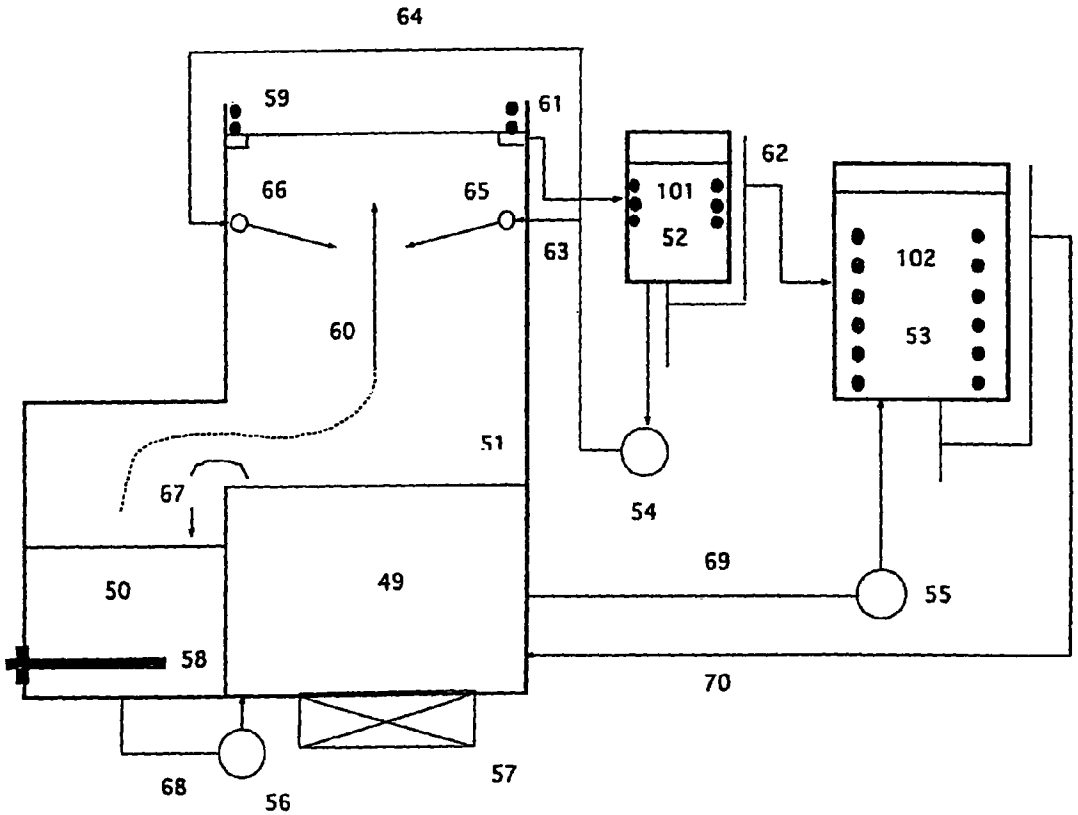
FIG. 4 shows an embodiment of the cleaning apparatus according to the 40th aspect of the present invention.

The soil-separating mechanism-carrying cleaning apparatus shown in FIG. 4, which is an example of the cleaning apparatus according to the 40th aspect of the present invention, comprises as a main structure, a cleaning tank (E) 49 and a heating tank (F) 50, in which the cleaning agent (e) is introduced, a vapor zone (G) 51, which is filled with vapor of the cleaning agent, a cooling pipe 59, with which the evaporated cleaning agent is condensed, a water separation tank (H) 52, in which the condensed liquid is separated from water attached to the cooling pipe, a soil-separating tank (M) 53, in which the condensate allowed to stay in the water separation tank (H) 52 and the cleaning agent contaminated with soil in the cleaning tank are contacted with each other, thereby separating and removing the soil dissolved in the cleaning agent, mechanisms (I) 54, 63, 64, 65 and 66 for spray-rinsing the condensate separated in the water separation tank (H) 52, mechanisms (J) 56 and 68 for circulating the cleaning agent between the cleaning tank (E) 49 and the heating tank (F) 50, and mechanisms (N) 55 and 69 for transferring the cleaning agent in the cleaning tank (E) 49 to the soil-separating tank in a continuous manner. In carrying out a practical cleaning, a material to be cleaned, which is placed in a jig or cage for exclusive use, is transferred through the cleaning apparatus in order of the cleaning tank (E) 49 and the vapor zone (G) 51, thereby completing the cleaning.

In the cleaning tank (E) 49, the soil attached to the material to be cleaned is cleaned and removed with the aid of the ultrasonic wave 57 while controlling the temperature at a fixed degree. At this time, any physical power such as vibration and submerged jet of the cleaning agent, as used for a conventional cleaning machine, may be applied.

In the vapor zone (G) 51, the vapor of the component (a) having a high vapor pressure mainly contained in the cleaning agent in accordance with the present invention and the component (b) slightly contained therein are condensed with the cooling pipe 59 and gathered in the water separation tank (H) 52. After lowering the liquid temperature of the condensate with the cooling pipe 101, the condensate is transferred to the pipes (I) 63 and 64 with the aid of the spray pump (I) 54, and sprayed on the material to be cleaned through the spray nozzles (I) 65 and 66, thereby removing the soil dissolved and/or dispersed in the cleaning agent, which soil had been attached to the material to be cleaned.

In the soil-separating tank (M) 53, the condensate of the water separation tank (H) 52, which is introduced through the pipe 62, and the cleaning agent of the cleaning tank (E) 49 transferred with the aid of the cleaning agent-transferring pump (N) 55 are contacted with each other, and at the same time, the liquid temperature is lowered with the cooling pipe 102, thereby separating and removing the soil dissolved in the cleaning agent. Thereafter the cleaning agent freed from the soil and the condensate are returned to the cleaning tank (E) 49, and as a result, the soil conveyed to the cleaning agent can be removed in a continuous manner. The condensate is gathered in the water separation tank (H) 52, and then returned to the cleaning tank (E) 49 passing through the pipe 62, the soil-separating tank (M) 53 and the pipe 70. Further, the condensate is returned to the cleaning tank (E) 49 from the spray pump (I) 54 passing through the pipes (I) 63 and 64 and the spray nozzles (I) 65 and 66. From the cleaning tank (E) 49, the condensate is overflowed as indicated by the arrow 67 to enter the heating tank (F) 50, wherein the condensate is heated with the heater 58, and a part or the whole thereof is vaporized and condensed with the cooling pipe 59 as indicated by the arrow 60, and then the condensate is returned to the water separation tank (H) 52 through the pipe 61.

The vapor-cleaning carried out in the vapor zone (G) 51 filled with the vapor generated in the heating tank (F) 50 is effective as a finish cleaning carried out in the last stage of the cleaning step, because no soil at all is contained in the liquid produced on the surface of the material to be cleaned through condensation of the vapor.

The mechanisms (J) 56 and 68 for circulating the cleaning agent between the cleaning tank (E) 49 and the heating tank (F) 50 serve to transfer the cleaning agent from the heating tank (F) 50 to the cleaning tank (E) 49 through the pipe (J) 68 with the aid of the circulation pump (J) 56, and overflow the cleaning agent from the cleaning tank (E) 49 as indicated by the arrow 67, thereby returning the cleaning agent to the heating tank (F) 50. As a result, the cleaning agent compositions in the cleaning tank (E) 49 and the heating tank (F) 50 can be made always equal and the fluctuation of the composition of the cleaning agent in the cleaning tank (E) 49 can be controlled, so that a stable cleaning property can be attained.

According to the cleaning apparatus in accordance with the present invention, the component (a) having a high vapor pressure mainly contained in the cleaning agent and the component (b) slightly contained therein are circulated while being subjected to state transition to a liquid or a gas in the cleaning apparatus, and as a result, possibly small amounts of soil remaining attached to the material to be cleaned can be rinsed or vapor-cleaned without use of any rinsing agent, and moreover, the soil conveyed to the cleaning agent can be separated and removed in a continuous manner, thereby far improving the cleaning agent life. With respect to the cleaning apparatus shown in the foregoing FIG. 3 or FIG. 4, it is permitted to increase the number of the cleaning tank and/or the heating tank to two or more depending upon the purposes and uses.

The soil-separating method according to the 28th or 29th aspect of the present invention may be added to the cleaning apparatus used for carrying out cleaning with the cleaning agent in accordance with the present invention. For example, in the soil-separating method according to the 27th aspect of the present invention, a soil separation filter can be incorporated into the piping, wherein the liquid treated in the soil-separating tank is returned to the cleaning tank, so that any soil finely dispersed in the liquid returning to the cleaning tank can be separated.

The "separation filter" used in the present invention may be any of woven fabric, knitted fabric or non-woven fabric. The fabric constituting the "separation filter" is not limited, and includes, for example, polyester copolymer fiber such as polyethylene terephthalate and polybutylene tetrephthalate, polyamide fiber such as polyhexamethylene adipamide and polycapramide, polyamide imide fiber, aromatic polyamide fiber, polyester ether fiber such as polyparaoxybenzoate, halogen-containing polymer fiber such as polyvinyl chloride, polyvinylidene chloride and polytetrafluoroethylene, polyolefin fiber such as polypropylene and polyethylene, various acrylic fiber, polyvinyl alcohol fiber, and natural fiber such as regenerated cellulose, acetate, cotton, hemp, silk and wool. These fibers can be used singly or in combination thereof. Further, it is permitted to use products obtained by subjecting these fibers to water repellent finishing with dimethyl polysiloxane or a perfluoroalkyl group-carrying fluorine resin.

The single fiber diameter of the fiber constituting the "separation filter" used in the present invention is not particularly limited as long as the soil separation property is not impaired. The main constituent is that having a diameter of preferably from 0.1 to 10 μm, and more preferably not more than 2 μm. The "main constituent" means that the total weight of fibers having the above-defined single fiber diameter is not less than 50% based on a total weight of the fibers constituting the separation filter. When the single fiber diameter is not more than 10 μm, a more preferable removability of finely dispersed soil and treatment rate can be obtained. Those having the diameter of not less than 0.1 μm are easily available.

The thickness of the separation filter is not particularly limited as long as the soil separability is not impaired, and is preferably from 0.1 to 70 mm. When the thickness is not less than 0.1 mm, a more preferable separation effect can be obtained. When it is not more than 70 mm, it is possible to more preferably diminish the pressure loss at the time when the liquid passes through it.

The separation filter used in the present invention may have any optional form such as plain membrane-like, cylindrical, spiral and pleat-like forms. From a viewpoint of treatment efficiency, it is preferred to use the separation filter in the pleat-like form. The separation filter may be used in one sheet or more than one sheet, placed one over the other. How to enable the liquid to pass through it is not limited, and the liquid may pass through it under gravity, under pressure or in any optional manner.

For the separation filter used in the present invention, it is permitted to use reinforcing materials such as wire nets, plastics and fibrous structures for the purposes of reinforcing and the like. Further, it is permitted to provide a pre-filter for catching dust or dirt, for example, membrane or cotton-like dust-catching materials, before transferring the returning liquid through the separation filter used in the present invention.

As the separation filter used in the present invention, particularly preferred is a separation filter characterized by (a) or (b), which is available from Asahi Chemical Industry Co., Ltd. under the trade name of "EU-TEC".

The separation filter (a), whose main constituent comprises fibers having a single fiber diameter of from 0.1 to 10 μm, is a filter having voids of 30 to 90%, a thickness of from 0.1 to 70 mm and a fiber surface critical surface tension of not less than $3.5\times10^{-2}$ N/m, and is used for coarse grain separation. The separation filter (b), whose main constituent comprises fibers having a single fiber diameter of from 0.1 to 10 μm, is a water repellent filter having voids of 30 to 90%, and is used for separating the soil in the returning liquid.

When the soil is to be separated with the separation filter (a) or/and the separation filter (b) in the present invention, the liquid temperature is kept at preferably 20° C. or lower, more preferably 10° C. or lower, so that the soil finely dispersed in the soil-separating tank can be prevented from re-dissolving in the returning liquid.

According to the cleaning methods according to the 31st to 34th aspect of the present invention, pre-rinsing is carried out with a pre-rinsing agent containing the component (b) before the rinsing, and as a result, even when the concentration of the soil in the cleaning agent increases, poor rinsing in the rinsing tank can be avoided. Although the pre-rinsing agent is not particularly limited as long as there is used a solvent which does not impair the high pre-rinsing property, which is a characteristic feature of the rinsing agent, it is possible to add a constituting component of the cleaning agent and/or the rinsing agent in accordance with the present invention. It is particularly preferred that the component (b) is contained, because the pre-rinsing property can be improved. In order to obtain a pre-rinsing agent having no flash point, it is necessary to use the component (a1) of the chlorine-free fluorine-containing compound. Further, from a viewpoint of diminishing fluctuations of the composition of the cleaning agent and the rinsing agent, it is preferred that the composition of the pre-rinsing agent is the same as that of the cleaning agent and the rinsing agent. The concentration of the component (b) in the pre-rinsing agent is not particularly limited as long as the high pre-rinsing property, which is a characteristic feature of the pre-rinsing agent, is not impaired. It is preferred that the concentration is lower than the component (b) concentration in the cleaning agent, because the rinsing property owing to the rinsing agent in the rinsing tank can be improved and a high drying property can be attained. Further, it is preferred that the concentration is higher than the component (b) concentration in the rinsing agent, because substitution of the soil-containing cleaning agent component can be increased and a high pre-rinsing property can be attained. Further, it is more preferred that the component (b) concentration in the pre-rinsing agent is lower than the component (b) concentration in the cleaning agent to be used and higher than the component (b) concentration in the liquid formed by condensing vapor of the cleaning agent or that in the rinsing agent. Furthermore, the component (b) concentration in the pre-rinsing agent is preferably from 5 to 50% by mass, and more preferably from 10 to 30% by mass. In addition, it is preferred that the liquid treated according to the soil-separating method according to the 27th to 29th aspects of the present invention is used as the pre-rinsing agent, because when the cleaning is carried out continuously, it is possible to make the soil concentration in the pre-rinsing agent low and constant, so that no exchange of the pre-rinsing agent is required and the running cost can be decreased, and further because it is possible to keep the component (b) concentration in the pre-rinsing agent to a desired concentration, namely to a level medium between the component (b) concentration in the cleaning agent and the component (b) concentration in the rinsing agent, and it is also possible to keep it constant, so that a more superior rinsing property in the rinsing tank can be attained. In the pre-rinsing step, for the purpose of improving the pre-rinsing property, a physical means such as dip-spraying and application of ultrasound can be combined, thereby attaining an effective pre-rinsing. When the pre-rinsing is carried out by means of spraying, the discharge pressure is preferably from $1\times10^3$ to $2\times10^6$ Pa, more preferably from $1\times10^4$ to $1\times10^6$ Pa. The cleaning method with the cleaning agent in accordance with the present invention is superior in cleaning property and drying property, and has little effect on the material to be cleaned, and therefore it can be said to be the most suitable cleaning method.

As the cleaning method and cleaning apparatus in accordance with the present invention, wherein the pre-rinsing agent is used, any process and apparatus capable of cleaning the material to be cleaned may be used. For example, it is permitted to use those prepared by improving a conventional cleaning method and apparatus so far used using a chlorine cleaning agent. Although the cleaning method and cleaning apparatus are not limited, in carrying out pre-rinsing with the pre-rinsing agent containing the component (b) before rinsing, it is preferred to combine physical means such as dipping and spraying, thereby improving the pre-rinsing property. As specific examples of the cleaning method preferably carried out with the cleaning agent and pre-rinsing agent in accordance with the present invention, there are pointed out the cleaning apparatus according to the 44th aspect of the present invention, wherein the pre-rinsing is carried out by means of spraying, and the cleaning apparatus according to the 45th aspect of the present invention, wherein the pre-rinsing is carried out by means of dipping. The cleaning method and cleaning apparatus in accordance with the present invention are explained with reference to the attached Figures as follows. The cleaning apparatus shown in FIG. 7, which is an example of the cleaning apparatus according to the 44th aspect of the present invention, comprises as a main structure, a cleaning tank (E) 106 and a heating tank (F) 121, in which the cleaning agent (e) is introduced, a vapor zone (G) 108, which is filled with vapor of the cleaning agent, a cooling pipe 122, with which the evaporated cleaning agent is condensed, a water separation tank (H) 109, in which the condensed liquid is separated from water attached to the cooling pipe, a soil-separating tank (M) 112, in which the condensate allowed to stay in the water separation tank (H) 109 and the cleaning agent contaminated with soil in the cleaning tank are contacted with each other, thereby separating and removing the soil dissolved in the cleaning agent, mechanisms (X) 115, 117 and 118 for separating the soils in the liquid treated in the soil-separating tank with the separation filter, mechanisms (Y) 111, 117, 124 to 127, 129 and 131 to 133 for spray-rinsing the condensate separated in the water separation tank (H) 109 and the liquid treated with the separation filter, mechanisms (J) 120 and 134 for circulating the cleaning agent between the cleaning tank (E) 106 and the heating tank (F) 107, and a mechanism (N) 114 for transferring the cleaning agent in the cleaning tank (E) 106 to the soil-separating tank in a continuous manner. In a practical cleaning, a material to be cleaned, which is placed in a jig or cage for exclusive use, is transferred through the cleaning apparatus in order of the cleaning tank (E) 106 and the vapor zone (G) 108, thereby completing the cleaning.

In the cleaning tank (E) 106, the soil attached to the material to be cleaned is cleaned and removed with the aid of the ultrasonic wave 57 while controlling the temperature at a fixed degree. At this time, any physical power such as vibration and submerged jet of the cleaning agent, previously used for a conventional cleaning machine, may be applied.

In the vapor zone (G) 108, the pre-rinsing liquid passing through the separation filter (X) 118 is transferred to the check valve (Y) 133 and the pipes (Y) 126 and 127 with the aid of the pump (X) 117, and sprayed over the material to be cleaned through the spray nozzles (Y) 124 and 125, thereby removing the soil dissolved and/or dispersed in the cleaning agent, which had been attached to the material to be cleaned. Thereafter, the vapor of the component (a) having a high vapor pressure mainly contained in the cleaning agent in accordance with the present invention and the component (b) slightly contained therein are condensed with the cooling pipe 122 and gathered in the water separation tank (H) 109. After lowering the liquid temperature of the condensate with the cooling pipe 110, the condensate freed from the soil is transferred to the check valve (Y) 129 and the pipes (Y) 126 and 127 with the aid of the spray pump (Y) 111, and sprayed to the material to be cleaned through the spray nozzles (Y) 124 and 125, thereby removing the soil dissolved and/or dispersed in the cleaning agent, which soil had been attached to the material to be cleaned.

In the soil-separating tank (M) 112, the condensate of the water separation tank (H) 109, which is introduced through the pipe 130, and the cleaning agent of the cleaning tank (E) 106 transferred with the aid of the cleaning agent-transferring pump (N) 114 are contacted with each other, and at the same time, the liquid temperature is lowered with the cooling pipe 113, thereby separating and removing the soil dissolved in the cleaning agent, thereafter the cleaning agent freed from the soil and the condensate are returned to the cleaning tank (E) 106, and as a result, the soil conveyed to the cleaning agent can be removed in a continuous manner. The liquid treated in the soil-separating tank (M) 112 is once gathered in the tank (X) 115 for the soil-separating tank treatment liquid before returning to the cleaning tank (E) 106, after lowering the liquid temperature with the cooling pipe 116, and further transferred through the separation filter (X) 118 with the aid of the pump (X, Y) 117, thereby separating the soil finely dispersed in the liquid, and then returned to the cleaning tank (E) 106 as it is through the pipe 132. The condensate is gathered in the water separation tank (H) 109, and then returned to the cleaning tank (E) 106 passing through the pipe 130, the soil-separating tank (N) 112 and the pipe 132. Further, the condensate is returned to the cleaning tank (E) 106 from the spray pump (Y) 111 passing through the pipes (Y) 126 and 127 and the spray nozzles (Y) 124 and 125. From the cleaning tank (E) 106, the condensate is overflowed to enter the heating tank (F) 107 as indicated by the arrow 135, and heated with the heater 121. A part or the whole thereof is vaporized and condensed with the cooling pipe 122 as indicated by the arrow 123, and then the condensate is returned to the water separation tank (H) 109 through the pipe 128.

The vapor-cleaning carried out in the vapor zone (G) 108 filled with the vapor generated in the heating tank (F) 107 is effective as a finish cleaning carried out in the last of the cleaning step, because completely no soil is contained in the liquid produced on the surface of the material to be cleaned through condensation of the vapor.

The mechanisms (J) 120 and 134 for circulating the cleaning agent between the cleaning tank (E) 106 and the heating tank (F) 107 serve to transfer the cleaning agent from the heating tank (F) 107 to the cleaning tank (E) 106 through the pipe (J) 134 with the aid of the circulation pump (J) 120, and return the cleaning agent from the cleaning tank (E) 106 to the heating tank (F) 107, provided that the cleaning agent overflows as indicated by the arrow 135. As a result, the compositions of the cleaning agent in the cleaning tank (E) 106 and the heating tank (F) 107 can be made always equal, and the composition fluctuation of the cleaning agent in the cleaning tank (E) 106 can be controlled, so that a stable cleaning property can be attained. According to the cleaning apparatus in accordance with the present invention, the spray rinsing is carried out with the pre-rinsing agent containing the component (b) before rinsing, thereby diminishing the soil remaining on the surface of the material to be cleaned, which soil had been dissolved in the cleaning agent, and moreover, the soil conveyed to the cleaning agent can be separated and removed in a continuous manner, thereby far improving the cleaning agent life.

Figure 8:
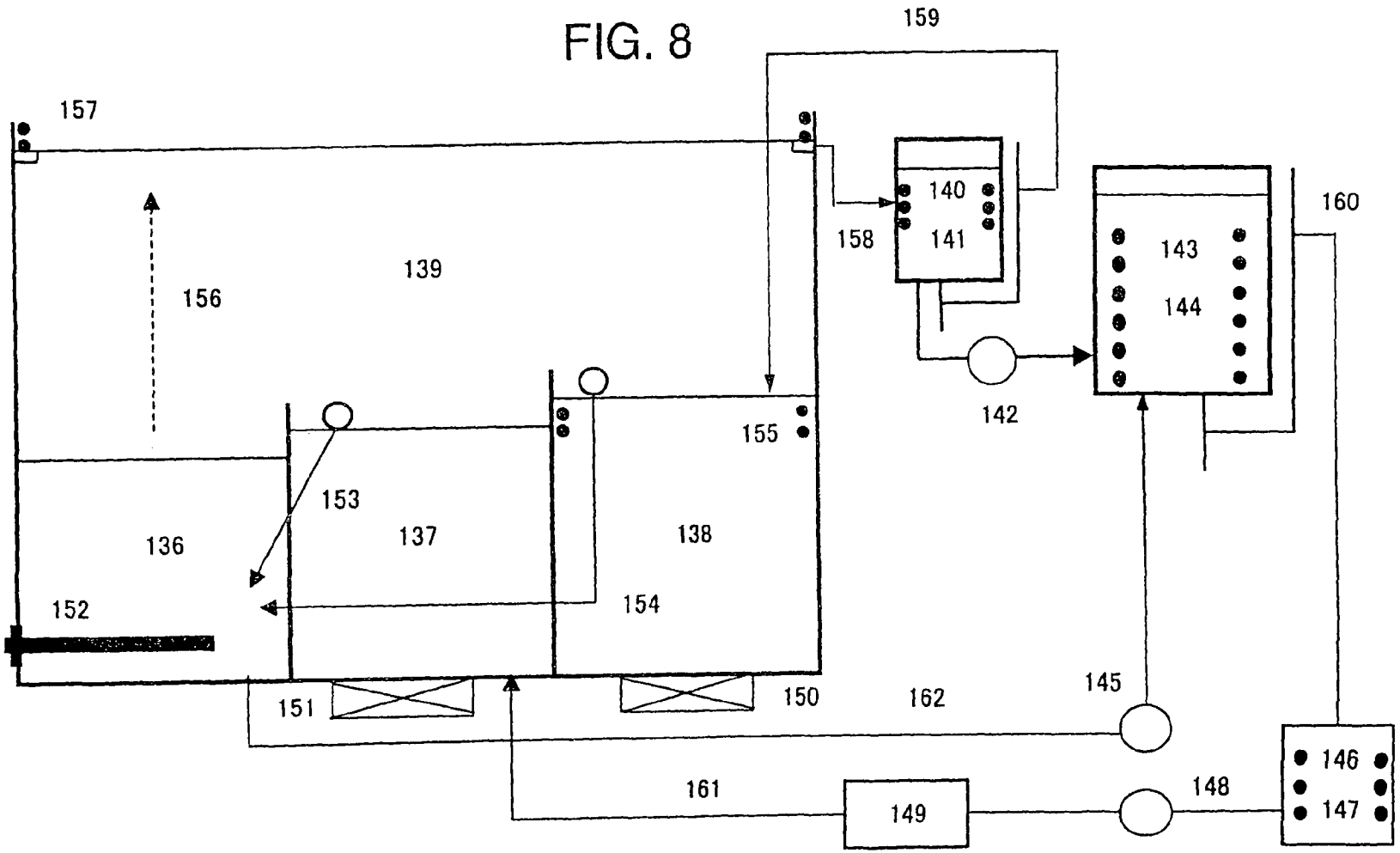
FIG. 8 shows an embodiment of the cleaning apparatus according to the 45th aspect of the present invention.

The cleaning apparatus shown in FIG. 8, which is an example of the cleaning apparatus according to the 45th aspect of the present invention, comprises as a main structure, a cleaning tank (Z) 136 having a heating mechanism for heating at least one component constituting the cleaning agent or/and generating vapor thereof, a vapor zone (AA) 139, in which vapor-cleaning is carried out with the vapor generated in the cleaning tank, a water separation tank (AB) 140, in which water is removed from the condensate obtained by condensing the vapor generated, a rinsing tank (AC) 138, in which dip-rinsing is carried out with the condensate, from which water has been removed in the water separation tank (AB), a soil-separating tank (AD) 143, in which the soil-containing cleaning agent and the condensate are contacted with each other, thereby separating the soil dissolved in the cleaning agent, a mechanism (AE) 145 for continuously transferring the cleaning agent in the cleaning tank (Z) to the soil-separating tank, a mechanism (AF) 142 for continuously transferring the condensate freed from water in the water separation tank (AB) to the soil-separating tank, mechanisms (AG) 146, 148 and 149 for separating the soil in the liquid treated in the soil-separating tank with the separation filter, and a pre-rinsing tank (AH) 137, in which dip-rinsing is carried out with the liquid passing through the separation filter. In a practical cleaning, a material to be cleaned, which is placed in a jig or cage for exclusive use, is transferred through the cleaning apparatus in order of the cleaning tank (Z) 136, the pre-rinsing tank (AH) 137, the rinsing tank (AC) 138 and the vapor zone (AA) 139, thereby completing the cleaning.

In the cleaning tank (Z) 136, the soil attached to the material to be cleaned is cleaned and removed while heating the cleaning agent in accordance with the present invention with the heater 152. At this time, any physical power such as vibration and submerged jet of the cleaning agent, previously used for a conventional cleaning machine, may be applied.

In the pre-rinsing tank (AH) 137, the liquid, which is treated in the soil-separating tank (AD) 143 and transferred through the soil-separating filter (AG) 149, is used as the pre-rinsing agent, and the cleaning agent and soil attached to the material to be cleaned are cleaned and removed. At this time, any physical power such as vibration, application of supersonic wave and submerged jet of the cleaning agent, previously used for a conventional cleaning machine, may be applied.

In the rinsing tank (T) 83, the pre-rinsing agent and soil attached to the material to be cleaned are cleaned and removed with the component (a), the rinsing agent in accordance with the present invention and their condensates. At this time, any physical power such as vibration, application of supersonic wave and submerged jet of the cleaning agent, previously used for a conventional cleaning machine, may be applied.

The vapor-cleaning carried out in the vapor zone (AA) 139 filled with the vapor generated in the cleaning tank (Z) 136 is effective as a finish cleaning carried out in the last stage of the cleaning step, because completely no soil is contained in the liquid produced on the surface of the material to be cleaned through condensation of the vapor.

In the soil-separating tank (AD) 143, the condensate of the water separation tank (AB) 140, which is introduced with the aid of the condensate-transferring pump 142, and the cleaning agent of the cleaning tank (Z) 136 transferred with the aid of the cleaning agent-transferring pump (AE) 145 through the pipe 162 are contacted with each other, and at the same time, the liquid temperature is lowered with the cooling pipe 144, thereby separating and removing the soil dissolved in the cleaning agent, thereafter the cleaning agent freed from the soil and the condensate are returned to the cleaning tank (Z) 136, and as a result, the soil conveyed to the cleaning agent can be removed in a continuous manner. The liquid treated in the soil-separating tank (AD) 143 is collected in the tank (AG) 146 for the soil-separating tank treatment liquid, after lowering the liquid temperature with the cooling pipe 147, further transferred through the separation filter (AG) 149 with the aid of the pump (AG) 148, thereby separating the soil finely dispersed in the liquid, and introduced into the pre-rinsing tank (AH) 137 to be used as the component of the pre-rinsing agent, and then overflowed as indicated by the arrow 153 to return to the cleaning tank (Z) 136.

The condensate is gathered in the water separation tank (AB) 140 to lower the liquid temperature with the cooling pipe 141, and thereafter introduced to the rinsing tank (AC) 138 through the pipe 159, wherein after cooling the liquid temperature with the cooling pipe 155, the condensate is used as the rinsing liquid. Thereafter, the condensate is returned to the cleaning tank (Z) 136 as indicated by the arrow 154. On the other hand, the condensate is transferred through the soil-separating tank (AD) 143, the pipe 160 and the tank (AG) for the soil-separating tank treatment liquid from the condensate-transferring pump 142, and then separated. One of the liquid is transferred through the pump (AG) 148 for the soil-separating tank treatment liquid, the separation filter (AG) 149 and the pipe 161 to enter the pre-rinsing tank (AH) 137, in which the liquid is used as the component of the pre-rinsing agent, and thereafter overflowed as indicated by the arrow 153 to return to the cleaning tank (Z) 136. The condensate returned to the cleaning tank (Z) 136 is heated with the heater 152, and a part or the whole thereof is vaporized and condensed with the cooling pipe 157 as indicated by the arrow 156, and then the condensate is returned to the water separation tank (AB) 140 through the pipe 158.

According to the cleaning apparatus in accordance with the present invention, dip rinsing is carried out with the pre-rinsing agent containing the component (b) before rinsing, thereby diminishing the soil remaining on the surface of the material to be cleaned, which soil had been dissolved in the cleaning agent, and moreover, the soil conveyed to the cleaning agent can be separated and removed in a continuous manner, thereby far improving the cleaning agent life.

The present invention is explained in detail with reference to the following Examples. Various physical properties of the cleaning agent were measured and evaluated as follows.

EXAMPLES 1 TO AND COMPARATIVE EXAMPLES 1 TO 12

(1) Measurement of Flash Point

The measurement of flash point was carried out by the Cleveland open-cup method, according to JIS K2265. The evaluation was carried out based on the following criteria.

○: No flash point method

X: A flash point method

EXAMPLES 1 TO 8

Each component in the proportion described in Table 1 was mixed to obtain the desired rinsing agent. With respect to each rinsing agent, its flash point was measured and the results were summarized in Table 1. It was confirmed that the flash point disappeared when (a1) the chlorine-free fluorine-containing compound having a vapor pressure of not less than $1.33\times10^3$ Pa at 20° C. and (b) the component having a vapor pressure of less than $1.33\times10^3$ Pa at 20° C. were used in combination.

EXAMPLES 9 TO 22

Each component in the proportion described in Table 1 was mixed to obtain the desired rinsing agent. With respect to each rinsing agent, its flash point was measured and the results were summarized in Table 1. It was confirmed that the flash point disappeared when (a1) the chlorine-free fluorine-containing compound having a vapor pressure of not less than $1.33\times10^3$ Pa at 20° C. and (b) the component having a vapor pressure of less than $1.33\times10^3$ Pa at 20° C. were used in combination. It was further confirmed that the flash point entirely disappeared when (a1) the chlorine-free fluorine-containing compound, (a2) at least one compound selected from the group consisting of alcohols, ketones, esters and hydrocarbons, and (b) the component having a vapor pressure of less than $1.33\times10^3$ Pa at 20° C. were used in combination, provided that the complete disappearance of the flash point could not be confirmed when only the component (a1) and the component (a2) were used in combination, but the complete disappearance of the flash point could be confirmed when the component (b) was additionally added thereto.

COMPARATIVE EXAMPLES 1 TO 12

With respect to the compounds described in Table 2, the flash point measurement was carried out in the same manner as in Example, and the results were summarized in Table 2. It was confirmed that all compounds measured exhibited flash points.

EXAMPLES 23 TO 39 AND COMPARATIVE EXAMPLES 13 TO 15

(2) Oil Dissolution Test

A 30 mesh stainless steel wire net (10 mm×20 mm) is impregnated with the following metal processing oil, and heated at 100° C. for 30 minutes to obtain a sample. The sample is subjected to vibration-cleaning (200 times/min) with 10 ml of a cleaning agent of 60° C., rinsed with a mixture of methyl perfluorobutyl ether and methyl perfluoroisobutyl ether (commercial name: HFE7100, manufactured by Sumitomo 3M Limited), and then dried. Thereafter, the dissolution property is visually evaluated. The evaluation is based on the following criteria.

○: No residue of the processing oil is observed

Δ: Slight residue of the processing oil is observed

X: Residue of the processing oil is observed

Metal processing oil used in the test: AM 30 (commercial name: UNICUTTERAMI, NISSEKI-MITSUBISHI)

(3) Rosin Dissolution Test

Flux is heated to dryness, to evaporate solvent components such as isopropanol, and thereafter a pellet(s) of about 0.2 g is prepared. The pellet is subjected to vibration-cleaning (200 times/min) with 10 ml of a cleaning agent of 60° C., rinsed with a mixture of methyl perfluorobutyl ether and methyl perfluoroisobutyl ether (commercial name: HFE7100, manufactured by Sumitomo 3M Limited), and thereafter dried by air-blowing. Before and after the test, the pellet is weighed, and the dissolution property is found by the following equation.

$$\text{Rosin dissolution (\%)}=\{(\text{weight before test}-\text{weight after test})/\text{weight before test}\}\times 100$$

The evaluation is based on the following criteria.

◎: Not less than 40%

○: From 30% (inclusive) to 40% (exclusive)

Δ: From 10% (inclusive) to 30% (exclusive)

X: Less than 10%

Commercial name of the flux used in the test: CFR-225, manufactured by TAMUPA SEISAKUSHO.

(4) Test of Flux Cleaning Property

The flux cleaning property of the rinsing agent against polymer rosin, rosin metal salt and other soils causing white residues was measured in the following manner.

One side surface of a glass epoxy-made printed plate (35 mm×48 mm) is dipped in flux, air-dried, and thereafter subjected to soldering at 250° C., thereby obtaining a specimen. The specimen is subjected to vibration-cleaning (200 times/min) with 50 ml of a cleaning agent of 60° C., rinsed with a mixture of methyl perfluorobutyl ether and methyl perfluoroisobutyl ether (commercial name: HFE7100, manufactured by Sumitomo 3M Limited), and thereafter subjected to vapor-cleaning with HEF 7100 and then dried. The flux cleaning property is determined by visually evaluating appearance of the plate surface. The evaluation is based on the following criteria.

◎: No white residue is observed

○: Slight white residue is observed

X: White residue is observed

Commercial name of the flux used in the test: CFR-225, manufactured by TAMURA SEISAKUSHO.

EXAMPLES 23 TO 39

Each component in the proportion described in Table 3 was mixed to obtain the desired cleaning agent. With respect to each cleaning agent, the cleaning test was carried out and the results were summarized in Table 3. When (a1) the chlorine-free fluorine-containing compound having a vapor pressure of not less than $1.33\times10^3$ Pa at 20° C. and (b) the component having a vapor pressure of less than $1.33\times10^3$ Pa at 20° C. were used in combination, there could be obtained a cleaning agent superior in dissolution property against oil, rosin and flux. It was further confirmed that a higher cleaning effect could be obtained in a combination use of the component (b1) and the component (b2) and in a combination use of at least two components (b) selected from the group consisting of glycol ethers, glycol ether acetates and hydroxycarboxylic acid esters.

It was still further confirmed that the amount of the component (b) could be decreased without detriment to the superior cleaning property when the component (a2), at least one compound selected form the group consisting of alcohols, ketones, esters and hydrocarbons, was added thereto.

COMPARATIVE EXAMPLES 13 TO 15

With respect to the solvents described in Table 3, the evaluation test was carried out in the same manner as in Example number, and the results were summarized in Table 3. 4H,5H,5H-Perfluorocyclopentane, 2H,3H-perfluoropentane, and a mixture of methyl perfluorobutyl ether and methyl perfluoroisobutyl ether have been found to be insufficient in dissolution property against oil, rosin and flux.

EXAMPLES 40 TO 54 AND COMPARATIVE EXAMPLES 16 AND 17

(5) Performance Confirmation Test of Rinsing Agent

Rinsing property to the glass epoxy-made printed plate having been subjected to flux cleaning with a cleaning agent was measured in the following manner.

One side surface of a glass epoxy-made printed plate (35 mm×48 mm) is dipped in flux, air-dried, and thereafter subjected to soldering at 250° C., thereby obtaining a specimen. Using a cleaning agent containing completely free of soil, flux, and a cleaning agent containing 3% by mass of the soil, the specimen is subjected to vibration-cleaning (200 times/min) for 2 minutes with 100 ml of each cleaning agent heated to 60° C., rinsed with the rinsing agent and then dried. The flux cleaning property is determined by visually evaluating appearance of the plate surface. The evaluation is based on the following criteria.

◎: No white residue is observed

○: Slight white residue is observed

X: White residue is observed

Cleaning agent used in the test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol dimethyl ether=50/30/20 (% by mass)

Flux used in the test: CFR-225, manufactured by TAMURA SEISAKUSHO.

EXAMPLES 40 TO 54

Each component in the proportion described in Table 4 was mixed to obtain the desired rinsing agent. With respect to each rinsing agent, the rinsing property confirmation test was carried out and the results were summarized in Table 4. When (a1) the chlorine-free flubrine-containing compound and (b) the component having a vapor pressure of less than $1.33\times10^3$ Pa at 20° C. were used in combination, there could be obtained a rinsing agent superior in rinsing property. It was further confirmed that a high rinsing effect to the cleaning agent containing 3% by mass of the soil could be obtained when the component (a2), at least one compound selected form the group consisting of alcohols, ketones, esters and hydrocarbons, was added thereto.

COMPARATIVE EXAMPLES 16 AND 17

With respect to the solvents described in Table 4, the evaluation test was carried out in the same manner as in Example, and the results were summarized in Table 4. 2H,3H-Perfluoropentane and a mixture of methyl perflucrobutyl ether and methyl perfluoroisobutyl ether have been found to be insufficient in rinsing property against the cleaning agent containing 3% by mass of the soil.

EXAMPLES 55 TO 67 AND COMPARATIVE EXAMPLES 18 TO 20

(6) Oxidation Stability Test 0.2 Liter of a cleaning agent sample is put into a 0.5 l-volume hard glass-made Erlenmeyer flask equipped with a reflux condenser and an oxygen introducing tube. A piece of mild steel (JIS-G-3141SPCC-B, 2 mm×6 mm×20 mm), well polished, thoroughly cleaned and thereafter dried, is dipped in the sample liquid, and another mild steel (JIS-G-3141SPCC-B, 2 mm×6 mm×2 mm) is bound to the oxygen introducing tube so as to be hung in a vapor phase above the sample liquid surface. The tip of the oxygen introducing tube is adjusted to be located at 6 mm or less from the bottom of the flask below the sample liquid surface. The whole of the flask is heated with a 150 W frosted electric bulb while introducing a water-saturated oxygen bubble of ambient temperature at a rate of 10 to 12 bubbles per minute. The flow rate of cooling water is adjusted so as to condense vapor of the sample liquid at a height of a half of the reflux condenser. The test is continued for 10 days. Thereafter, the sample liquid is cooled to ambient temperature, two pieces of the mild steel are taken out, and pH of the sample liquid is measured in the following manner.

pH: To 5 ml of the sample liquid, 50 ml of distilled water is added, the mixture is vigorously shaken for 3 minutes, and thereafter, pH of the aqueous layer is measured. The evaluation is based on the following criteria.

○: pH 5 (inclusive) to 8 (inclusive)

X: pH 1 (inclusive) to 5 (exclusive)

EXAMPLES 55 TO 67

Each component in the proportion described in Table 5 was mixed to obtain the desired cleaning agent and rinsing agent. With respect to each cleaning agent, the oxidation stability test was carried out and the results were summarized in Table 5. When (a1) the chlorine-free fluorine-containing compound having a vapor pressure of not less than $1.33\times10^3$ Pa at 20° C., (b) the component having a vapor pressure of less than $1.33\times10^3$ Pa at 20° C., (c) an antioxidant and (d) a ultraviolet absorber were used in combination, there could be obtained a cleaning agent and rinsing agent having no flash point diminished in its oxidation decomposition. It was further confirmed that the amount of the antioxidant (c) could be decreased by a combination use of the phenol antioxidant and the phosphorus antioxidant and a combination use of the phenol antioxidant and the ultraviolet absorber.

COMPARATIVE EXAMPLES 18 TO 20

Each component in the proportion described in Table 5 was mixed to obtain the cleaning agent and rinsing agent. With respect to each cleaning agent and rinsing agent, the oxidation stability test was carried out in the same manner as in Example and the results were summarized in Table 5. Oxidation decomposition occurred only by use of the chlorine-free fluorine-containing compound (a1) and the glycol ether (b).

EXAMPLES 68 TO 79 AND COMPARATIVE EXAMPLES 21 AND 22

(7) Cleaning Test in Actual Use 1

The cleaning agent was introduced in both of the cleaning tank (A) 1 and the water separation tank (C) 3 in the cleaning apparatus shown in FIG. 1, and the cleaning agent in the cleaning tank (A) 1 was heat-boiled with use of the heater 7. A blank test was continued for 1 hour to decrease the concentration of the component having a low vapor pressure contained in the cleaning agent of the water separation tank (C) 3. Thereafter, cleaning properties against polymer rosin, rosin metal salts, other soils causing the white residue, and processing oil were measured in the following operations under the following cleaning conditions.

Operations

Evaluation of Flux Cleaning

One side surface of a glass epoxy-made printed plate (35 mm×48 mm) is dipped in flux, air-dried, and thereafter subjected to soldering at 250° C., thereby obtaining a specimen. The specimen is cleaned using the above-described cleaning apparatus, spray-rinsed with (f) a condensate of the cleaning agent having no flash point, thereafter subjected to vapor-cleaning, and then dried. With respect to the cleaning property, the ionic residue (unit: μg NaCl/sqin) is measured with an omega meter (600R-SC, ALPHAMETALS), and a measurement value is taken as "β". Evaluation is based on the following criteria.

◎: $\beta\leqq7$

○: $7<\beta\leqq14$

X: $\beta>14$

Commercial name of the flux used for the test: JS-64ND (manufactured by KOKI)

Evaluation of De-Grease Cleaning Property

A 30 mesh stainless steel wire net (10 mm×20 mm) is impregnated with the following metal processing oil, and heated at 100° C. for 30 minutes to obtain a sample. The sample is cleaned using the above-described cleaning apparatus, spray-rinsed with (f) a condensate of the cleaning agent having no flash point, thereafter subjected to vapor-cleaning, and then dried. The cleaning property is visually evaluated. Evaluation is based on the following criteria.

○: No processing oil remains

Δ: Processing oil partially remains

X: Processing oil remains

Metal processing oil used for the test: A liquid containing 0.1% by weight of a dye (Sudan) and 25% by weight of UNICUT GH35 (commercial name, manufactured by Nippon Oil Company, Ltd.) in perchloroethylene was prepared to obtain the metal processing oil for test use.

Cleaning Conditions

Cleaning tank (A) 1: boil cleaning for 2 minutes

Vapor zone (B) 2: spray rinsing (5 l/min) for 2 minutes, thereafter standing for 2 minutes.

EXAMPLES 68 TO 73

Each component in the proportion described in Table 6 was mixed to obtain the desired cleaning agent. Using the cleaning agent, the above-described evaluation test was carried out and the results were summarized in Table 6. Cleaning was carried out using (e) and (f), (e) being the cleaning agent having no flash point containing (a1) the chlorine-free fluorine-containing compound and (b) the glycol ether and (f) being the vapor generated by boiling the cleaning agent having no flash point and its condensate. As a result, superior cleaning properties against flux and oil could be confirmed. Further, it was found that the vapor generated by boiling the cleaning agent and its condensate contained almost no component (b), and a satisfactory rinsing property could be obtained by spray-rinsing with the condensate.

Furthermore, the ionic residue was reduced by a combination use of the component (a2) of the alcohols.

COMPARATIVE EXAMPLE 21

With respect to the cleaning agent described in Table 6, the evaluation test was carried out in the same manner as in Examples 68 to 73 and the results were summarized in Table 6. When only a mixture of the component (a1), methyl perfluorobutyl ether and methyl perfluoroisobutyl ether was used, respective cleaning properties against flux and oil were found to be insufficient.

EXAMPLES 74 TO 79 AND COMPARATIVE EXAMPLE 22

(8) Cleaning Test in Actual Use 2

In the cleaning tank (E) 14, the heating tank (F) 15 and the water separation tank (H) 17 in the cleaning apparatus shown in FIG. 2, the cleaning agent was introduced, and the cleaning agent in the heating tank (F) 15 was heated to boiling point with use of the heater 20. A blank test was continued for 1 hour to decrease the concentration of the component having a low vapor pressure contained in the cleaning agent of the water separation tank (H) 17. Thereafter, cleaning properties against polymer rosin, rosin metal salts, other soils causing the white residue, and processing oil were measured in the following operations under the following cleaning conditions.

Operations

Evaluation of Flux Cleaning

One side surface of a glass epoxy-made printed plate (35 mm×48 mm) is dipped in flux, air-dried, and thereafter subjected to soldering at 250° C., thereby obtaining a specimen. The specimen is cleaned using the above-described cleaning apparatus, spray-rinsed with (c) a condensate of the cleaning agent having no flash point, thereafter subjected to vapor-cleaning, and then dried. With respect to the cleaning property, the ionic residue (unit: μg NaCl/sqin) is measured with an omega meter (600R-SC, ALPHAMETALS), and a measurement value is taken as "β". Evaluation is based on the following criteria.

◎: $\beta \leqq 7$

○: $7 < \beta \leqq 14$

X: $\beta > 14$

Commercial name of the flux used for the test: JS-64ND (manufactured by KOKI)

Evaluation of De-Grease Cleaning Property

A 30 mesh stainless steel wire net (10 mm×20 mm) is impregnated with the following metal processing oil, and heated at 100° C. for 30 minutes to obtain a sample. The sample is cleaned using the above-described cleaning apparatus, spray-rinsed with (f) a condensate of the cleaning agent having no flash point, thereafter subjected to vapor-cleaning, and then dried. The cleaning property is visually evaluated. Evaluation is based on the following criteria.

○: No processing oil remains

Δ: Processing oil partially remains

X: Processing oil remains

Metal processing oil used for the test: A liquid containing 0.1% by weight of a dye (Sudan) and 25% by weight of UNICUT GH35 (commercial name, manufactured by Nippon Oil Company, Ltd.) in perchloroethylene was prepared to obtain the metal processing oil for test use.

Cleaning Conditions

Cleaning tank (E) 14: boil cleaning for 2 minutes

Vapor zone (G) 16: spray rinsing (5 l/min) for 2 minutes, thereafter standing for 2 minutes.

EXAMPLES 74 TO 79

Each component in the proportion described in Table 6 was mixed to obtain the desired cleaning agent. Using the cleaning agent, the above-described evaluation test was carried out and the results were summarized in Table 6. Cleaning was carried out using (e) and (f), (e) being the cleaning agent having no flash point containing (a1) the chlorine-free fluorine-containing compound and (b) the glycol ether and (f) being the vapor generated by boiling the cleaning agent having no flash point and its condensate. As a result, superior cleaning properties against flux and oil could be confirmed. Further, it was found that the vapor generated by boiling the cleaning agent and its condensate contained almost no component (b), and a satisfactory rinsing property could be obtained by shower-rinsing with the condensate.

Furthermore, the ionic residue was reduced by a combination use of the component (a2) of the alcohols.

COMPARATIVE EXAMPLE 22

With respect to the cleaning agent described in Table 6, the evaluation test was carried out in the same manner as in Examples 74 to 79 and the results were summarized in Table 6. When only a mixture of the component (a1), methyl perfluorobutyl ether and methyl perfluoroisobutyl ether was used, respective cleaning properties against flux and oil were found to be insufficient.

EXAMPLES 80 TO 82 AND COMPARATIVE EXAMPLE 23

(9) Cleaning Test in Actual Use 3

Using the cleaning apparatus shown in FIG. 5, the cleaning agent was introduced in the cleaning tank (O) 71 and the rinsing agent was introduced both in the rinsing tank (R) 72 and in the water separation tank (Q) 74. The cleaning agent in the cleaning tank (O) 71 was heated to boiling with use of the heater 76, the material to be cleaned was transferred in order of the cleaning tank (O) 71, the rinsing tank (R) 72 and the vapor zone (P) 73, and thus cleaning properties against polymer rosin, rosin metal salts, other soils causing the white residue, and processing oil were measured in the following operations under the following cleaning conditions.

Operations

Evaluation of Flux Cleaning

One side surface of a glass epoxy-made printed plate (35 mm×48 mm) is dipped in flux, air-dried, and thereafter subjected to soldering at 250° C., thereby obtaining a specimen. The specimen is cleaned using the above-described cleaning apparatus, dip-rinsed with the rinsing agent, thereafter subjected to vapor-cleaning, and then dried. With respect to the cleaning property, the ionic residue (unit: μg NaCl/sqin) is measured with an omega meter (600R-SC, ALPHAMET-ALS), and a measurement value is taken as "β". Evaluation is based on the following criteria.

◎: β≦7

○: 7≦β≦14

X: β>14

Commercial name of the flux used for the test: CFR-225 (manufactured by TAMURA SEISAKUSHO)

Evaluation of De-Grease Cleaning Property

A 30 mesh stainless steel wire net (10 mm×20 mm) is impregnated with the following metal processing oil, and heated at 100° C. for 30 minutes to obtain a sample. The sample is cleaned using the above-described cleaning apparatus, dip-rinsed with the rinsing agent, thereafter subjected to vapor-cleaning, and then dried. The cleaning property is visually evaluated. Evaluation is based on the following criteria.

○: No processing oil remains

Δ: Processing oil partially remains

X: Processing oil remains

Metal processing oil used for the test: AM 30 (commercial name: UNICUTTERAMI, manufactured by NIPPON MITSUBISHI OIL CORPORATION)

Cleaning Conditions

Cleaning tank (O) 71: boil cleaning for 2 minutes

Rinsing tank (R) 72: dip cleaning with ultrasonic waves (28 kHz, 200 W) for 2 minutes Vapor zone (P) 73: standing for 2 minutes Rinsing agent: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol dimethyl ether=99/0.6/0.4 (% by mass)

EXAMPLES 80 TO 82

Each component in the proportion described in Table 7 was mixed to obtain the desired cleaning agent. Using the cleaning agent, the above-described evaluation test was carried out and the results were summarized in Table 7. Cleaning was carried out using (e) the cleaning agent having no flash point containing (a1) the chlorine-free fluorine-containing compound and (b) the glycol ether, and the rinsing or/and vapor-cleaning was (were) carried out using the rinsing agent, (f) the vapor generated by boiling the cleaning agent having no flash point and its condensate. As a result, superior cleaning properties against flux and oil could be confirmed. Further, it was found that the vapor generated by boiling the cleaning agent and its condensate contained almost no component (b), and a satisfactory rinsing property could be obtained by dip-rinsing with the condensate. Furthermore, the ionic residue was reduced by a combination use of the component (a2) of the alcohols.

COMPARATIVE EXAMPLE 23

With respect to the cleaning agent described in Table 7, the evaluation test was carried out in the same manner as in Examples 31 to 35 and the results were summarized in Table 7. When only a mixture of the component (a1), methyl perfluorobutyl ether and methyl perfluoroisobutyl ether was used, respective cleaning properties against flux and oil were found to be insufficient.

EXAMPLES 83 TO 88 AND COMPARATIVE EXAMPLE 24

(10) Cleaning Test in Actual Use 4

Using the cleaning apparatus shown in FIG. 6, the cleaning agent was introduced in the cleaning tank (S) 82 and the rinsing agent was introduced in the rinsing tank (T) 83, the distillation tank (U) 84 and the water separation tank (W) 86. The cleaning agent in the cleaning tank (S) 82 was heated to 60° C. with use of the heater 87, the rinsing agent in the distillation tank (U) 84 was heated to boiling with use of the heater 88, and thereafter cleaning properties against polymer rosin, rosin metal salts, other soil causing the white residue, and processing oil were measured in the following operations under the following cleaning conditions.

Operations

Evaluation of Flux Cleaning

One side surface of a glass epoxy-made printed plate (35 mm×48 mm) is dipped in flux, air-dried, and thereafter subjected to soldering at 250° C., thereby obtaining a specimen. The specimen is cleaned using the above-described cleaning apparatus, dip-rinsed with the rinsing agent, thereafter subjected to vapor-cleaning, and then dried. With respect to the cleaning property, the ionic residue (unit: μg NaCl/sqin) is measured with an omega meter (600R-SC, ALPHAMET-ALS), and a measurement value is taken as "β". Evaluation is based on the following criteria.

◎: β≦7

○: 7<β≦14

X: β>14

Commercial name of the flux used for the test: CFR-225 (manufactured by TAMUPA SEISAKUSHO)

Evaluation of De-Grease Cleaning Property

A 30 mesh stainless steel wire net (10 mm×20 mm) is impregnated with the following metal processing oil, and heated at 100° C. for 30 minutes to obtain a sample. The sample is cleaned using the above-described cleaning apparatus, dip-rinsed in the rinsing tank, thereafter subjected to vapor-cleaning, and then dried. The cleaning property is visually evaluated. Evaluation is based on the following criteria.

○: No processing oil remains

Δ: Processing oil partially remains

X: Processing oil remains

Metal processing oil used for the test: AM 30 (commercial name: UNICUTTERAMI, manufactured by NIPPON MITSUBISHI OIL CORPORATION)

Cleaning Conditions

Cleaning tank (S) 82: cleaning with ultrasonic waves (28 kHz, 200 W) for 2 minutes Rinsing tank (T) 83: dip rinsing for 2 minutes Vapor zone (V) 85: standing for 2 minutes Rinsing agent: a mixture of methyl perfluorobutyl ether and methyl perfluoroisobutyl ether (commercial name: HFE7100, manufactured by Sumitomo 3M Limited)

EXAMPLES 83 TO 88

Each component in the proportion described in Table 7 was mixed to obtain the desired cleaning agent. Using the cleaning agent, the above-described evaluation test was carried out and the results were summarized in Table 7. Cleaning was carried out using (e) the cleaning agent having no flash point containing (a1) the chlorine-free fluorine-containing compound and (b) the glycol ether, and the dip rinsing was carried out using the component (a1). As a result, superior cleaning properties against flux and oil could be confirmed. Further, the ionic residue was reduced by a combination use of the component (a2) of the alcohols.

COMPARATIVE EXAMPLE 24

With respect to the cleaning agent described in Table 7, the evaluation test was carried out in the same manner as in Examples 36 to 40 and the results were summarized in Table 7. When only a mixture of the component (a1), methyl perfluorobutyl ether and methyl perfluoroisobutyl ether was used, respective cleaning properties against flux and oil were found to be insufficient.

EXAMPLE 89 AND COMPARATIVE EXAMPLE 25

(11) Soil-Separating and Cleaning Tests in Actual Use 1

Figure 3:
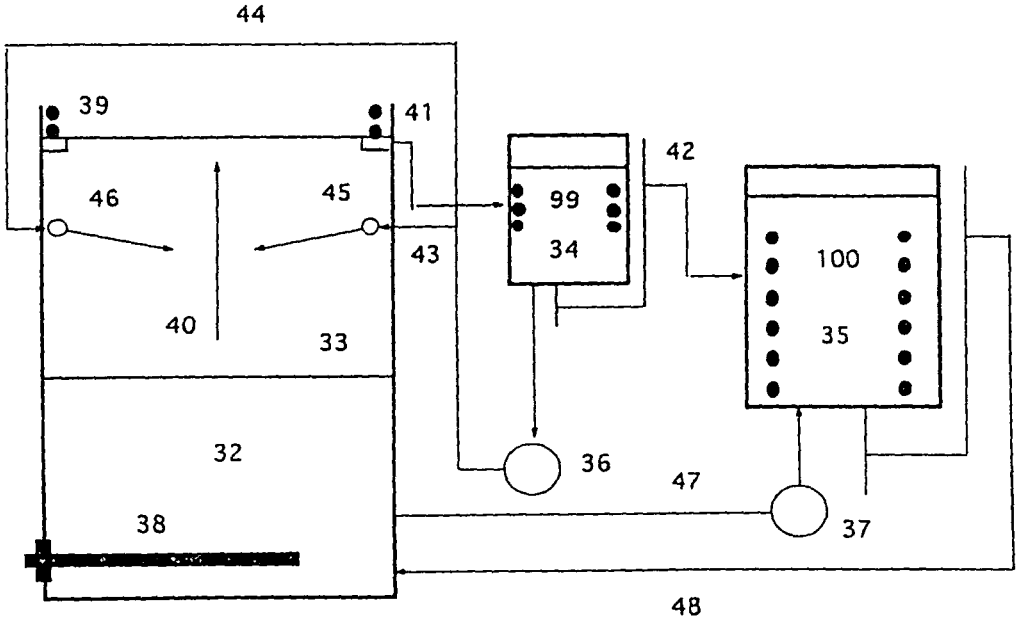
FIG. 3 shows an embodiment of the cleaning apparatus according to the 39th aspect of the present invention.

Using the cleaning apparatus shown in FIG. 3, the cleaning agent is introduced in the cleaning tank (A) 32 and the water separation tank (C) 34, and the cleaning agent in the cleaning tank (A) 32 is heated to boiling with use of the heater 38. A blank operation is carried out for 1 hour so as to decrease a concentration of the component having a low vapor pressure contained in the cleaning agent in the water separation tank (C) 34 and the soil-separating tank (K) 35, and then the cleaning agent in the cleaning tank (A) 32 is continuously transferred to the soil-separating tank (K) 35 with the aid of the cleaning agent transferring pump (L) 37, thereby separating the processing oil dissolved in the cleaning agent. A specific gravity of the processing oil separated is lighter than that of the liquid in the soil-separating tank, and therefore the separated and floated processing oil is continuously discharged from the soil-separating tank. As described, cleaning property against the processing oil and the change in the oil concentration in the cleaning agent are measured in the following operations under the following conditions.

Operations

250 Bearings as a cleaning sample are impregnated with a metal processing oil described below, and thereafter put in a cage for barrel cleaning use. After adding 2% by mass of the processing oil to the cleaning agent in the cleaning tank (A) 32 of the above-described cleaning apparatus, the sample is cleaned, spray-rinsed with the condensate of (f) the cleaning agent having no flash point, subjected to vapor-cleaning and then dried. The cleaning is continued for 40 hours at a tact time of 15 minutes, namely the cleaning is carried out 160 times, and after the 1st time cleaning and after 40 hour-operation, cleaning property of the bearing and an oil concentration in the cleaning agent are measured. In order to know the cleaning property, the processing oil remaining on the surface of the part cleaned is measured with an oil measurement apparatus (OIL-20, manufactured by CENTRAL KAGAKU CORP.). Evaluation is based on the following criteria.

◎: remaining oil less than 70 μg/bearing

○: remaining oil 70 μg/bearing (inclusive) to 100 μg/bearing (exclusive)

X: remaining oil not less than 100 μg/bearing

In order to know the oil concentration in the cleaning agent, 20 ml of the cleaning agent is dried with a vacuum drier (110° C., 0 Pa), and the concentration of a non-volatile matter is measured. Evaluation is based on the following criteria.

○: increased oil concentration of less than 2% by mass

X: increased oil concentration of not less than 2% by mass

Cleaning Conditions

Cleaning tank (A) 32: boil cleaning for 2 minutes

Vapor zone (B) 33: spray rinsing for 2 minutes (5 l/min), thereafter standing for 2 minutes Condensate of cleaning agent: 500 ml/min Feed of cleaning agent to soil-separating tank: 110 ml/min Liquid temperature of soil-separating tank: 3 to 6° C.

Soil-separating tank: operated in Example, not operated in Comparative Example

Cleaning agent used for test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol-dimethyl ether=50/30/20 (% by mass)

Metal processing oil used for test: FM220 (commercial name, YUSHIRON FORMER, manufactured by YUSHIRO CHEMICAL INDUSTRY CO., LTD.)

EXAMPLE 89

Results were summarized as follows.

Cleaning property 1st time: ○, after 40 hours (160 times): ○

Change in oil concentration after 40 hours (160 times): ○

The processing oil conveyed into the cleaning agent was continuously separated and removed in the soil-separating tank, and as a result, the oil concentration in the cleaning agent could be kept constant, and the cleaning property after 40 hours against the processing oil could be maintained to a high cleaning level equal to that in the 1st time cleaning test.

COMPARATIVE EXAMPLE 25

Results were summarized as follows.

Cleaning property 1st time: ○, after 40 hours (160 times): X

Change in oil concentration after 40 hours (160 times): X

Owing to the processing oil conveyed into the cleaning agent, the oil concentration in the cleaning agent was increased and the cleaning property against the processing oil after 40 hours was deteriorated.

EXAMPLES 90 AND 91 AND COMPARATIVE EXAMPLE 26

(12) Soil-Separating and Cleaning Tests in Actual Use 2

Using the cleaning apparatus shown in FIG. 4, the cleaning agent is introduced in the cleaning tank (E) 49, the heating tank (F) 50 and the water separation tank (H) 52, and the cleaning agent in the heating tank (F) 50 is boiled with use of the heater 58. While maintaining a constant composition by circulating the cleaning agent in the cleaning tank (E) 49 and the heating tank (F) 50 with the aid of the cleaning agent circulating pump (J) 56, a blank operation is carried out for 1 hour so as to decrease the concentration of the component having a low vapor pressure contained in the cleaning agent in the water separation tank (H) 52 and the soil-separating tank (M) 53, and then the cleaning agent in the cleaning tank (E) 49 is continuously transferred to the soil-separating tank (M) 53 with the aid of the cleaning agent transferring pump (N) 55, thereby separating the processing oil dissolved in the cleaning agent. The specific gravity of the processing oil separated is lighter than that of the liquid in the soil-separating tank, and therefore the separated and floated processing oil is continuously discharged from the soil-separating tank. Further, in order to find out the separation effect by a separation filter, a separation apparatus housing a storage tank of a returning liquid, a transferring pump of a returning liquid and a separation filter is mounted to the returning liquid pipe 70 connecting the soil-separating tank (M) 53 with the cleaning tank (E) 49, thereby separating the processing oil finely dispersed in the returning liquid. Cleaning property against the processing oil and a change in the oil concentration in the cleaning agent are measured in the following operations under the following conditions.

Operations

250 Bearings as a cleaning sample are impregnated with a metal processing oil described below, and thereafter put in a cage for barrel cleaning use. After adding 2% by mass of the processing oil to the cleaning agent in the cleaning tank (E) 49 and the heating tank (F) 52 of the above-described cleaning apparatus, the sample is cleaned, spray-rinsed with the condensate of (f) the cleaning agent having no flash point, subjected to vapor-cleaning and then dried. The cleaning is continued for 40 hours at a tact time of 15 minutes, namely the cleaning is carried out 160 times, and after the 1st time cleaning and after 40 hour-operation, cleaning property of the bearing and an oil concentration in the cleaning agent are measured. In order to know the cleaning property, the processing oil remaining on the surface of the part cleaned is measured with an oil measurement apparatus (OIL-20, manufactured by CENTRL KAGAKU CORP.). Evaluation is based on the following criteria.

◎: remaining oil less than 70 μg/bearing

○: remaining oil 70 μg/bearing (inclusive) to 100 μg/bearing (exclusive)

X: remaining oil not less than 100 μg/bearing

In order to know the oil concentration in the cleaning agent, 20 ml of the cleaning agent is dried with a vacuum drier (110° C., 0 Pa), and the concentration of a non-volatile matter is measured. Evaluation is based on the following criteria.

○: increased oil concentration less than 2% by mass

X: increased oil concentration not less than 2% by mass

Cleaning Conditions

Cleaning tank (E) 49: boil cleaning for 2 minutes

Vapor zone (G) 51: spray rinsing for 2 minutes (5 l/min), thereafter standing for 2 minutes Condensate of cleaning agent: 500 ml/min Feed of cleaning agent to soil-separating tank: 110 ml/min Liquid temperature of soil-separating tank: 3 to 6° C.

Soil-separating tank: operated in Example, not operated in Comparative Example

Separation filter: EUS04AV (commercial name: EU-TEC, manufactured by Asahi Chemical Industry Co., Ltd.)

Cleaning agent used for test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol-dimethyl ether=50/30/20 (% by mass)

Metal processing oil used for test: FM220 (commercial name, YUSHIRON FORMER, manufactured by YUSHIRO CHEMICAL INDUSTRY CO., LTD.)

EXAMPLE 90

Results were summarized as follows.

Cleaning property 1st time: ○, after 40 hours (160 times): ○

Change in oil concentration after 40 hours (160 times): ○

The processing oil conveyed into the cleaning agent was continuously separated and removed in the soil-separating tank, and as a result, the oil concentration in the cleaning agent could be kept constant, and the cleaning property after 40 hours against the processing oil could be maintained to a high cleaning level equal to that in the 1st time cleaning test.

EXAMPLE 91

Results were summarized as follows.

Cleaning property 1st time: ○, after 40 hours (160 times): ○

Change in oil concentration after 40 hours (160 times): ◎

The processing oil conveyed into the cleaning agent was continuously separated and removed in the soil-separating tank, and at the same time, the processing oil finely dispersed in the returning liquid was separated by means of the separation filter. Thereby, the oil concentration in the cleaning agent could be controlled to a lower level, and the cleaning property after 40 hours against the processing oil could be maintained to a high cleaning level equal to that in the 1st time cleaning test.

COMPARATIVE EXAMPLE 26

Results were summarized as follows.

Cleaning property 1st time: ○, after 40 hours (160 times): X

Change in oil concentration after 40 hours (160 times): X

Owing to the processing oil conveyed into the cleaning agent, the oil concentration in the cleaning agent was increased and the cleaning property against the processing oil after 40 hours was deteriorated.

EXAMPLES 92 AND 93

(13) Soil-Separating and Cleaning Tests in Actual Use 3

Figure 7:
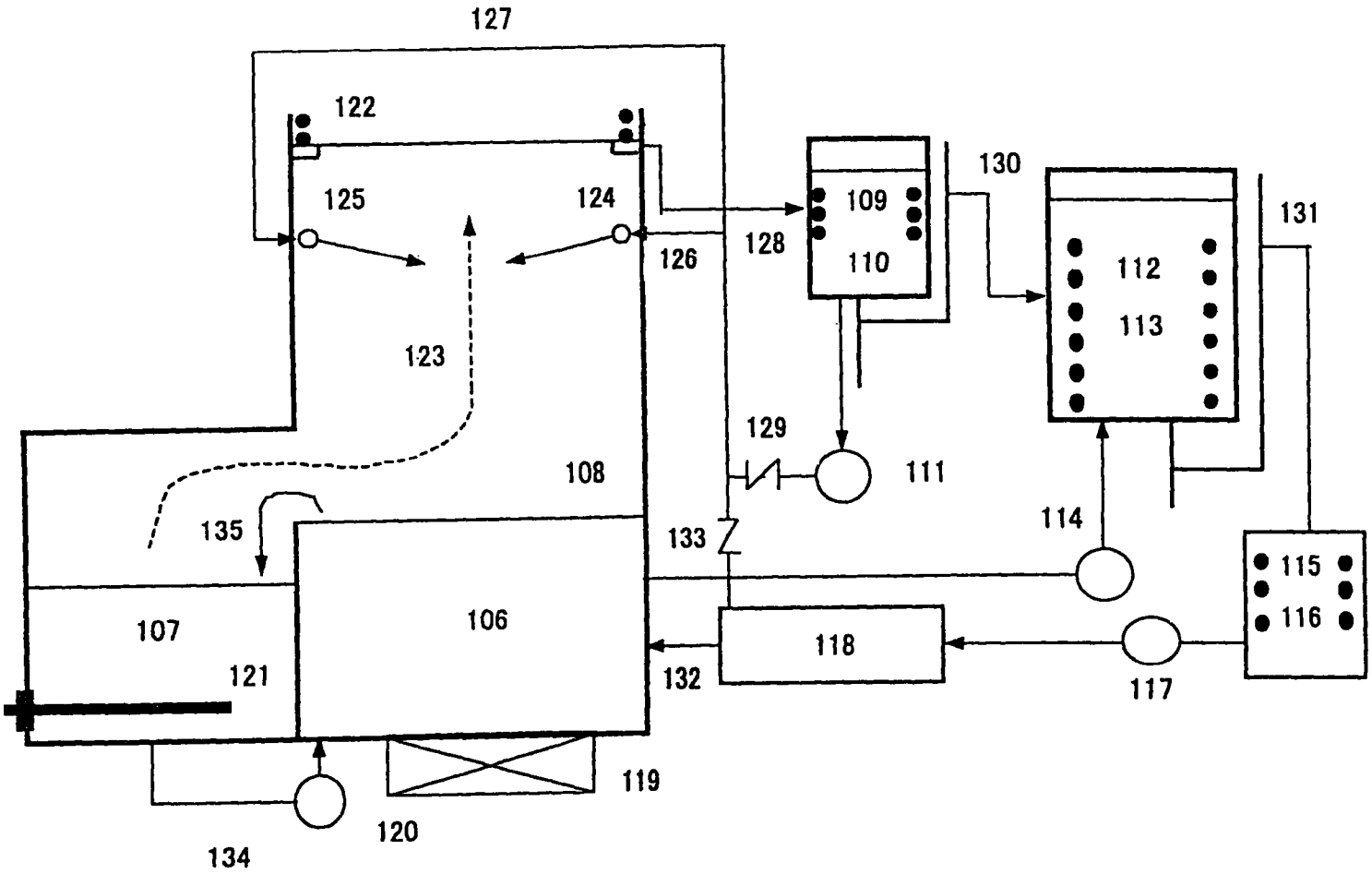
FIG. 7 shows an embodiment of the cleaning apparatus according to the 44th aspect of the present invention.

Using the cleaning apparatus shown in FIG. 7, the cleaning agent is introduced in the cleaning tank (E) 106 and the heating tank (F) 107, and the rinsing agent is introduced in the water separation tank (H) 109, the soil-separating tank (M) 112, the tank for the liquid treated in the soil-separating tank (X) 115 and the separation filter unit (X) 118. The cleaning agent in the heating tank (F) 107 is boiled with use of the heater 121. While maintaining a constant composition by circulating the cleaning agent in the cleaning tank (E) 106 and the heating tank (F) 107 with the aid of the cleaning agent circulating pump (J) 120, a blank operation is carried out for 1 hour, and then the cleaning agent in the cleaning tank (E) 106 is continuously transferred to the soil-separating tank (M) 112 with the aid of the cleaning agent transferring pump (N) 114, thereby separating and cleaning the processing oil dissolved in the cleaning agent. Cleaning property against the processing oil and the change in the oil concentration in the cleaning agent are measured in the following operations under the following conditions.

Operations

250 Bearings as a cleaning sample are impregnated with a metal processing oil described below, and thereafter put in a cage for barrel cleaning use. After adding 2% by mass (Example 92) or 4% by mass (Example 93) of the processing oil to the cleaning agent in the cleaning tank (E) 106 and the heating tank (F) 107 of the above-described cleaning apparatus, the sample is cleaned, spray-rinsed with the liquid transferred through the separation filter (X) 118 and further with the condensate of (f) the cleaning agent having no flash point, lastly subjected to vapor-cleaning and then dried. The cleaning is conducted at a tact time of 15 minutes to measure the cleaning property of the bearing. In order to know the cleaning property, the processing oil remaining on the surface of the part cleaned is measured with an oil measurement apparatus (OIL-20, manufactured by CENTPAL SCIENCE). Evaluation is based on the following criteria.

◎: remaining oil less than 70 μg/bearing

○: remaining oil 70 μg/bearing (inclusive) to 100 μg/bearing (exclusive)

X: remaining oil not less than 100 μg/bearing

Cleaning Conditions

Cleaning tank (E) 106: boil cleaning for 2 minutes

Vapor zone (G) 108: pre-spray rinsing for 2 minutes (5 l/min), thereafter spray rinsing for 2 minutes (5 l/min), and then standing for 2 minutes Condensate of cleaning agent: 500 ml/min Feed of cleaning agent to soil-separating tank: 110 ml/min Liquid temperature of soil-separating tank: 3 to 6° C.

Liquid temperature of tank for liquid treated in soil-separating tank: 3 to 6° C.

Separation filter: EUS04AV (commercial name: EU-TEC, manufactured by Asahi Chemical Industry Co., Ltd.)

Cleaning agent used for test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol-dimethyl ether=50/30/20 (% by mass)

Rinsing agent used for test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol-dimethyl ether=99/0.6/0.4 (% by mass)

Metal processing oil used for test: FM220 (commercial name, YUSHIRON FORMER, manufactured by YUSHIRO CHEMICAL INDUSTRY CO., LTD.)

EXAMPLE 92

The result was summarized as follows.

Cleaning property: ○

After cleaning with the cleaning agent containing 2% by mass of the processing oil, spray-prerinsing was conducted, and as a result, superior cleaning property could be confirmed.

EXAMPLE 93

The result was summarized as follows.

Cleaning property: ○

After cleaning with the cleaning agent containing 4% by mass of the processing oil, spray-prerinsing was conducted, and as a result, sufficient cleaning property could be obtained.

EXAMPLES 94 AND 95

(14) Soil-Separating and Cleaning Tests in Actual Use 4

Using the cleaning apparatus shown in FIG. 8, the cleaning agent is introduced in the cleaning tank (Z) 136, and the rinsing agent is introduced in the pre-rinsing tank (AH) 137, the rinsing tank (AC) 138, the water separation tank (AB) 140, the soil-separating tank (AD) 143, the tank for the liquid treated in the soil-separating tank (AG) 146 and the separation filter unit (AG) 149. The cleaning agent in the cleaning tank (Z) 136 is boiled with use of the heater 152, and a blank operation is carried out for 1 hour. The cleaning agent in the cleaning tank (Z) 136 is continuously transferred to the soil-separating tank (AD) 143 with the aid of the cleaning agent transferring pump (AF) 145, and at the same time the pump for transferring the liquid treated in the soil-separating tank (AG) 148 is operated, thereby separating and cleaning the processing oil dissolved in the cleaning agent. Cleaning property against the processing oil and the change in the oil concentration in the cleaning agent are measured in the following operations under the following conditions.

Operations

250 Bearings as a cleaning sample are impregnated with a metal processing oil described below, and thereafter put in a cage for barrel cleaning use. After adding 2% by mass (Example 94) or 4% by mass (Example 95) of the processing oil to the cleaning agent in the cleaning tank (Z) 136 of the above-described cleaning apparatus, the sample is cleaned, dip-pre-rinsed with the liquid transferred through the separation filter (AG) 149 and further dip-rinsed with the condensate of (f) the cleaning agent having no flash point, lastly subjected to vapor-cleaning and then dried. The cleaning is conducted at a tact time of 15 minutes to measure the cleaning property of the bearing. In order to know the cleaning property, the processing oil remaining on the surface of the part cleaned is measured with an oil measurement apparatus (OIL-20, manufactured by CENTRAL KAGAKU CORP.). Evaluation is based on the following criteria.

◎: remaining oil less than 70 μg/bearing

○: remaining oil 70 μg/bearing (inclusive) to 100 μg/bearing (exclusive)

X: remaining oil not less than 100 μg/bearing

Cleaning Conditions

Cleaning tank (Z) 136: boil cleaning for 2 minutes

Pre-rinsing tank (AH) 137: ultrasonic waves (28 kHz, 200 W) cleaning for 1 minute Rinsing tank (AC) 138: ultrasonic waves (28 kHz, 200 W) cleaning for 1 minute Vapor zone (AA) 139: vapor-cleaning for 1 minute, and then standing for 2 minutes Condensate of cleaning agent: 500 ml/min Feed of cleaning agent to soil-separating tank: 110 ml/min Liquid temperature of soil-separating tank: 3 to 6° C.

Liquid temperature of tank for liquid treated in soil-separating tank (X) 115: 3 to 6° C.

Separation filter: EUS04AV (commercial name: EU-TEC, manufactured by Asahi Chemical Industry Co., Ltd.)

Cleaning agent used for test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol-dimethyl ether=50/30/20 (% by mass)

Rinsing agent used for test: a mixture of methyl perfluorobutyl ether and methyl perfluoroisobutyl ether (commercial name: HFE7100, manufactured by Sumitomo 3M Limited)/3-methyl-3-methoxybutanol/dipropylene glycol-dimethyl ether=99/0.6/0.4 (% by mass)

Metal processing oil used for test: FM220 (commercial name, YUSHIRON FORMER, manufactured by YUSHIRO CHEMICAL INDUSTRY CO., LTD.)

EXAMPLE 94

The result was summarized as follows.

Cleaning property: ◎

After cleaning with the cleaning agent containing 2% by mass of the processing oil, dip-pre-rinsing was conducted, and as a result, superior cleaning property could be confirmed.

EXAMPLE 95

The result was summarized as follows.

Cleaning property: ◎

After cleaning with the cleaning agent containing 4% by mass of the processing oil, dip-pre-rinsing was conducted, and as a result, superior cleaning property could be obtained.

TABLE 1

| Component (parts by weight) | | Example 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|---|
| Component a1 | A mixture of methyl perfluorobutyl ether and methyl perfluoroisobutyl ether (commercial name of HFE7100, manufactured by Sumitomo 3M Limited) | 95 | 95 | 95 | 95 | 98 | 97 | 97 | 97 | 60 | 70 | 70 | 70 | 50 | 66 | 71 | 46 | 50 | 60 | 55 | 70 | 10 | — |
| | 4H,5H,5H-Perfluoro-cyclopentane (commercial name, Zeorora H manufactured by Nippon Zeon Co., Ltd.) | — | — | — | — | — | — | — | — | — | — | — | — | — | — | — | — | — | — | — | — | 50 | 60 |
| Component a2 | Ethanol | — | — | — | — | — | — | — | 1 | — | — | — | — | — | 4 | 4 | 4 | 4 | 4 | — | 4 | — | — |
| | n-Propanol | — | — | — | — | — | — | — | — | — | — | — | — | — | — | — | — | — | — | — | — | 2 | 2 |
| | i-Propanol | — | — | — | — | — | — | — | — | — | — | — | — | — | — | — | — | — | — | 5 | — | — | — |
| Component b | 3-Methoxybutanol | 5 | — | — | — | — | 2 | — | — | — | — | — | — | — | — | — | — | 26 | — | — | — | — | — |
| | 3-Methoxy-3-methylbutanol | — | 5 | — | — | 1 | — | 2 | 1 | 40 | — | — | — | 30 | — | — | 30 | — | — | — | 10 | — | — |
| | Diethylene glycol n-butyl ether | — | — | 5 | — | — | — | — | — | — | 30 | — | — | — | 30 | — | — | — | 20 | — | — | — | 20 |
| | Dipropylene glycol mono-methyl ether | — | — | — | — | — | — | — | — | — | — | — | — | — | — | — | — | — | — | 20 | — | 20 | — |
| | Diethylene glycol n-butyl ether | — | — | — | — | — | 1 | — | — | — | — | — | — | — | — | — | — | 20 | — | 20 | — | 18 | 18 |
| | Dipropylene glycol monomethyl ether | — | — | — | — | 1 | — | — | 1 | — | — | 30 | — | 20 | — | — | 20 | — | 16 | — | — | — | — |
| | 3-Methoxy-3-methylbutyl acetate | — | — | — | — | — | — | — | — | — | — | — | — | — | — | — | — | — | — | — | 16 | — | — |
| | Butyl lactate | — | — | — | 5 | — | — | 1 | — | — | — | — | 30 | — | — | 25 | — | — | — | — | — | — | — |
| Component c | 2,6-Di-t-butyl-p-cresol | — | — | — | — | 0.05 | — | — | — | — | — | — | — | — | — | — | — | — | 0.05 | — | — | 0.05 | — |
| | (1) Flash point | ○ | ○ | ○ | ○ | ○ | ○ | ○ | ○ | ○ | ○ | ○ | ○ | ○ | ○ | ○ | ○ | ○ | ○ | ○ | ○ | ○ | ○ |

TABLE 2

| Component (parts by weight) | | Comparative Example 1 | 2 | 3 | 4 | 5 | 6 | 7 | 8 | 9 | 10 | 11 | 12 |
|---|---|---|---|---|---|---|---|---|---|---|---|---|---|
| Component a1 | A mixture of methyl perfluorobutyl ether and methyl perfluoroisobutyl ether (commercial name of HFE7100, manufactured by Sumitomo 3M Limited) | — | — | — | — | — | — | — | — | — | 96 | 95 | — |
| | 4H,5H,5H-Perfluorocyclopentane (commercial name, Zeorora H manufactured by Nippon Zeon Co., Ltd.) | — | — | — | — | — | — | — | — | — | — | — | 98 |
| Component a2 | Ethanol | 100 | — | — | — | — | — | — | — | — | 4 | — | — |
| | n-Propanol | — | — | — | — | — | — | — | — | — | — | — | 2 |
| | i-Propanol | — | 100 | — | — | — | — | — | — | — | — | 5 | — |
| Component b | 3-Methyl-3-methoxybutanol | — | — | 100 | — | — | — | — | — | — | — | — | — |
| | Diethylene glycol n-butyl ether | — | — | — | 100 | — | — | — | — | — | — | — | — |
| | Dipropylene glycol mono-n-propyl ether | — | — | — | — | 100 | — | — | — | — | — | — | — |
| | Diethylene glycol n-butyl ether | — | — | — | — | — | 100 | — | — | — | — | — | — |
| | Dipropylene glycol dimethyl ether | — | — | — | — | — | — | 100 | — | — | — | — | — |
| | 3-Methyl-3-methoxylbutyl acetate | — | — | — | — | — | — | — | 100 | — | — | — | — |
| | Butyl lactate | — | — | — | — | — | — | — | — | 100 | — | — | — |
| | (1) Flash point | X | X | X | X | X | X | X | X | X | X | X | X |

TABLE 3

| Component (parts by weight) | | Example 23 | 24 | 25 | 26 | 27 | 28 | 29 | 30 | 31 | 32 | 33 |
|---|---|---|---|---|---|---|---|---|---|---|---|---|
| Component a1 | 4H,5H,5H-Perfluorocyclopentane (commercial name, Zeorora H manufactured by Nippon Zeon Co., Ltd.) | — | — | — | — | 60 | 60 | 70 | — | — | — | 15 |
| | A mixture of methyl perfluorobutyl ether and methyl perfluoroisobutyl ether (commercial name of HFE7100, manufactured by Sumitomo 3M Limited) | 60 | 50 | 60 | 60 | — | — | — | 45 | 68 | 60 | 54 |

TABLE 3-continued

| | | | | | | | | | | | | | |
|---|---|---|---|---|---|---|---|---|---|---|---|---|---|
| | | | 2H,3H-Perfluoropentane (commercial name of VERTREL XF, manufactured by Mitsu Dupon Fluorochemical) | — | — | — | — | — | — | — | — | — | — | — |
| | Component a2 | | Ethanol | — | — | — | — | — | — | — | — | 2 | — | 1 |
| Component b | Component b1 | Hydrophilic | Diethylene glycol mono-n-butyl ether | — | — | — | — | — | — | 10 | — | — | — | — |
| | | | 3-Methyl-3-methoxybutanol | 40 | — | — | — | 20 | — | — | 36 | — | — | — |
| | | | Dipropylene glycol monomethyl ether | — | 50 | — | — | — | — | — | — | — | — | — |
| | | Hydrophobic | Dipropylene glycol mono-n-propyl ether | — | — | — | — | — | — | — | — | — | 15 | — |
| | | | Dipropylene glycol mono-n-butyl ether | — | — | — | — | — | 20 | — | — | 20 | — | 10 |
| | Component b2 | Hydrophilic | Diethylene glycol dimethyl ether | — | — | — | — | 20 | — | — | — | — | — | — |
| | | | Diethylene glycol diethyl ether | — | — | — | — | — | 20 | — | — | 15 | — | — |
| | | Hydrophobic | Diethylene glycol di-n-butyl ether | — | — | 40 | — | — | — | 20 | — | — | 25 | — |
| | | | Dipropylene glycol dimethyl ether | — | — | — | — | — | — | — | 19 | — | — | 20 |
| | | | 3-Methyl-3-methoxybutyl acetate | — | — | — | — | — | — | — | — | — | — | — |
| | | | Butyl lactate | — | — | — | 40 | — | — | — | — | — | — | — |
| Component c | | | 2,6-Di-t-butyl-p-cresol | — | — | — | — | — | — | — | — | — | — | 0.05 |
| | | (2) Oil dissolution property | | ○ | ○ | ○ | ○ | ○ | ◎ | ◎ | ◎ | ◎ | ◎ | ◎ |
| | | (3) Rosin dissolution property | | ○ | Δ | ○ | ○ | ◎ | ◎ | ○ | ◎ | ◎ | ◎ | ◎ |
| | | (4) Flux dissolution property | | ○ | ○ | ○ | ○ | ◎ | ○ | ○ | ◎ | ◎ | ○ | ○ |

| | | | | | Example | | | | | | Comparative Example | | |
|---|---|---|---|---|---|---|---|---|---|---|---|---|---|
| Component (parts by weight) | | | | | 34 | 35 | 36 | 37 | 38 | 39 | 13 | 14 | 15 |
| | Component a1 | | 4H,5H,5H-Perfluorocyclopentane (commercial name, Zeorora H manufactured by Nippon Zeon Co., Ltd.) | | 45 | — | — | — | — | — | 100 | — | — |
| | | | A mixture of methyl perfluorobutyl ether and methyl perfluoroisobutyl ether (commercial name of HFE7100, manufactured by Sumitomo 3M Limited) | | 15 | — | 50 | 50 | 66 | 60 | — | 100 | — |
| | | | 2H,3H-Perfluoropentane (commercial name of VERTREL XF, manufactured by Mitsu Dupon Fluorochemical) | | — | 60 | — | — | — | — | — | — | 100 |
| | Component a2 | | Ethanol | | — | — | — | — | 4 | 4 | — | — | — |
| Component b | Component b1 | Hydrophilic | Diethylene glycol mono-n-butyl ether | | — | 20 | — | — | — | — | — | — | — |
| | | | 3-Methyl-3-methoxybutanol | | — | — | 30 | 20 | — | — | — | — | — |
| | | | Dipropylene glycol monomethyl ether | | — | — | — | — | — | — | — | — | — |
| | | Hydrophobic | Dipropylene glycol mono-n-propyl ether | | 20 | — | — | — | — | 16 | — | — | — |
| | | | Dipropylene glycol mono-n-butyl ether | | — | — | — | — | 10 | — | — | — | — |
| | Component b2 | Hydrophilic | Diethylene glycol dimethyl ether | | — | — | — | — | — | — | — | — | — |
| | | | Diethylene glycol diethyl ether | | 20 | — | — | — | — | 10 | — | — | — |
| | | Hydrophobic | Diethylene glycol di-n-butyl ether | | — | 20 | — | 20 | — | — | — | — | — |
| | | | Dipropylene glycol dimethyl ether | | — | — | — | — | 20 | — | — | — | — |
| | | | 3-Methyl-3-methoxybutyl acetate | | — | — | 20 | — | — | 10 | — | — | — |
| | | | Butyl lactate | | — | — | — | 10 | — | — | — | — | — |
| Component c | | | 2,6-Di-t-butyl-p-cresol | | 0.05 | — | — | — | — | — | — | — | — |
| | | (2) Oil dissolution property | | | ◎ | ◎ | ○ | ◎ | ◎ | ◎ | X | X | X |
| | | (3) Rosin dissolution property | | | ◎ | ○ | ◎ | ◎ | ◎ | ◎ | X | X | X |
| | | (4) Flux dissolution property | | | ◎ | ◎ | ◎ | ◎ | ◎ | ◎ | X | X | X |

TABLE 4

| | | Example | | | | | | | | | | | | | | | Comparative Example | |
|---|---|---|---|---|---|---|---|---|---|---|---|---|---|---|---|---|---|---|
| Component (parts by weight) | | 40 | 41 | 42 | 43 | 44 | 45 | 46 | 47 | 48 | 49 | 50 | 51 | 52 | 53 | 54 | 16 | 17 |
| Component a1 | A mixture of methyl perfluorobutyl ether and methyl perfluoroisobutyl ether (commercial name of HFE7100, manufactured by Sumitomo 3M Limited) | 90 | 95 | 95 | 95 | 95 | 95 | 94 | 95 | 95 | 93 | 97 | 97 | 95 | — | 93 | 100 | — |
| | 2H,3H-Perfluoropentane (commercial name of VERTREL XF, manufactured by Mitsui Dupon Fluorochemical) | — | — | — | — | — | — | — | — | — | — | — | — | — | 90 | — | — | 100 |
| Component a2 | Ethanol | — | — | — | — | — | — | 1 | — | — | — | — | 1 | — | — | 2 | — | — |
| | Isopropanol | — | — | — | — | — | — | — | — | — | 2 | — | — | — | — | — | — | — |
| Component b | 3-Methoxybutanol | 10 | — | — | — | — | — | — | — | — | — | — | — | — | 5 | — | — | — |
| | 3-Methyl-3-methoxylbutanol | — | 5 | — | — | — | — | — | — | — | 5 | — | 1 | — | — | 3 | — | — |
| | Dipropylene glycol mono-n-propyl ether | — | — | 5 | — | — | — | — | — | — | — | 2 | — | — | — | — | — | — |

TABLE 4-continued

| | Component (parts by weight) | Example 40 | 41 | 42 | 43 | 44 | 45 | 46 | 47 | 48 | 49 | 50 | 51 | 52 | 53 | 54 | Comparative Example 16 | 17 |
|---|---|---|---|---|---|---|---|---|---|---|---|---|---|---|---|---|---|---|
| | Dipropylene glycol mono-n-butyl ether | — | — | — | 5 | — | — | — | — | — | — | — | — | 2 | — | — | — | — |
| | Diethylene glycol diethyl ether | — | — | — | — | 5 | — | — | — | — | — | — | — | 3 | — | — | — | — |
| | Diethylene glycol di-n-butyl ether | — | — | — | — | — | 5 | — | — | — | — | 1 | — | — | — | — | — | — |
| | Dipropylene glycol dimethyl ether | — | — | — | — | — | — | 5 | — | — | — | — | 1 | — | 5 | — | — | — |
| | 3-Methyl-3-methoxybutyl acetate | — | — | — | — | — | — | — | 5 | — | — | — | — | — | — | — | — | — |
| | Butyl lactate | — | — | — | — | — | — | — | — | 5 | — | — | — | — | — | 2 | — | — |
| Component c | 2,6-Di-t-butyl-p-cresol | — | — | — | — | — | — | — | — | — | — | — | 0.05 | 0.05 | — | — | — | — |
| (5) Rinsing property | Soil concentration in cleaning agent: 0% by mass | ◎ | ◎ | ◎ | ◎ | ◎ | ◎ | ◎ | ◎ | ◎ | ◎ | ◎ | ◎ | ◎ | ◎ | ◎ | ○ | ○ |
| | Soil concentration in cleaning agent: 3% by mass | ○ | ○ | ○ | ○ | ○ | ○ | ◎ | ○ | ○ | ◎ | ○ | ◎ | ○ | ○ | ◎ | X | X |

TABLE 5

| | Component (parts by weight) | Example 55 | 56 | 57 | 58 | 59 | 60 | 61 | 62 |
|---|---|---|---|---|---|---|---|---|---|
| Component a1 | 4H,5H,5H-Perfluorocyclopentane (commercial name, Zeorora H manufactured by Nippon Zeon Co., Ltd.) | — | — | — | 70 | 70 | — | — | 55 |
| | A mixture of methyl perfluorobutyl ether and methyl perfluoroisobutyl ether (commercial name of HFE7100, manufactured by Sumitomo 3M Limited) | 70 | 79 | 78 | — | — | 70 | 78 | 15 |
| | 2H,3H-Perfluoropentane (commercial name of VERTREL XF, manufactured by Mitsu Dupon Fluorochemical) | — | — | — | — | — | — | — | — |
| Component a2 | Ethanol | — | 1 | — | — | — | — | 2 | — |
| | Methyl ethyl ketone | — | — | 2 | — | — | — | — | — |
| Component b | Diethylene glycol diethyl ether | 30 | — | — | — | — | — | — | — |
| | Diethylene glycol dimethyl ether | — | — | — | — | — | — | — | — |
| | Diethylene glycol dibutyl ether | — | 20 | — | — | — | — | — | 30 |
| | Diethylene glycol monobutyl ether | — | — | 20 | — | — | — | 20 | — |
| | Dipropylene glycol monomethyl ether | — | — | — | 30 | — | — | — | — |
| | Dipropylene glycol monopropyl ether | — | — | — | — | 30 | — | — | — |
| | Dipropylene glycol dimethyl ether | — | — | — | — | — | 30 | — | — |
| | 3-Methyl-3-methoxybutanol | — | — | — | — | — | — | — | — |
| Component c | 2,6-Di-t-butyl-p-cresol | 0.05 | — | 0.01 | — | 0.05 | 0.05 | 0.05 | 0.05 |
| | Octadecyl-3-(3,5-di-t-butyl-4-hydroxyphenyl)propionate | — | 0.05 | — | — | — | — | — | — |
| | 1-Oxy-3-methyl-4-isopropylbenzene | — | — | — | 0.01 | — | — | — | — |
| | Trisnonylphenyl phosphite | — | — | 0.01 | — | — | — | — | — |
| Component d | 2-(2'-Hydroxy-5'-methylphenyl)-benztriazol | — | — | — | 0.01 | — | — | — | — |
| | Oxidation stability (pH) | ○ | ○ | ○ | ○ | ○ | ○ | ○ | ○ |

| | Component (parts by weight) | Example 63 | 64 | 65 | 66 | 67 | Comparative Example 18 | 19 | 20 |
|---|---|---|---|---|---|---|---|---|---|
| Component a1 | 4H,5H,5H-Perfluorocyclopentane (commercial name, Zeorora H manufactured by Nippon Zeon Co., Ltd.) | 70 | — | — | — | — | — | — | — |
| | A mixture of methyl perfluorobutyl ether and methyl perfluoroisobutyl ether (commercial name of HFE7100, manufactured by Sumitomo 3M Limited) | 8 | 50 | 50 | — | 85 | — | 50 | — |

TABLE 5-continued

| | | | | | | | | | | |
|---|---|---|---|---|---|---|---|---|---|---|
| | 2H,3H-Perfluoropentane (commercial name of VERTREL XF, manufactured by Mitsu Dupon Fluorochemical) | — | — | — | 20 | — | — | — | 20 |
| Component a2 | Ethanol | — | — | — | — | — | — | — | — |
| | Methyl ethyl ketone | 2 | — | — | — | — | — | — | — |
| Component b | Diethylene glycol diethyl ether | — | — | 25 | — | 10 | 10 | 25 | — |
| | Diethylene glycol dimethyl ether | — | — | 25 | — | — | — | 25 | — |
| | Diethylene glycol dibutyl ether | — | — | — | — | — | — | — | — |
| | Diethylene glycol monobutyl ether | 20 | — | — | 80 | 5 | — | — | 80 |
| | Dipropylene glycol monomethyl ether | — | — | — | — | — | — | — | — |
| | Dipropylene glycol monopropyl ether | — | — | — | — | — | — | — | — |
| | Dipropylene glycol dimethyl ether | — | 30 | — | — | — | — | — | — |
| | 3-Methyl-3-methoxybutanol | — | 20 | — | — | — | — | — | — |
| Component c | 2,6-Di-t-butyl-p-cresol | 0.05 | 0.05 | 0.05 | 0.05 | 0.05 | — | — | — |
| | Octadecyl-3-(3,5-di-t-butyl-4-hydroxyphenyl)propionate | — | — | — | — | — | — | — | — |
| | 1-Oxy-3-methyl-4-isopropylbenzene | — | — | — | — | — | — | — | — |
| | Trisnonylphenyl phosphite | — | — | — | — | — | — | — | — |
| Component d | 2-(2'-Hydroxy-5'-methylphenyl)-benztriazol | — | — | — | — | — | — | — | — |
| | Oxidation stability (pH) | ○ | ○ | ○ | ○ | ○ | X | X | X |

TABLE 6

| | | | Example | | | | | | | | | | | | Comparative Example | |
|---|---|---|---|---|---|---|---|---|---|---|---|---|---|---|---|---|
| | Component (parts by weight) | | 68 | 69 | 70 | 71 | 72 | 73 | 74 | 75 | 76 | 77 | 78 | 79 | 21 | 22 |
| Composition of (e) cleaning agent | a1 | A mixture of methyl perfluorobutyl ether and methyl perfluoroisobutyl ether (commercial name of HFE7100, manufactured by Sumitomo 3M Limited) | 40 | 40 | 60 | 50 | 50 | 50 | 40 | 40 | 60 | 50 | 50 | 50 | 100 | 100 |
| | a2 | Isopropanol | — | 4 | — | — | 4 | 4 | — | 4 | — | — | 4 | 4 | — | — |
| | b | 3-Methyl-3-methoxybutanol | — | — | — | 30 | 28 | 28 | — | — | — | 30 | 28 | 28 | — | — |
| | | Dipropylene glycol dimethyl ether | — | — | — | 20 | 18 | 18 | — | — | — | 20 | 18 | 18 | — | — |
| | | Dipropylene glycol monomethyl ether | 60 | 56 | 40 | — | — | — | 60 | 56 | 40 | — | — | — | — | — |
| | c | 2,6-Di-t-butyl-p-cresol | — | — | — | — | — | 0.05 | — | — | — | — | — | 0.05 | — | — |
| (7) Cleaning test in actual use 1 | | Flux cleaning | ○ | ◎ | ○ | ○ | ◎ | ◎ | — | — | — | — | — | — | X | — |
| | | De-grease cleaning | ○ | ○ | ○ | ○ | ○ | ○ | — | — | — | — | — | — | X | — |
| (8) Cleaning test in actual use 2 | | Flux cleaning | — | — | — | — | — | — | ○ | ◎ | ○ | ○ | ◎ | ◎ | — | X |
| | | De-grease cleaning | — | — | — | — | — | — | ○ | ○ | ○ | ○ | ○ | ○ | — | X |

TABLE 7

| | | | Example | | | | | | | | | Comparative Example | |
|---|---|---|---|---|---|---|---|---|---|---|---|---|---|
| | Component (parts by weight) | | 80 | 81 | 82 | 83 | 84 | 85 | 86 | 87 | 88 | 23 | 24 |
| Composition of (e) cleaning agent | a1 | A mixture of methyl perfluorobutyl ether and methyl perfluoroisobutyl ether (commercial name of HFE7100, manufactured by Sumitomo 3M Limited) | 50 | 50 | 50 | 40 | 40 | 60 | 50 | 50 | 50 | 100 | 100 |
| | a2 | Isopropanol | — | 4 | 4 | — | 4 | — | — | 4 | 4 | — | — |
| | b | 3-Methyl-3-methoxybutanol | 30 | 28 | 28 | — | — | — | 30 | 28 | 28 | — | — |
| | | Dipropylene glycol dimethyl ether | 20 | 18 | 18 | — | — | — | 20 | 18 | 18 | — | — |
| | | Diethylene glycol mono-n-butyl ether | — | — | — | 60 | 56 | 40 | — | — | — | — | — |
| | c | 2,6-Di-t-butyl-p-cresol | — | — | 0.05 | — | — | — | — | — | 0.05 | — | — |
| (9) Cleaning test in actual use 3 | | Flux cleaning | ○ | ◎ | ◎ | — | — | — | — | — | — | X | — |
| | | De-grease cleaning | ○ | ○ | ○ | — | — | — | — | — | — | X | — |
| (10) Cleaning test in actual use 4 | | Flux cleaning | — | — | — | ○ | ◎ | ○ | ○ | ◎ | ◎ | — | X |
| | | De-grease cleaning | — | — | — | ○ | ○ | ○ | ○ | ○ | ○ | — | X |

Industrial Applicability

The cleaning agent and rinsing agent in accordance with the present invention comprise a combination of components differing in their vapor pressure, and therefore exhibit superior dissolution property to oil and flux as well as diminishing the possibility of ignition. Further, according to the cleaning method, soil-separating method and cleaning apparatus in accordance with the present invention, vapor of the cleaning agent generated by boiling the cleaning agent in accordance with the present invention and its condensate are used, thereby completing drying as well as cleaning.

That is, (b) a component having a vapor pressure of less than $1.33\times10^3$ Pa at 20° C., which is superior in cleaning property to various soil, is combined with (a1) a chlorine-free fluorine-containing compound having a vapor pressure of not less than $1.33\times10^3$ Pa at 20° C., which is superior in drying property, low in possibility of ignition and remarkably inferior in cleaning property. Thereby, boil-cleaning with the cleaning agent containing the component (b), and rinsing with a condensate of said cleaning agent, which condensate contains a small amount of the component (b), can be carried out substantially in a one-liquid manner, and a cleaning method and apparatus effectively making use of the characteristic feature of the component (b) superior in cleaning property to various soil can be provided.

Further, the cleaning agent containing the component (a1) of the chlorine-free fluorine-containing compound is enabled to have no flash point owing to the characteristic feature such that the chlorine-free fluorine-containing compound has no flash point. Thereby, the possibility of ignition can be diminished, and as a result, a low cost cleaning system can be established, because the plant including the cleaning machine requires no explosion-protecting structure to protect ignition and explosion, and moreover an existing cleaning plant can be used as it is.

Furthermore, the cleaning agent in the cleaning tank and the liquid obtained by condensing vapor of said cleaning agent are transferred to the soil-separating tank, wherein two liquids are contacted with each other, thereby separating and removing the soil dissolved in the cleaning agent, and thereafter, the liquid freed from the soil is returned to the cleaning tank. As a result, the soil in the cleaning agent can be effectively separated in a continuous manner, and further when a separation filter is provided, higher soil-separating property can be obtained.

The cleaning agent, rinsing agent, cleaning method, soil-separating method and cleaning apparatus in accordance with the present invention, if desired, can be used in combination thereof to obtain a long life of the cleaning agent, diminish oxidation decomposition and the possibility of ignition, and easily dissolution-clean all types of soil from the surface of a material to be cleaned.

What is claimed is:

1. A soil-separating method, comprising the steps of:

cleaning with (e) a cleaning agent having no flash point, which comprises (a1) a chlorine-free fluorine-containing compound having a vapor pressure of not less than $1.33\times10^3$ Pa at 20° C., and (b) a component having a vapor pressure of less than $1.33\times10^3$ Pa at 20° C., contacting (f) a liquid obtained by condensing vapor of the cleaning agent, which comprises from 90.0% by mass to 99.9% by mass of the component (a1), and the cleaning agent contaminated with soil in a cleaning tank with each other in a soil-separating tank, thereby separating soil dissolved in said cleaning agent, and returning the liquid freed from soil to the cleaning tank;

wherein the component (a1) is a poor solvent to a soil.

2. The soil-separating method according to claim 1, wherein the liquid treated in the soil-separating tank is transferred through the separation filter, and thereafter returned to the cleaning tank.

3. The soil-separating method according to claim 1, wherein the cleaning agent (e) having no flash point further comprises (a2) at least one compound having a vapor pressure of not less than $1.33\times10^3$ Pa at 20° C., which is selected from the group consisting of alcohols, ketones, esters, and hydrocarbons.

4. The soil-separating method according to claim 1, wherein component (a1) contains a compound selected from the group consisting of methyl perfluorobutyl ether, methyl perfluoroisobutyl ether, and a mixture thereof.

5. The soil-separating method according to claim 1, wherein component (b) contains at least one compound selected from the group consisting of glycol ethers, glycol ether acetates, and hydroxycarboxylic acid esters.

6. The soil-separating method according to claim 1, wherein component (b) contains at least one compound selected from the group consisting of compounds represented by the following formulas (1), (2), (3), and (4),

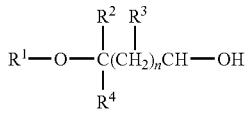

(1)

wherein $R^1$ is an alkyl, alkenyl or cycloalkyl group having 1 to 6 carbon atoms, $R^2$, $R^3$ and $R^4$ are each hydrogen or a methyl group, and n is an integer of 0 or 1,

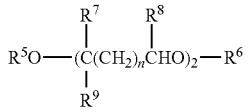

(2)

wherein $R^5$ is an alkyl, alkenyl or cycloalkyl group having 4 to 6 carbon atoms, $R^7$, $R^8$ and $R^9$ are each hydrogen or a methyl group, $R^6$ is an alkyl, alkenyl or cycloalkyl group having 3 to 6 carbon atoms, and n is an integer of 0 or 1,

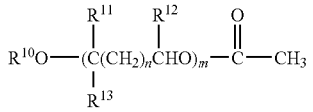

(3)

wherein $R^{10}$ is an alkyl, alkenyl or cycloalkyl group having 1 to 6 carbon atoms, $R^{11}$, $R^{12}$ and $R^{13}$ are each hydrogen or a methyl group, n is an integer of 0 or 1, and m is an integer of 1 to 4, and

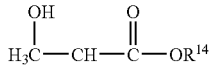

(4)

wherein $R^{14}$ is an alkyl, alkenyl or cycloalkyl group having 1 to 6 carbon atoms.

7. The soil-separating method according to claim 1, wherein component (b) contains a combination of (b1) at least one compound selected from glycol ether monoalkyl ethers and (b2) at least one compound selected from glycol ether dialkyl ethers.

8. The soil-separating method according to claim 7, wherein the combination contains at least one compound selected from hydrophilic glycol ether monoalkyl ethers as the component (b1) and at least one compound selected from hydrophobic glycol ether dialkyl ethers as the component (b2).

9. The soil-separating method according to claim 7, wherein the combination contains at least one compound selected from hydrophobic glycol ether monoalkyl ethers as the component (b1) and at least one compound selected from hydrophilic glycol ether dialkyl ethers as the component (b2).

10. The soil-separating method according to claim 7, wherein both the component (b1) and the component (b2) are hydrophilic.

11. The soil-separating method according to claim 7, wherein both the component (b1) and the component (b2) are hydrophobic.

12. The soil-separating method according to claim 7, wherein the component (b1) contains at least one compound selected from the group consisting of 3-methoxybutanol, 3-methyl-3-methoxybutanol, dipropylene glycol mono-n-propyl ether and dipropylene glycol mono-n-butyl ether.

13. The soil-separating method according to claim 7, wherein the component (b2) contains at least one compound selected from the group consisting of diethylene glycol diethyl ether, diethylene glycol di-n-butyl ether, and dipropylene glycol dimethyl ether.

14. The soil-separating method according to claim 1, wherein the cleaning agent (e) having no flash point further comprises (c) an antioxidant.

15. The soil-separating method according to claim 14, wherein the component (c) contains at least one compound selected from the group consisting of phenol antioxidants, amine antioxidants, phosphorus antioxidants, and sulfur antioxidants.

16. The soil-separating method according to claim 14, wherein the component (c) is a combination of at least one compound selected from the group consisting of phenol antioxidants and amine antioxidants, and at least one compound selected from the group consisting of phosphorus antioxidants and sulfur antioxidants.

17. The soil-separating method according to claim 14, wherein the component (c) has a melting point of not higher than 120° C.

18. The soil-separating method according to claim 1, wherein the cleaning agent (e) having no flash point further comprises (d) an ultraviolet absorber.

19. The soil-separating method according to claim 1, characterized by transferring a liquid through a separation filter, the liquid being obtained by contacting a liquid obtained by condensing vapor of a cleaning agent and the cleaning agent contaminated with soil in a cleaning tank, and thereafter returning the transferred liquid to the cleaning tank.

20. A cleaning method, comprising the step of:

cleaning with (e) a cleaning agent having no flash point, which comprises (a1) a chlorine-free fluorine-containing compound having a vapor pressure of not less than $1.33\times10^3$ Pa at 20° C., and (b) a component having a vapor pressure of less than $1.33\times10^3$ Pa at 20° C., combined with the soil-separating method according to claim 1.

21. A cleaning method, comprising the step of:

pre-rinsing before rinsing with use of a liquid treated by the soil-separating method according to claim 1 as a pre-rinsing agent, combined with the cleaning method according to claim 20.

22. A cleaning method, comprising the steps of:

cleaning with a cleaning agent, which comprises (a1) a chlorine-free fluorine-containing compound having a vapor pressure of not less than $1.33\times10^3$ Pa at 20° C., and (b) a component having a vapor pressure of less than $1.33\times10^3$ Pa at 20° C., successively carrying out pre-rinsing with a pre-rinsing agent containing the component (b), and thereafter carrying out rinsing or/and vapor-cleaning with vapor of the pre-rinsing agent containing the component (b) or a condensate of said vapor, combined with the cleaning method according to claim 20.

* * * * *